US006755230B2

(12) United States Patent
Ulatowski et al.

(10) Patent No.: US 6,755,230 B2
(45) Date of Patent: Jun. 29, 2004

(54) POWERED CONTROL SYSTEM FOR A COVERING FOR ARCHITECTURAL OPENINGS

(75) Inventors: Bogdan R. Ulatowski, Westminster, CO (US); Michael S. Holford, Broomfield, CO (US); Joseph E. Kovach, Brighton, CO (US); Marek Jarosinski, Brighton, CO (US); Gary F. Skinner, Westminster, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/124,046

(22) Filed: Apr. 16, 2002

(65) Prior Publication Data

US 2003/0000653 A1 Jan. 2, 2003

Related U.S. Application Data

(60) Provisional application No. 60/284,065, filed on Apr. 16, 2001.

(51) Int. Cl.[7] ..... A47H 5/00

(52) U.S. Cl. ..... 160/84.02; 160/168.1 V; 160/174 R; 160/178.1 V

(58) Field of Search ..... 160/84.02, 168.1 V, 160/168.1 R, 170.1 V, 170.1 R, 173 R, 173 V, 174 R, 174 V, 177 R, 177 V

(56) References Cited

U.S. PATENT DOCUMENTS

| | | | | |
|---|---|---|---|---|
| 93,297 A | * | 7/1869 | Schnelby et al. | 318/16 |
| 1,468,433 A | | 9/1923 | Zackow | |
| 1,820,328 A | | 8/1931 | Schlegel | 16/122 |
| 2,164,206 A | | 6/1939 | Gits et al. | 16/122 |
| 2,503,441 A | | 4/1950 | Kamm | 160/172 V |
| 2,621,723 A | | 12/1952 | Etten | 160/34 |
| 2,660,751 A | | 12/1953 | Falkenberg | 16/122 |
| 2,759,534 A | | 8/1956 | Harju | 160/168 |
| 2,822,043 A | | 2/1958 | Horak | 160/712 V |
| 2,854,071 A | | 9/1958 | Toti | 160/176 |
| 2,869,636 A | | 1/1959 | Klenz | |
| 2,876,834 A | | 3/1959 | Walker | 160/168 |
| 3,079,005 A | | 2/1963 | Bednar | 211/96 |
| 3,240,260 A | | 3/1966 | Rabinow | 160/176.1 V |
| 3,280,891 A | | 10/1966 | Eldredge, Jr. et al. | |
| 3,329,385 A | | 7/1967 | Dietsch | 211/96 X |
| 3,334,682 A | | 8/1967 | Eldredge, Jr. | 160/178 |
| 3,434,524 A | | 3/1969 | Fein | |
| 3,486,549 A | | 12/1969 | Rosenquist | 160/183 |
| 3,693,696 A | | 9/1972 | Salzmann | |
| D231,326 S | | 4/1974 | Miki | D8/9 |
| 3,851,699 A | | 12/1974 | Shapiro | 160/900 X |
| 3,996,988 A | | 12/1976 | De Wit | 160/168 R |
| 4,054,918 A | * | 10/1977 | Kamogawa et al. | 358/214 |
| 4,122,884 A | | 10/1978 | Salzmann | |
| 4,214,622 A | | 7/1980 | Debs | 160/168 A |

(List continued on next page.)

FOREIGN PATENT DOCUMENTS

| | | | |
|---|---|---|---|
| CA | 576369 | 5/1959 | 160/900 |
| DE | 2637067 A1 | 2/1978 | |
| DE | 3048763 | 8/1982 | |

(List continued on next page.)

*Primary Examiner*—Bruce A. Lev
(74) *Attorney, Agent, or Firm*—Dorsey & Whitney LLP

(57) ABSTRACT

A powered remotely actuated control system adapted for use in a covering system for an architectural opening and a covering system incorporating the control system are described. The control system includes: (1) a translational drive system for selectively moving a vertically-orientated vanes between extended and retracted positions, (ii) an angular drive system for selectively pivoting or rotating the vanes between an opened angular position and a closed angular position; and (iii) a logic system for determining the relative translational and angular positions of the vanes, as well as, decoding and executing commands received from a wireless remote control.

84 Claims, 45 Drawing Sheets

U.S. PATENT DOCUMENTS

| | | | | | |
|---|---|---|---|---|---|
| 4,267,875 | A | | 5/1981 | Koks | 160/176 R |
| 4,293,021 | A | | 10/1981 | Arena | 160/178 R |
| 4,316,493 | A | | 2/1982 | Arena | 160/168 R |
| 4,361,179 | A | | 11/1982 | Benthin | 160/176 R |
| 4,366,852 | A | | 1/1983 | Holzer | 160/320 |
| 4,381,029 | A | | 4/1983 | Ford et al. | 160/172 |
| 4,381,812 | A | | 5/1983 | Ford et al. | 160/168 R |
| 4,386,644 | A | | 6/1983 | Debs | 160/174 |
| 4,425,955 | A | | 1/1984 | Kaucic | 160/168 R |
| 4,425,956 | A | | 1/1984 | Terlecke | 160/168.1 R |
| 4,438,798 | A | | 3/1984 | Ford et al. | 160/126 |
| 4,557,309 | A | | 12/1985 | Judkins | 160/84 R |
| 4,628,981 | A | | 12/1986 | Ciriaci et al. | 160/176 R |
| 4,646,808 | A | | 3/1987 | Anderson | 160/178 C |
| 4,648,436 | A | | 3/1987 | Oskam | 160/168 R |
| 4,657,060 | A | * | 4/1987 | Kaucic | 160/168 R |
| 4,662,422 | A | | 5/1987 | Anderson | 160/168 R |
| 4,724,883 | A | | 2/1988 | Liebowitz | 160/84 R |
| 4,736,784 | A | * | 4/1988 | Boloix | 160/168.1 |
| 4,773,464 | A | | 9/1988 | Kobayashi | 160/168.1 |
| 4,779,661 | A | | 10/1988 | Yalowega | 160/178.1 V |
| 4,799,527 | A | | 1/1989 | Villoch et al. | 160/168.1 |
| 4,802,522 | A | | 2/1989 | Anderson | 160/168.1 |
| 4,834,162 | A | | 5/1989 | John | 160/168.1 |
| 4,834,163 | A | | 5/1989 | Dickstein | 160/176.1 |
| 4,848,434 | A | * | 7/1989 | Morris et al. | 160/168.1 |
| 4,856,574 | A | * | 8/1989 | Minami et al. | 160/168.1 |
| 4,869,309 | A | | 9/1989 | Evans | 160/177 |
| 4,902,953 | A | * | 2/1990 | Kraft et al. | 318/663 |
| 4,909,298 | A | | 3/1990 | Langhart et al. | 160/178.1 |
| 4,936,370 | A | | 6/1990 | Uecker et al. | 160/168.1 V |
| 5,004,033 | A | | 4/1991 | Stipkovits | 160/178.1 |
| 5,012,850 | A | | 5/1991 | Schrader | 160/38 |
| 5,029,365 | A | | 7/1991 | McCabe | 16/87.4 R |
| 5,088,542 | A | | 2/1992 | Biba et al. | 160/168.1 |
| D325,681 | S | | 4/1992 | Gartenmaier | D6/580 |
| 5,109,913 | A | | 5/1992 | Kazuma | 160/332 |
| 5,237,169 | A | * | 8/1993 | Grehant | 250/214 AL |
| 5,249,617 | A | | 10/1993 | Durig | 160/168.1 |
| 5,263,528 | A | | 11/1993 | Patel | 160/178.2 |
| 5,270,629 | A | * | 12/1993 | Hsieh | 318/600 |
| 5,289,863 | A | | 3/1994 | Schon | 160/168.1 |
| 5,351,741 | A | | 10/1994 | Swopes | 160/168.1 |
| 5,465,779 | A | | 11/1995 | Rozon | 160/176.1 V X |
| 5,467,808 | A | * | 11/1995 | Bell | 160/168.1 |
| 5,560,414 | A | | 10/1996 | Judkins et al. | 160/178.1 |
| 5,562,140 | A | | 10/1996 | Biba | 160/178.1 |
| 5,603,369 | A | | 2/1997 | Colson et al. | 160/900 X |
| 5,626,177 | A | | 5/1997 | Colson et al. | 160/168.1 |
| 5,638,881 | A | | 6/1997 | Ruggles et al. | 160/168.1 V |
| 5,713,407 | A | | 2/1998 | Judkins | 169/900 X |
| 5,743,318 | A | | 4/1998 | Ruggles et al. | 160/168.1 V |
| 5,760,558 | A | * | 6/1998 | Popat | 318/480 |
| 5,793,174 | A | * | 8/1998 | Kovach et al. | 318/468 |
| 5,819,833 | A | | 10/1998 | Swiszcz et al. | 160/168.1 V |
| 5,894,877 | A | * | 4/1999 | Sommerfeld | 160/168.1 V |
| 6,076,588 | A | | 6/2000 | Swiszcz et al. | 160/168.1 V |
| 6,084,231 | A | * | 7/2000 | Popat | 250/214 AL |
| 6,116,322 | A | | 9/2000 | Anderson et al. | 160/168.1 V |
| 6,135,188 | A | | 10/2000 | Anderson et al. | 160/178.1 V |
| 6,148,894 | A | | 11/2000 | Judkins | 160/177 R |

FOREIGN PATENT DOCUMENTS

| | | |
|---|---|---|
| EP | 111926 | 6/1984 |
| EP | 120425 | 10/1984 |
| EP | 159812 | 10/1985 |
| EP | 446587 | 9/1991 |
| EP | 589846 | 3/1994 |
| FR | 2362264 | 3/1978 |
| FR | 2499390 | 8/1982 |
| GB | 868961 | 5/1961 |
| GB | 1159635 | 7/1969 |
| GB | 1470533 | 4/1977 |
| GB | 2171441 | 8/1986 |
| GB | 2247488 | 3/1992 |
| WO | 87/04057 | 7/1987 |

* cited by examiner

POWERED CONTROL SYSTEM FOR A COVERING FOR ARCHITECTURAL OPENINGS

CROSS-REFERENCE TO RELATED APPLICATIONS

This utility application claims priority to U.S. provisional patent application No. 60/284,065, filed Apr. 16, 2001. This application is also related to U.S. utility patent application Ser. No. 09/525,613, filed Mar. 14, 2000, for Control and Suspension System for a Vertical Vane Covering for Architectural Openings, currently pending, which is a continuation-in-part of U.S. utility patent application Ser. No. 09/007,576, filed Jan. 15, 1998, for End Cap for Headrail in a Covering for an Architectural Opening, now U.S. utility Pat. No. 6,076,588, which is a division of U.S. utility patent application Ser. No. 08/639,905, filed Apr. 24, 1996, for Control and Suspension System for a Vertical Vane Covering for Architectural Openings, now U.S. utility Pat. No. 5,819,833, which is a continuation-in-part of U.S. utility patent application Ser. No. 08/472,992, filed Jun. 7, 1995, for Control and Suspension System for a Vertical Vane Covering for Architectural Openings, now U.S. utility Pat. No. 5,626,177. Each of these patents and patent applications, which are all commonly owned by the owner of the present application, is hereby incorporated by reference as though fully set forth herein.

BACKGROUND OF THE INVENTION a. Field of the Invention

The present invention relates generally to control and suspension systems for coverings for architectural openings such as doors, windows, and the like. More particularly the present invention relates to a remotely-controllable powered system for configuring a covering having a plurality of vertically suspended vanes that are moveable between extended and retracted positions as well as open and closed positions to control visibility and the passage of light through the architectural opening.

b. Background Art

Coverings for architectural openings such as doors, windows, and the like have been known in various forms for many years. One form of such covering is commonly referred to as a vertical vane covering wherein a control system suspends and is operable to selectively manipulate a plurality of vertically suspended vanes such that the vanes can be moved laterally across the architectural opening to extend or retract the covering, and pivoted (or tilted) about longitudinal vertical axes to open and close the vanes.

Control systems for operating vertical vane coverings typically include a headrail in which a plurality of carriers, one associated with each vane, are movably mounted for lateral movement and include internal mechanisms for pivoting the vanes about their vertical axes. The headrails vary in construction and configuration to house the various types of carriers.

As will be appreciated, while the prior art includes many different forms of control systems and headrails in which various types of carriers are movably mounted, they each would benefit from an easily-operated, powered control system.

BRIEF SUMMARY OF THE INVENTION

The powered control system of the present invention is adapted for use in a covering for an architectural opening that includes a plurality of carriers supported by a headrail for independently traversing and pivoting (or tilting) connected vertical vanes used in the covering. The control system includes a translational drive system for selectively moving the vanes between an extended position and a retracted position (i.e., traversing the vanes); and an angular drive system for selectively pivoting or rotating the vanes about pivot axes parallel to, or collinear with, the vane longitudinal axes, between an opened angular position and a closed angular position (i.e., tilting the vanes). Each carrier is mounted on the headrail for sliding movement and supports a single vane.

As part of the translational drive system, the plurality of carriers are interconnected by a scissors-type (or pantograph) linkage so that the vanes suspended by the carriers can be stacked adjacent one side (single-draw system) or both sides (double-draw or center-draw system) of an architectural opening when the covering is retracted, but are uniformly spaced when the covering is extended to cover all or a portion of the architectural opening. In the preferred embodiment, the scissors-type linkage is disposed above the headrail. In the single-draw system depicted in, for example, FIG. 2, a lead one of the carriers is connected to a beaded traverse cord and is moveable by the beaded cord longitudinally of the headrail (i.e., transversely of the opening adjacent to which the architectural covering is mounted), and this movement of the lead carrier causes the remaining follower carriers to move therewith by action of the scissors-type linkage. The present invention includes additional hardware and firmware comprising a powered control system to enable remote operation and control of the translational drive system.

As part of the angular drive system, each carrier includes components to enable rotation (i.e., tilting) of the vanes about pivot axes substantially parallel to, or substantially collinear with, the vanes' longitudinal, vertical axes. For example, each carrier could include a rack and pinion system for pivoting a suspended vane. This rack and pinion system, which is operatively engaged with a tilt rod that runs the length of the headrail, is fully disclosed in related U.S. utility patent application Ser. No. 09/525,613, which has been incorporated by reference as though fully set forth herein. Alternatively, the components that enable tilting of the vanes could include the meshing gear system that is also fully disclosed in related U.S. utility patent application Ser. No. 09/525,613. The tilt rod is mounted for rotative movement about its longitudinal axis such that selective rotation of the tilt rod in either rotative direction effects reversible pivotal movement of the vanes about their vertical longitudinal axes.

A system for covering an architectural opening according to one embodiment of the present invention includes a powered control system having a translational drive system operatively engaging a vane to cause selective translational movement of the vane along a guide rail. The powered control system also includes an angular drive system that causes selective rotation of the vane to different angular positions relative to the guide rail. Additionally, a logic system is operatively connected to the translational drive system and to the angular drive system to control and monitor translational motion and angular motion of the vane with respect to the guide rail.

In another embodiment, a system for covering an architectural opening according to the present invention includes a headrail and at least one tilt rod rotatably mounted with respect to said headrail. At least one carrier is operatively mounted on the tilt rod to allow the carrier to translationally move along the tilt rod. A hanger pin is pivotally attached to the at least one carrier, and a first gear train is operatively associated with the at least one carrier and operatively attached between the tilt rod and the hanger pin. At least one vane is operatively attached to the hanger pin. A drive cord is formed in a loop and extends along the headrail and the at least one carrier is attached to the drive cord. This embodiment also includes a powered control system having a translational drive system operatively engaging the drive cord for selective translational movement of the at least one vane along the headrail. The powered control system also includes an angular drive system operatively engaging the tilt rod to cause selective rotation of the at least one vane to different angular positions relative to the headrail, and a logic system operatively connected to the translational drive system and to the angular drive system to control and monitor the translational motion and angular motion of the at least one vane with respect to the headrail.

Other aspects, features, and details of the present invention can be more completely understood by reference to the following detailed description of preferred embodiments, taken in conjunction with the drawings and from the appended claims.

DETAILED DESCRIPTION OF THE PREFERRED EMBODIMENT

Figures 1, 2:
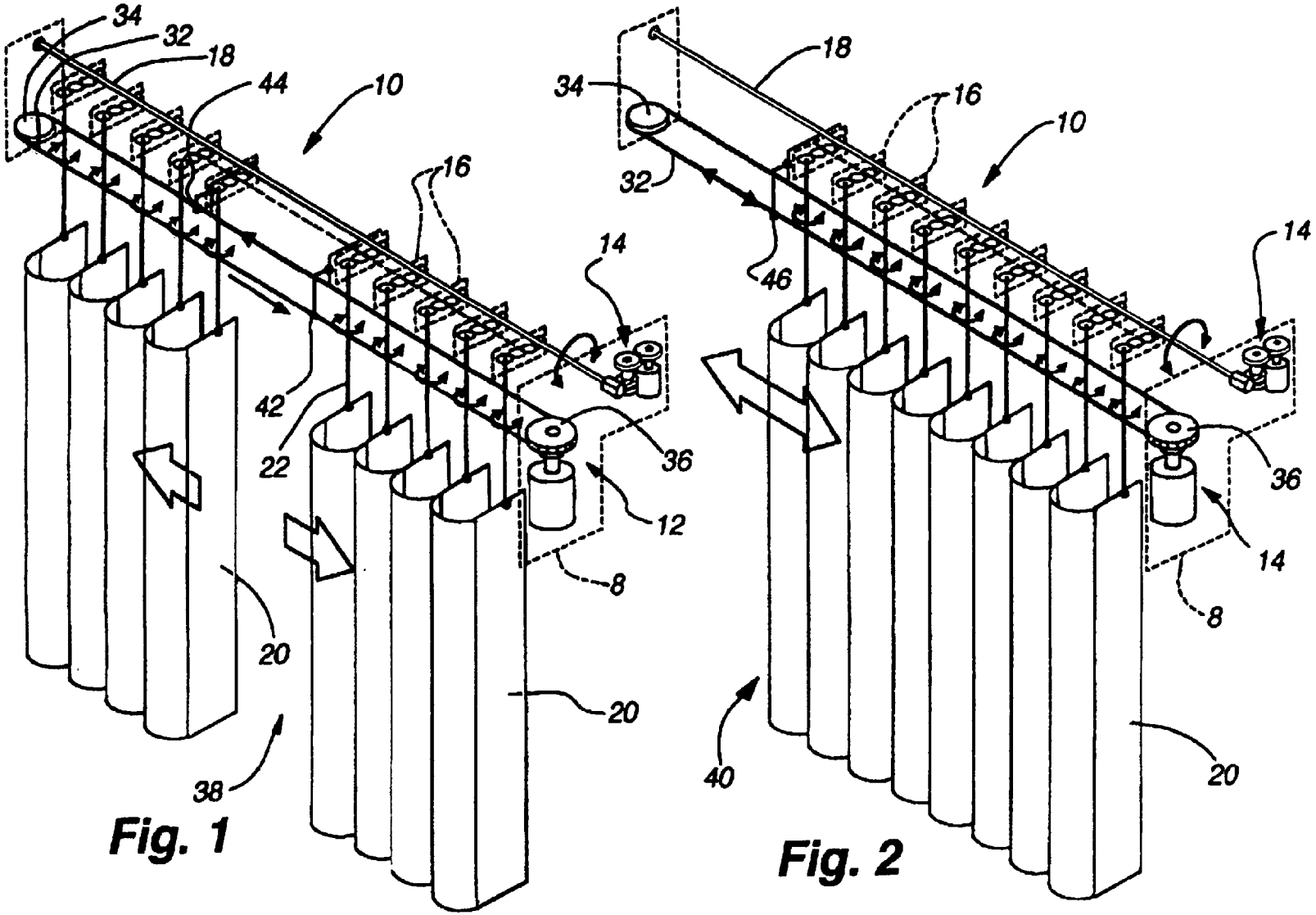
FIG. 1 is a schematic view of a center-draw or dual-draw vertical vane architectural covering having a powered control system.
FIG. 2 is a schematic view of a single-draw vertical vane architectural covering having a powered control system.
Figure 57:
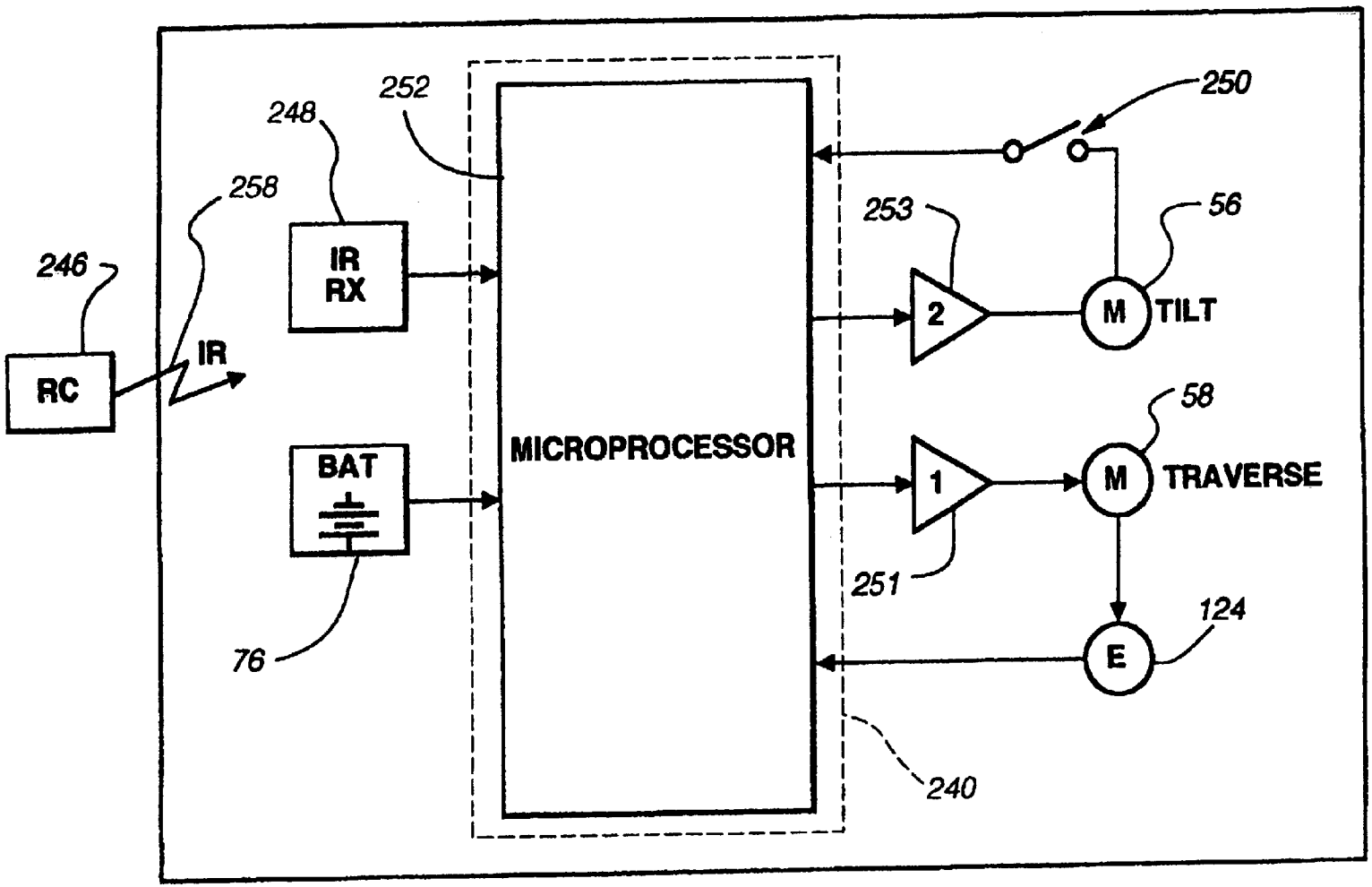
FIG. 57 is a block diagram of the control system hardware.

A vertical blind covering system 10 is schematically shown in FIG. 1 and includes a control system 8 comprising a translational drive system 12, an angular drive system 14, and logic system 240. In certain embodiments, the logic system 240 can comprise a microprocessor as illustrated in FIG. 57. In the schematic vertical blind system of FIG. 1, a plurality of carriers 16 are slidably supported on a tilt rod 18. A vane 20 is suspended from each carrier by a hanger pin 22, which in turn is connected to the tilt rod 18 by an angular rotation gear train 24 (see FIG. 4), which is known in the art. The angular rotation gear train 24 allows a user to control the angular position of the vane 20 about a vertical axis by rotating the tilt rod 18. In the instant invention, an angular drive system 14 is attached at one end of the tilt rod 18 to allow the user to remotely control the angular position of the vanes 20. The movement of each carrier 16 along the tilt rod 18 in translation is controlled by the translation drive system 12, which is part of the control system 8. The carriers 16 that require common movement are attached together by a pantograph structure 30 (see FIG. 5). As shown in FIG. 1, the translation drive system 12 includes a drive cord 32 extending in a loop around two pulleys 34 and 36. The drive cord 32 is attached selectively to two carriers 42 and 44 to create a center opening vane system 38, as shown in FIG. 1, or is attached to one carrier 46 to create an end-collecting blind system 40 as shown in FIG. 2.

Referring back to FIG. 1, for a center opening blind system 38, the front span of the drive cord is attached to a central carrier 42 and the rear span of the drive cord is attached to an adjacent carrier 44 such that when the drive cord 32 is rotated in the loop, the front span moves the carrier it is attached to oppositely from the carrier attached to the rear span of the drive cord.

Referring to FIG. 2, for an end collection blind system 40, only one of the front or rear spans of the drive cord needs to be attached to an end carrier 46 depending on which end the vanes 20 are to be collected on. In both the blinds systems 10 of FIGS. 1 and 2, the angular rotation of the vanes 20 are collectively controlled separately from the translational movement of the carriers 16 along the tilt rod 18. Again, the angular drive system 14 controls the angular position of the vanes 20, while the translational drive system 12 controls the location of the carriers 16 along the tilt rods 18. The translational drive system 12 and the angular drive system 14, along with the logic system 240, together make up the control system 8 as is described in greater detail below.

The control system 8 is primarily described herein as it relates to an end collection blind system as depicted in FIG. 2; however, application of the control system to a center opening blind system as depicted in FIG. 1 is contemplated and would be obvious to one of ordinary skill in the art with the benefit of this disclosure.

Referring still to FIGS. 1 and 2, the vanes are each attached to an adjacent vane 20 by a strip of fabric connecting the adjacent front edges of each vane to one another. This is mere design choice, as the vanes 20 can also be each separate from one another with no interconnection other than through the drive system, as is shown in FIG. 3.

Figure 5:
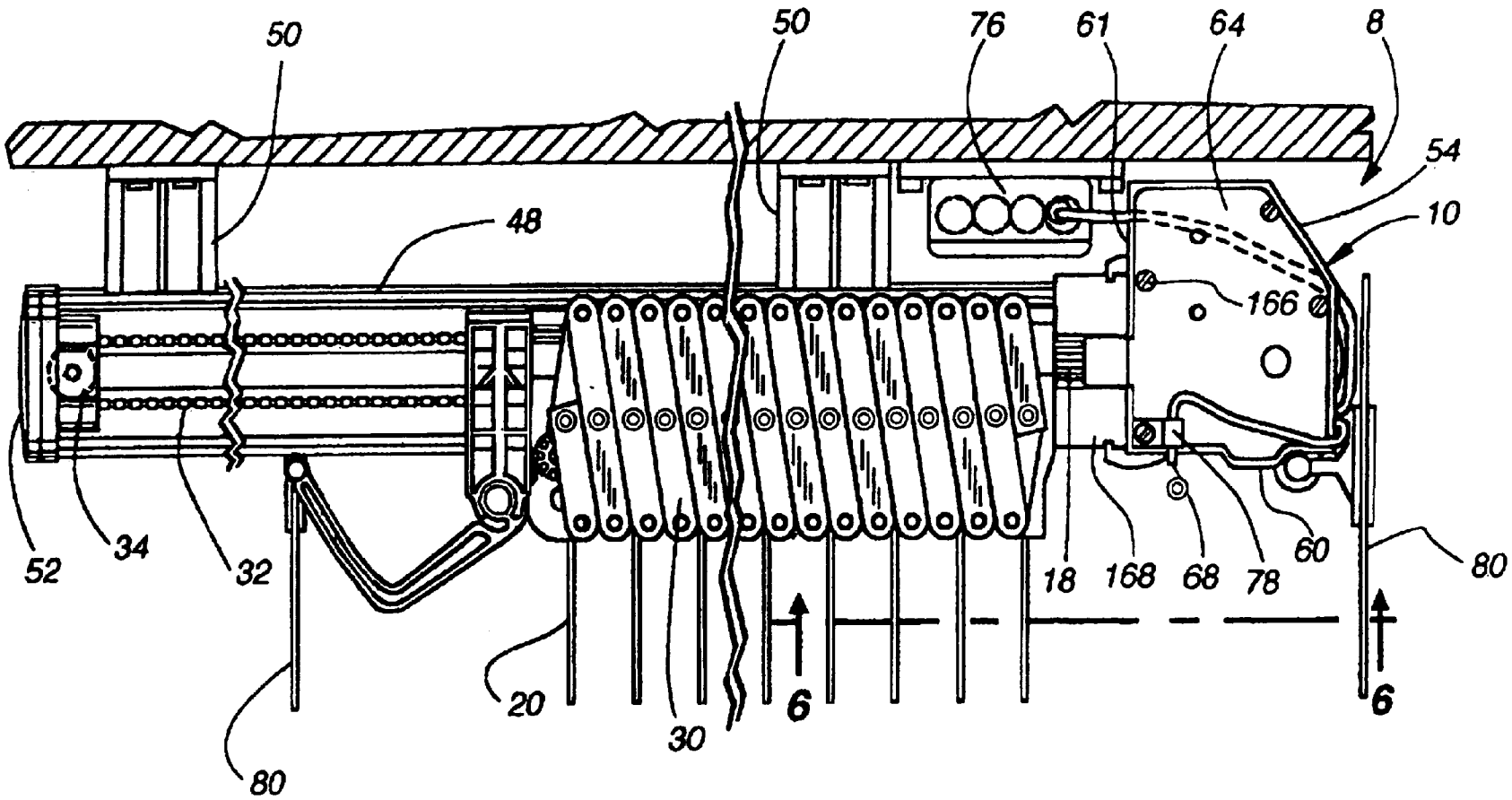
FIG. 5 is a top view of the covering in an open and retracted configuration, showing the control system in its housing structure attached to the headrail, to a scissors-type linkage or pantograph, and to the drive cord.

As a result of the interconnection of the vanes 20 with the control system 8, the vanes 20 rotate angularly about a vertical axis, approximately 180 degrees from the closed position through an open position and back to a closed position by the angular drive system 14. In other words, the vanes 20 can rotate until the front edge of each vane 20 contacts the rear edge of the adjacent vane to either side (at which point the widths of the vanes are generally linearly aligned). Generally, the vanes 20 are always parallel to one another. The angular open position is defined by the vanes extending perpendicularly to the longitudinal axis of a headrail 48, which position is also generally orthogonal to the translational movement of the vanes (see FIG. 3). In the traversing or translational movement of the carriers 16 along the tilt rod 18, and thus of the vanes 20 along the headrail 48, the vanes 20 move from an expanded position as shown in FIG. 3 to a retracted position as shown in FIG. 5. Partially retracted positions are shown in FIGS. 1 and 2. The translational drive system 12 controls the translational position of the carriers 16 along the tilt rod 18.

Figure 3:
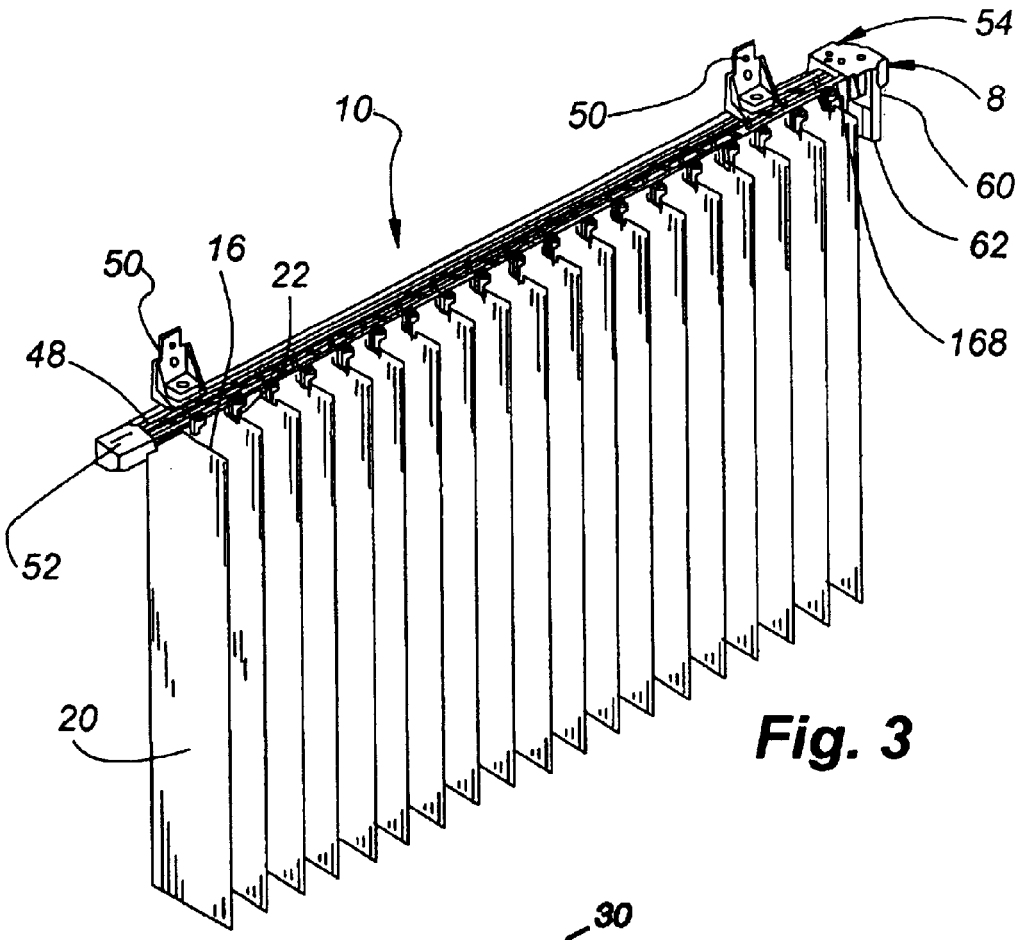
FIG. 3 is a front isometric view of a vertical vane architectural covering showing the brackets for supporting the covering on a wall, the support headrail, a plurality of vanes supported by the headrail, an end cap, and a control system housing structure.

FIG. 3 shows a vertical blind system 10 incorporating the instant invention. In the vertical blind system, the individual vanes 20 are attached by the hanger pin 22 to the carrier 16, with each carrier 16 being attached translationally to the tilt rod 18. Particular carriers 42, 44, and 46, as described above, are also attached to the drive cord 32, which translationally moves the carriers 16 along the tilt rod 18 between an expanded or retracted position, as directed by the translational drive system 12. The vanes 20 as shown in FIG. 3 are in the angularly open position, and are in the translationally extended position. The vanes 20 in FIGS. 1 and 2 are also in the angularly open position, yet are in the partially retracted translational position.

Still referring to FIG. 3, the blind system 10 is typically attached to a structure surrounding an architectural opening, such as a wall, by mounting brackets 50. The mounting brackets attach to the headrail 48 of the blind system and securely attach the blind system 10 to the structure, such as the wall. The headrail 48 provides the skeletal structure in which the tilt rod 18 and the drive cord 32 operate to control the position both translationally and angularly of the carriers 16 and vanes 20, respectively. An end cap 52 is positioned on one end of the headrail 48 and the control system 8 of the present invention is attached to the other end of the headrail 48. Most of the control system 8 for the control of the angular and translational position of the vanes 20 along the headrail 48 is discreetly contained within a housing structure 54 attached to the opposite end of the headrail 48. The housing 54 includes the angular drive system 14, the translational drive system 12, the motor units 56 and 58 for driving these two separate systems, as well as the logic system 240 for controlling the operation of both the angular drive system 14 and the translational drive system 12. The housing 54 includes structure to allow the angular drive system 14 to operatively attach to the tilt rod 18 and the translational drive system 12 to operatively attach to the beaded cord 32.

Figure 4:
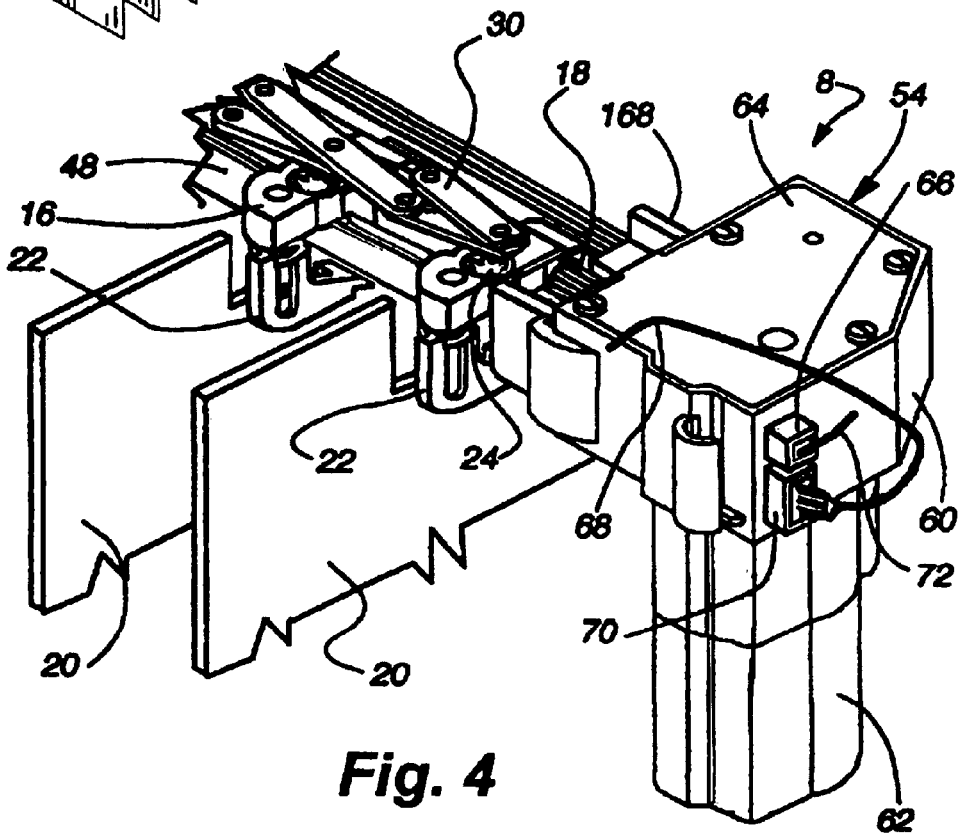
FIG. 4 is an enlarged fragmentary view of the powered drive system of the present invention attached to an end of the headrail from which two vanes are suspended.
Figures 6, 7:
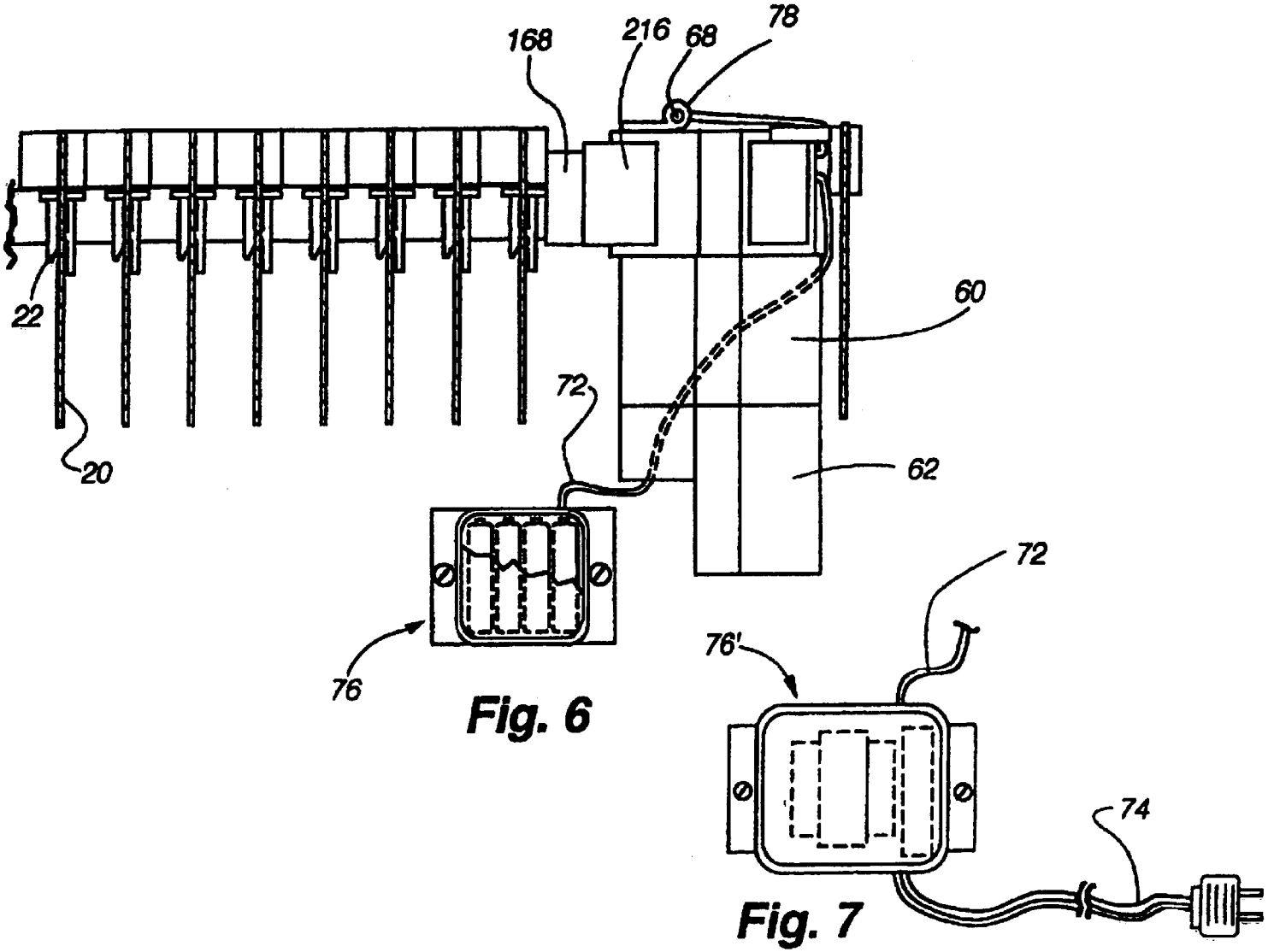
FIG. 6 is a fragmentary front elevation of a covering system that is similar to the covering system of FIG. 5 wherein the powered control system is powered by one or more batteries.
FIG. 7 shows the AC power supply and transformer that may be used to power the control system.

FIG. 4 shows the housing 54 containing the control system 8, including the main housing 60, the lower motor housing 62, and the lid 64. The housing 54 includes a sensor signal plug 70 for attaching a wireless control signal sensor 68 to the logic system for remote control of the logic system, as well as a power input plug 66 for bringing power to both an angular drive motor 56 (also referred to herein as the small motor) (see, e.g., FIG. 20) and a translational drive motor 58 (also referred to herein as a large motor) (see, e.g., FIG. 18). Ideally, the power brought to both motors is a low voltage power input 72 from line voltage conditioned by a transformer 76' (FIG. 7). Alternatively, the power can provided by a battery pack 76 (see FIG. 6). FIG. 4 also shows a connector bracket 168, which attaches the main housing 60 for the control system 8 to the end of the headrail 48, and two carriers 16 mounted on the headrail 48 for translational movement.

A hanger pin 22 depends from each carrier 16, and a vane 20 is attached to each hanger pin 22. The hanger pin 22 is pivotally attached to the carrier 16 to allow the vane 20 to be angularly moved by the angular rotation gear train 24 positioned in the carrier 16. The angular rotation gear train 24 in the carrier 16 is known in the art. As mentioned above, each of the carriers 16 are attached together by a pantograph structure 30, which maintains the desired spacing between adjacent carriers 16 and vanes 20 as the carriers are moved along the tilt rod 18.

The pantograph structure 30 shown in greater detail in FIG. 5, along with the headrail 48, end cap 52, main housing 60, battery pack 76, and beaded cord 32. The vanes 20 are shown in the collected or retracted position.

A power supply (battery pack 76 or transformer 76') is typically mounted on the wall behind the headrail 48 and adjacent to the main housing 60 of the control system 8. The power supply 76 or 76' is connected by the low voltage power input 72 to the power input plug 66 (as shown in FIG. 4). If a transformer 76' is used, an AC power cord 74 extends from the transformer into a suitable outlet as shown in FIG. 7. Depending on the design of the system, the transformer 76' can include a rectifier to change the AC current to a suitable DC current.

Referring back to FIG. 5, the wireless signal sensor 68 is attached to the lid 64 of the housing 54 by a retaining clip 78 to maintain a proper orientation for receiving signals. According to the preferred embodiment, the wireless signal sensor 68 is comprised of a fiber optic cable that receives signals from an infrared remote control (e.g., 246 shown in FIG. 58), although in alternative embodiments the sensor may comprise an antenna to receive radio signals from a suitable remote control.

As also shown in FIG. 5, an aesthetic end vane 80 may be positioned at the end of the main housing 60 and attached thereto to help hide the main housing structure 60 when the blind system is viewed from the side. The connector bracket 168 is shown connected to an inwardly-facing wall 61 of the main housing 60.

FIG. 6 is an elevation of a blind system similar to the one illustrated in FIG. 5, and shows the main housing 60 and lower motor housing 62 connected by the connector bracket 168 to the headrail 48. The lower motor housing 62 is separable from the main housing 60 to allow installation of and replacement of the motors 56 and 58 if needed. A battery pack 76 is shown that provides power to the motors 56 and 58 and the logic circuit. On the top of the main housing, the wireless signal sensor 68 is held in position, similar to FIG. 5, by a retaining clip 78. The vanes 20 in FIG. 6 are shown in the angular open position.

FIG. 7 shows an AC transformer 76' for conditioning line voltage as an alternative power source for the control system 8. An AC power cord 74 extends from the transformer as does the low voltage power input 72.

Figure 8A:
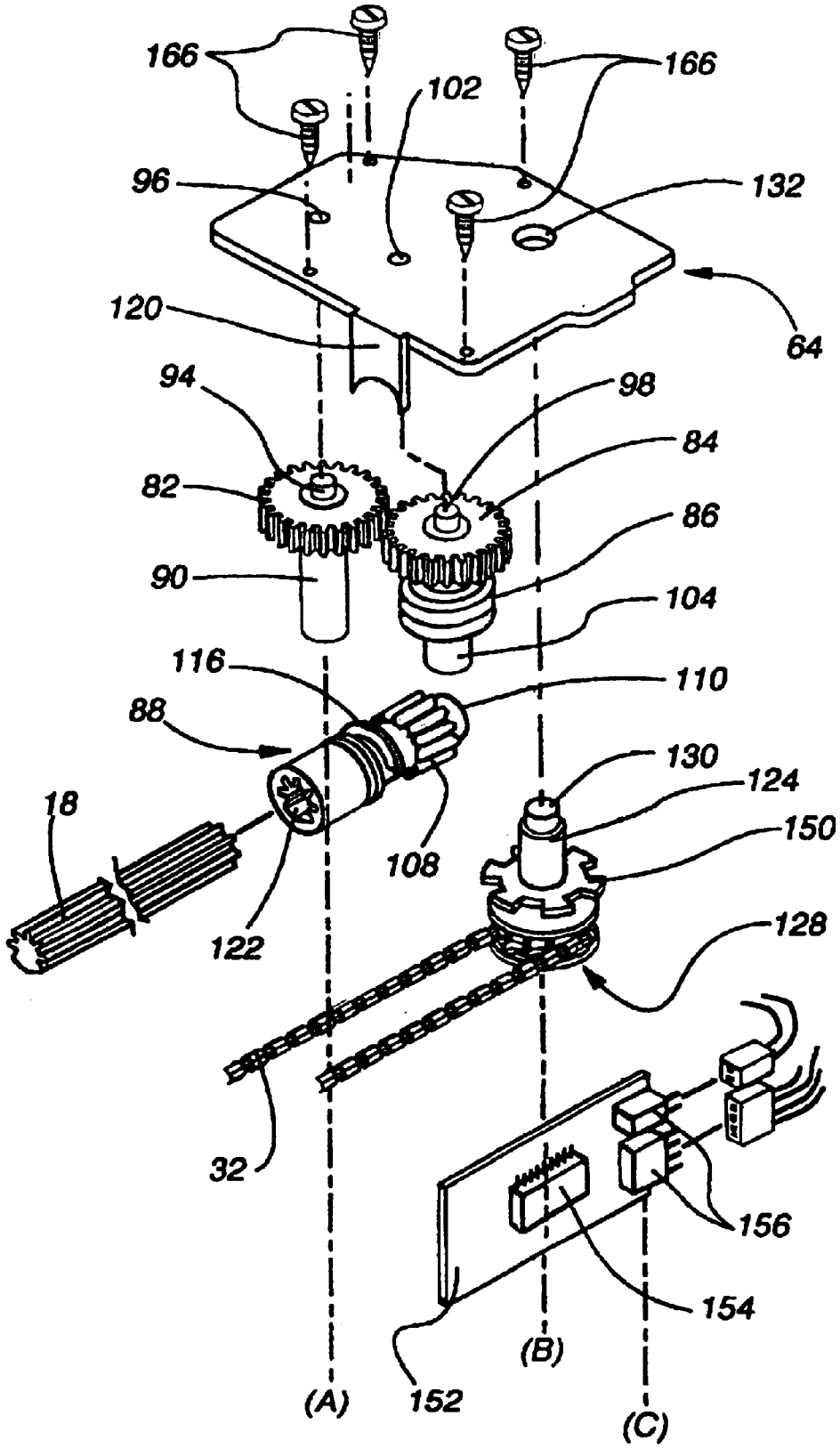
FIGS. 8A and 8B together comprise an exploded view of the internal components of the control system and show the components for engagement with the headrail.
Figure 8B:
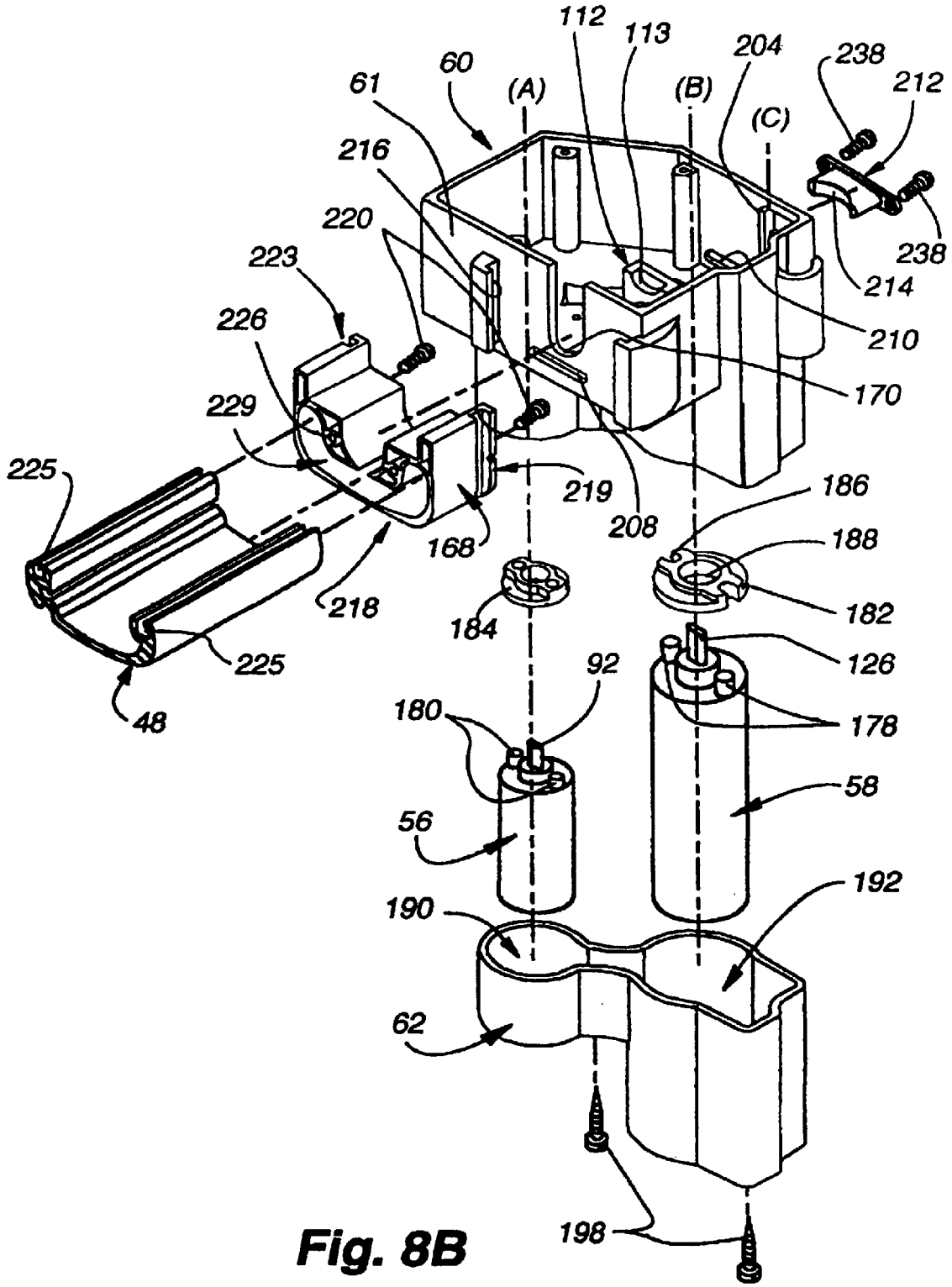

FIGS. 8A and 8B together comprise an exploded view of the components that make up the control system 8, along with the structure by which the control system 8 is attached to the headrail 48. Referring first to FIG. 8A, the angular drive system 14 portion of the control system 8 is made up of a small motor 56 (FIG. 8B) operatively attached to a drive gear 82, which is in turn operatively engaged with a driven slave gear 84. The driven slave gear includes a worm gear 86 thereupon for actuating the tilt rod drive unit 88. The tilt rod drive unit 88 is engaged to the tilt rod 18 such that when the small motor 56 is actuated, the drive gear 82 drives the driven slave gear 84, which in turn actuates the tilt rod drive unit 88 to rotate the tilt rod 18 to change the angular orientation of the vanes 20 of the blind system 10.

The drive gear 82 includes a drive gear shaft 90 having a lower end defining a keyed recess to mate with the output shaft 92 of the small motor 56. The output shaft 92 of the small motor 56 extends into the main housing 60, through the main housing's bottom wall. A top end of the drive gear shaft 90 defines a positioning pin 94 for positioning in a drive gear pin port 96 on the lid 64 of the housing 54. This drive gear pin port 96 on the lid 64 of the housing helps keep the drive gear in its proper vertical orientation. The drive gear 82 itself extends radially from the top end of the drive gear shaft and defines a plurality of teeth around its perimeter for engaging the driven slave gear 84.

The driven slave gear 84 includes a salve gear shaft having gear teeth positioned near its top end for engagement with the drive gear 82, and also defines a worm gear structure 86 along the portion of the length of the salve gear shaft for actuation of the tilt rod drive unit 88. At the top of the slave gear shaft of the driven slave gear 84, a top positioning pin 98 is formed for receipt in the driven slave gear upper pin port 102 formed in the lid 64. This upper pin port 102 formed in the lid 64 helps keep the driven slave gear 84 in proper alignment with the drive gear 82. A bottom end 104 of the shaft of the driven slave gear 84 also defines a positioning pin 105 (FIG. 34) for placement in an aperture 107 (FIG. 14) formed in the floor 172 of the main housing body 60 to keep the driven slave gear 84 in proper alignment.

Figure 34:
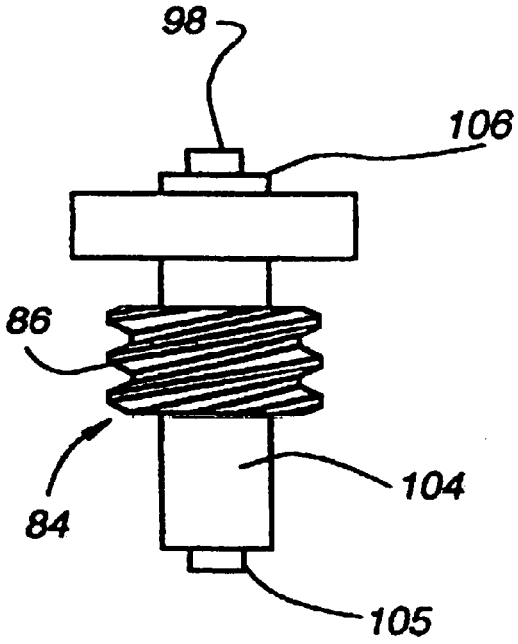
FIG. 34 is a side elevation of the driven slave gear and the bearing surface depicted in FIG. 33.
Figure 33:
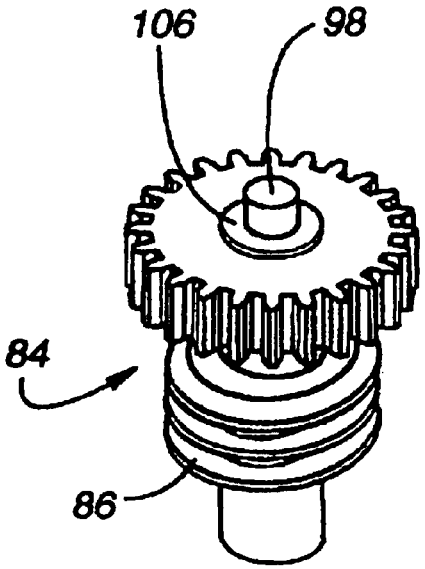
FIG. 33 is an isometric view of the driven slave gear which is a part of the angular rotation drive system of the present invention, including the top positioning pin, the bearing surface, the gear ring, and the worm gear.
Figure 39:
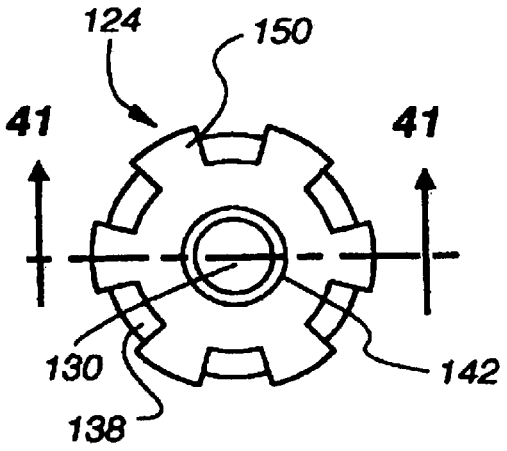
FIG. 39 is a top plan view of the beaded cord drive member depicted in FIG. 37.

FIGS. 33, 34, 35, and 36 show more detail of the driven slave gear 84, including a bearing surface 106 formed around the top positioning pin 98 to help reduce the wear and tear on the gear itself due to its frequent rotation. As can be seen in FIGS. 33 and 34, the worm gear 86 is formed around a length of the shaft and is used to engage the actuator gear 108 on the tilt rod drive unit 88 as is described below.

The combination of the drive gear 82 and the driven slave gear 84 provides a means to change the rotation of the small motor shaft 92 about a vertical axis into the actuation of the tilt rod drive unit 88 around a horizontal axis which is in line with the longitudinal extension of the headrail 48.

Figure 44:
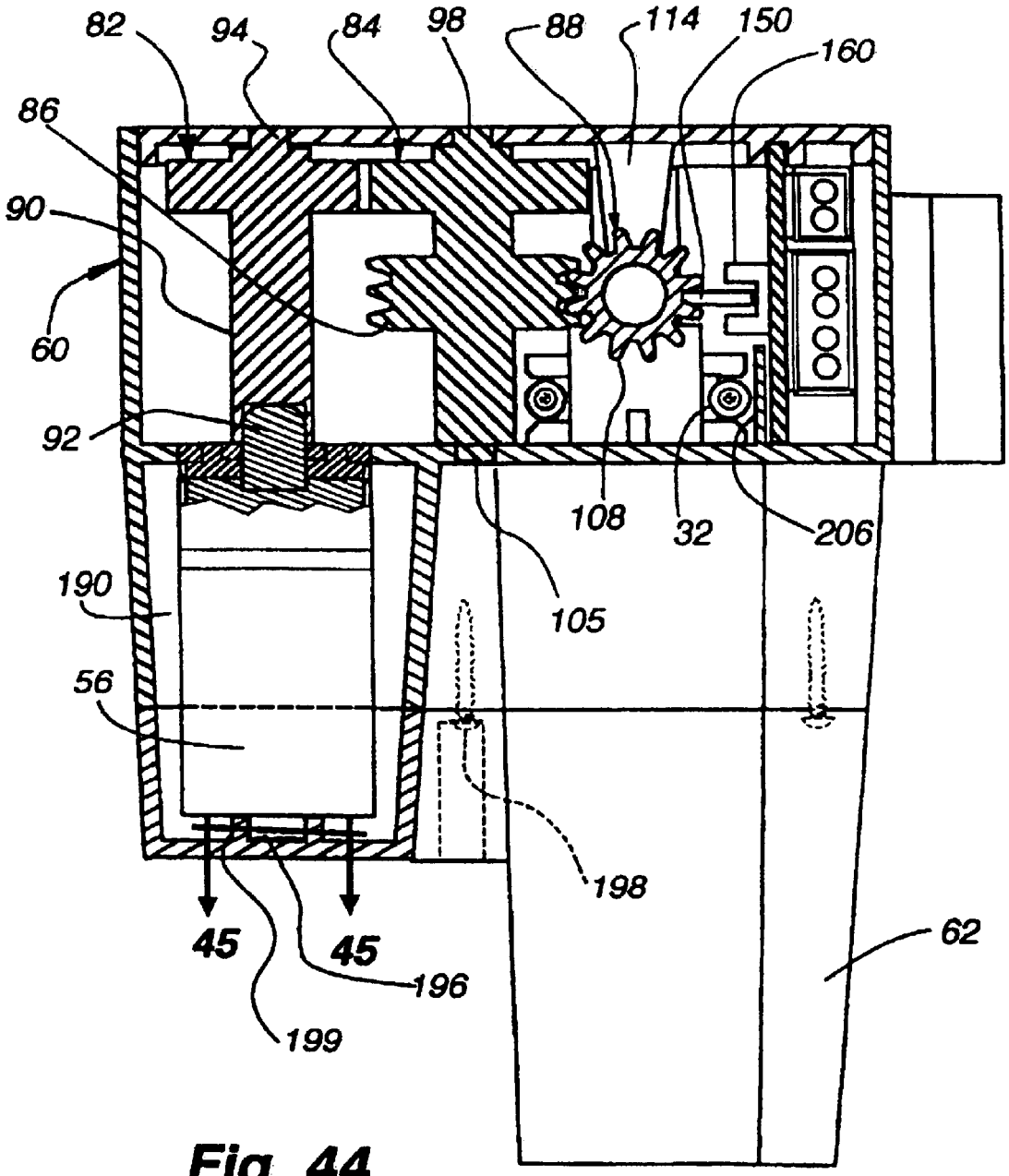
FIG. 44 is a cross-sectional view taken along line 44—44 of FIG. 43, and shows primarily the angular drive system components.

The preferred embodiment tilt rod drive unit 88 is illustrated in FIGS. 8A, 27, 28, 29, 30, 31, and 32 and is generally cylindrical in shape extending horizontally within the main housing 60. A first end of the tilt rod drive unit 88 defines an axle end 110 for support in a post 112 (FIG. 8B) extending upwardly from the bottom of the main housing 60 and defining a semi-circular recess 113 therein at its top end. The axle end 110 is held in that recess 113 (see also FIG. 13) formed in the post 112 by another post 114 (see, e.g., FIG. 9) extending downwardly from the lid 64. As shown in FIG. 44, the downwardly extending post 114 engages the top surface of the axle end 110 and keeps the axle end seated in the recess 113.

Figure 32:
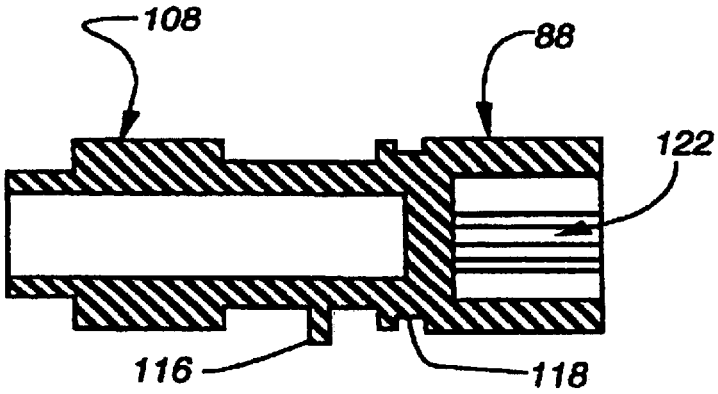
FIG. 32 is a cross-sectional view taken along line 32—32 of FIG. 31 and showing the keyed cavity for receiving an end of the tilt rod at one end of the tilt rod drive unit, and a blank cavity at the opposite end.
Figure 27:
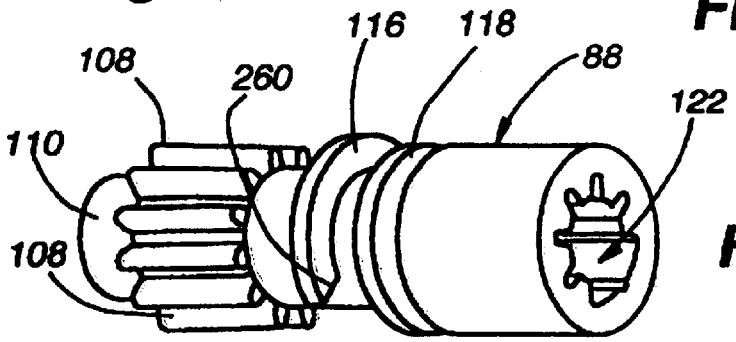
FIG. 27 is an isometric view of a tilt rod drive unit, showing a drive actuator gear, an indicator flange, and a groove for a positioning tang.
Figure 27A:
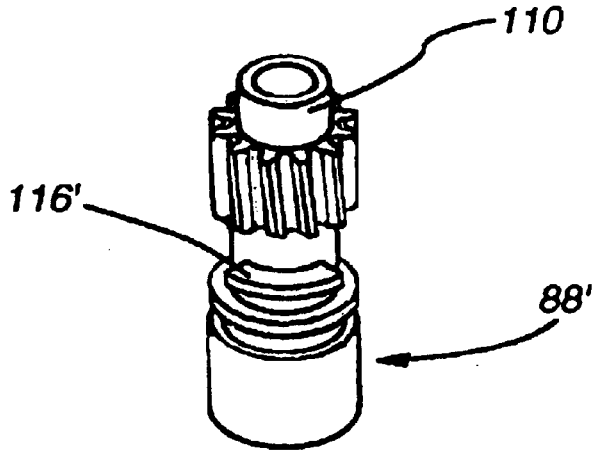
FIG. 27A is an isometric view of an alternative embodiment of a tilt drive unit, showing a drive actuator gear, a first indicator flange and a second indicator flange, and a groove for positioning the tang.
Figure 30A:
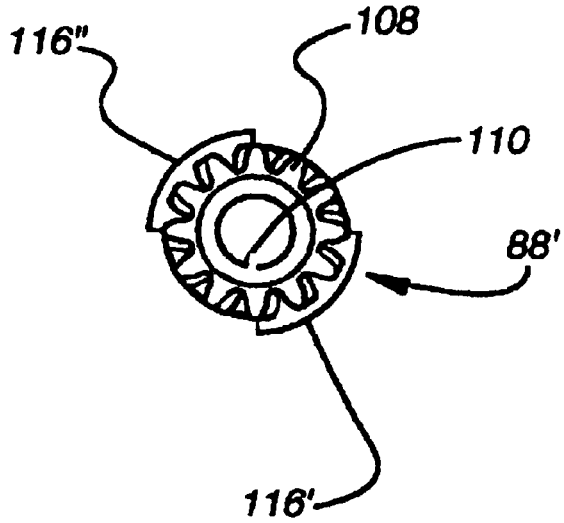
FIG. 30A is an end elevation of the alternative embodiment of the tilt rod drive unit depicted in FIGS. 27A and 29A.
Figure 31A:
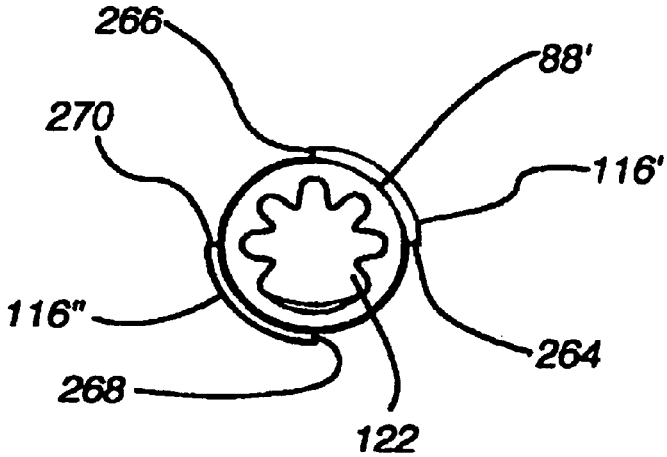
FIG. 31A is an end elevation of the opposite end of the alternative tilt drive unit from that shown in FIG. 30A and shows the first indicator flange extending only one-quarter of the way around the circumference of the tilt rod unit, and showing the second indicator flange extending only one-quarter of the way around the circumference of the tilt rod unit.
Figure 29A:
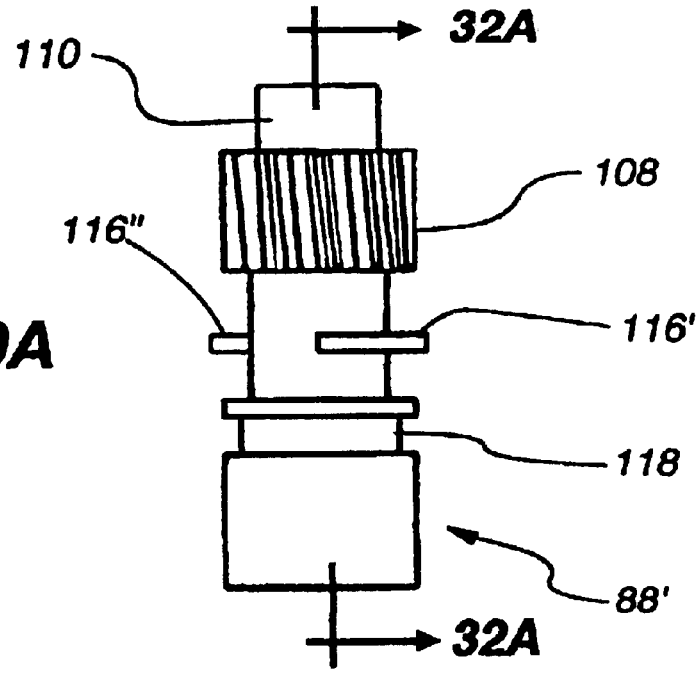
FIG. 29A is a side elevation view of the alternative embodiment of the tilt drive unit depicted in FIG. 27A.
Figure 32A:
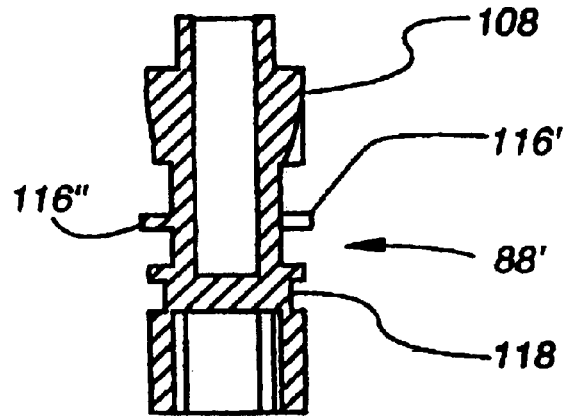
FIG. 32A is a cross-sectional view taken along line 32A—32A of FIG. 29A and showing the keyed cavity for receiving an end of the tilt rod at one end of the tilt rod drive unit, and blank cavity at the opposite end.
Figure 35:
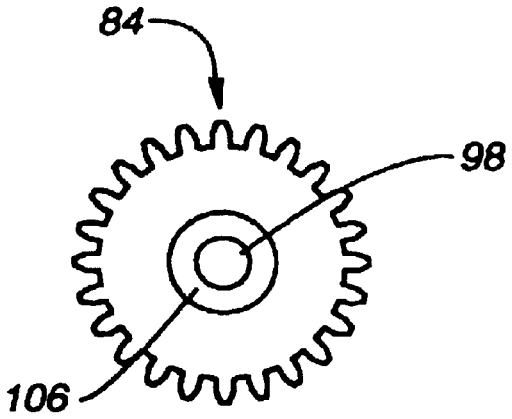
FIG. 35 is a top plan view of the driven slave gear depicted in FIG. 33.
Figure 36:
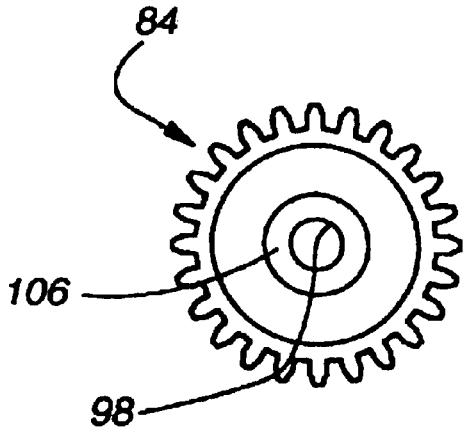
FIG. 36 is a bottom plan view of the driven slave gear depicted in FIG. 33.

A plurality of longitudinally extending gear teeth are positioned on the tilt rod drive unit 88 adjacent to the axle end. These longitudinal gear teeth form the drive unit actuator gear 108 which engages the worm gear 86 on the shaft of the driven slave gear 84. As the driven slave gear 84 is rotated by the drive gear 82, the worm gear 86 engages with the drive unit actuator gear 108 to cause the tilt rod drive unit 88 to rotate about its longitudinal axis. Spaced away from the drive unit actuator gear 108, an indicator flange 116 extends radially from the tilt rod drive unit 88, and is formed approximately halfway around the circumference of the tilt rod drive unit 88 as best shown in FIGS. 27 and 32. The indicator flange 116, as described in greater detail below, helps the logic system determine the angular orientation of the vanes 20 at any given time.

Figure 43:
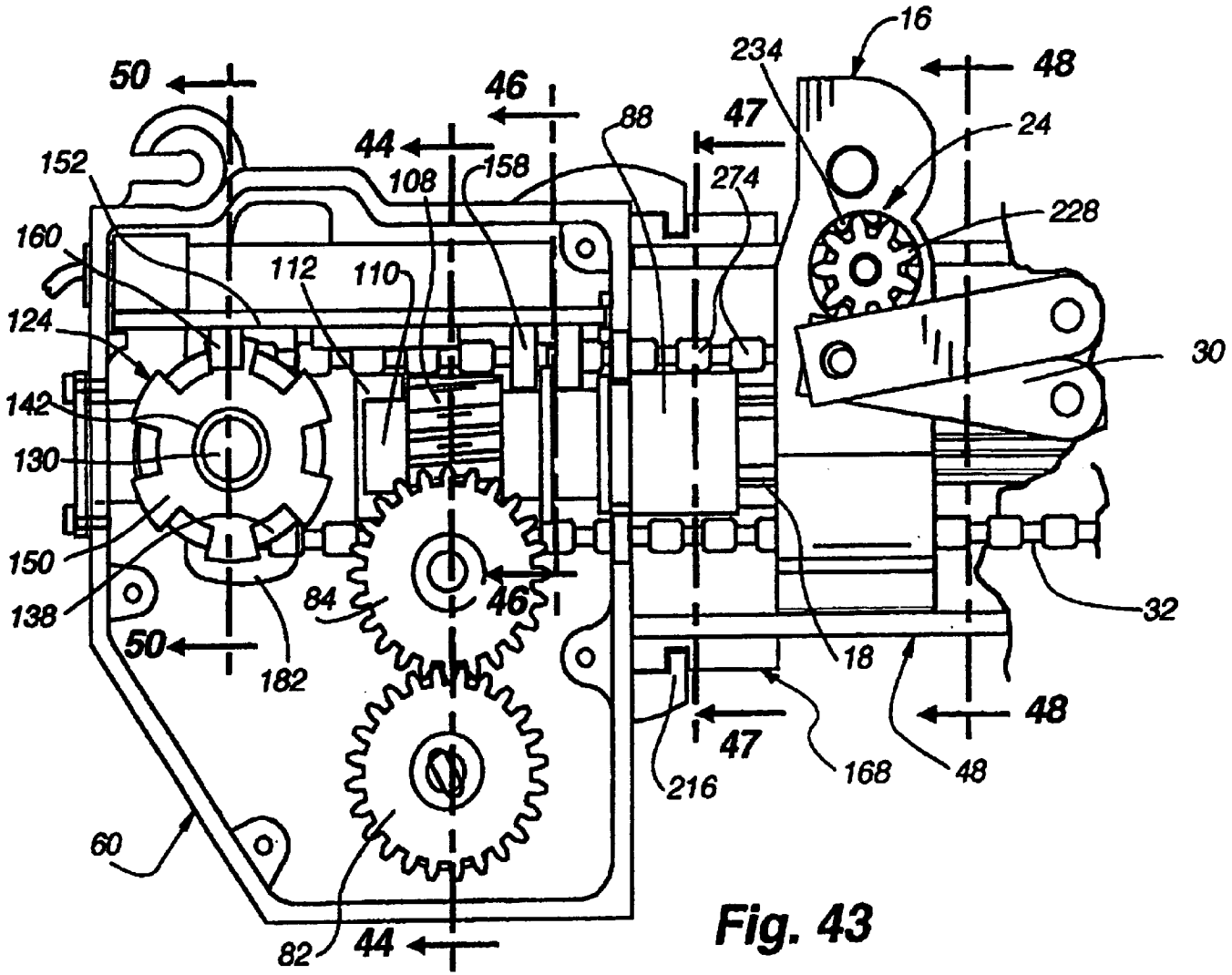
FIG. 43 is a top view similar to that of FIG. 42 showing the components of the control system as assembled inside the housing and connected to the headrail.

Spaced away from the indicator flange 116, an annular groove 118 extending all the way around the circumference of the tilt rod drive unit 88 is formed for receiving the sidewall 61 of the main housing 60 in combination with a positioning tang 120 (see, e.g., FIG. 9) extending downwardly from the lid 64. This holds the tilt rod drive unit 88 properly in the housing 54 as shown in FIG. 43. The wall 61 and tang 120 being received in the annular groove 118 keeps the tilt rod drive unit 88 from moving axially into or out of the housing 54. In combination with the axle end 110 being held in position as described above, the tilt rod drive unit 88 is securely positioned within the housing 54 yet is able to rotate about its longitudinal axis when actuated by the driven slave gear 84.

Figure 68:
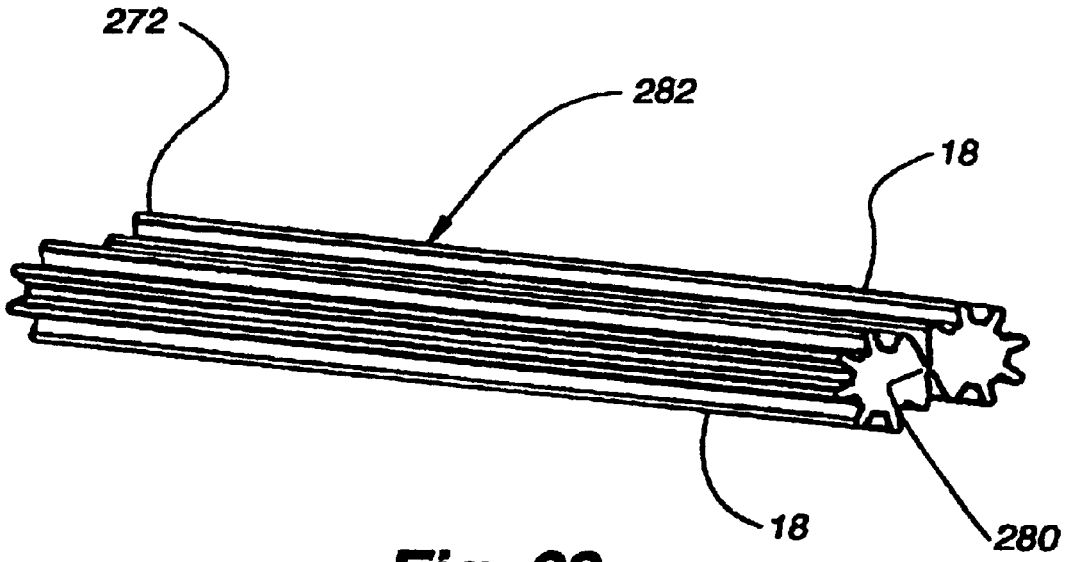
FIG. 68 is an isometric view of dual-extruded tilt rods.
Figure 69:
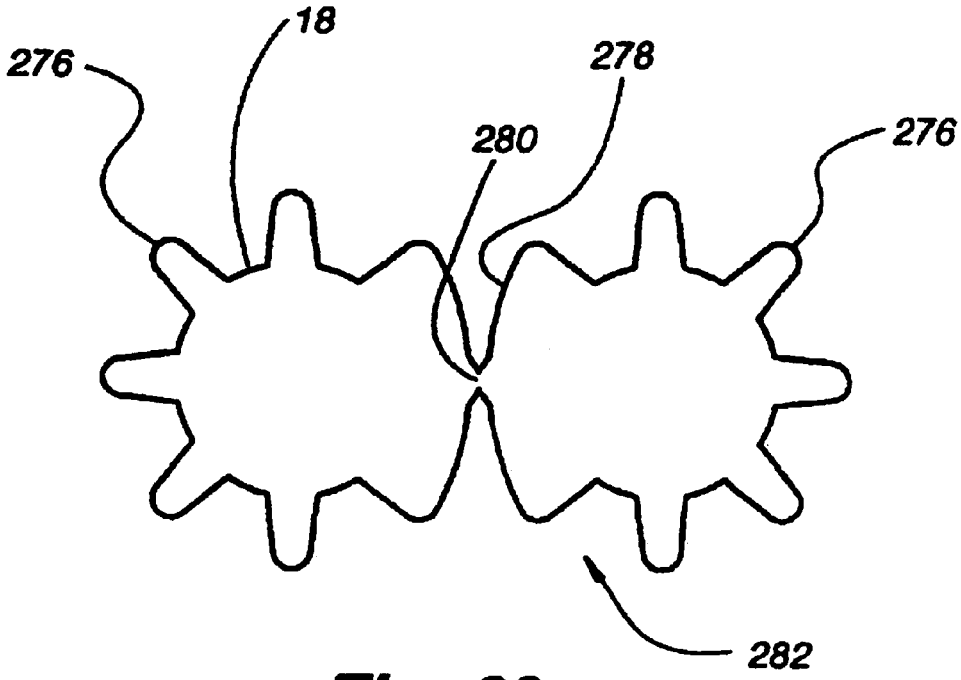
FIG. 69 is an end view of the dual-extruded tilt rods.

The end of the tilt rod drive unit 88 opposite the axle end defines a recess 122 (FIGS. 8A, 27, 31, and 32) having keyed multi-lobed shape. The keyed multi-lobe shape matches substantially with the exterior keyed multi-lobed shape of the tilt rod 18 (FIGS. 8A, 68, and 69). This allows the tilt rod 18 to be inserted into the tilt rod drive unit 88 in only one orientation and also in a torque transferring relationship so that when the tilt rod drive unit 88 is rotated, the tilt rod 18 is rotated to the same extent. The tilt rod drive unit 88 is the portion of the angular drive system 14 that extends out of the housing 54 to engage the tilt rod 18, which itself extends within the framework of the headrail 48. In effect, because the angular drive system 14 is substantially concealed in the housing 54, the only moving part with respect to the angular drive system that engages the blind system 10 to cause the vanes 20 to rotate is the tilt rod drive unit 88. This interaction is described in greater detail below.

Referring back to FIGS. 8A and 8B, the translational or transverse drive system 12, which moves the carriers 16 and vanes 20 along the tilt rod 18 between expanded or extended positions and retracted positions is also primarily contained in the main housing 54. The translational drive system 12 includes the large motor 58, the beaded cord drive member 124, and the beaded cord 32. In the instant embodiment, it has been found that a beaded cord 32 is most suitable for this application, however, other types of drive cords can be used. Referring to FIG. 8B, the large motor 58 includes an output drive shaft 126, which extends through the bottom wall of the main housing 60, as described in greater detail below. The output drive shaft 126 has an oval shape that engages a similarly shaped lower recess 128 (FIGS. 40 and 41) formed in the beaded cord drive member 124.

Figure 41:
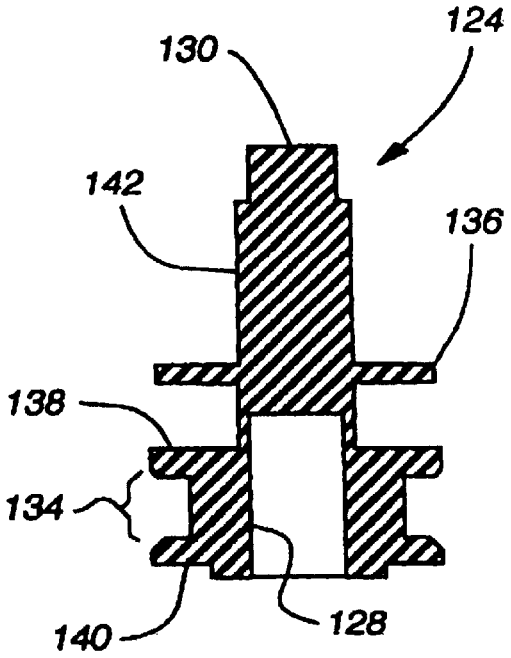
FIG. 41 is a cross-sectional view taken along line 41—41 of FIG. 39 showing the cavity for receiving the drive member of the large motor depicted in FIG. 18.
Figure 38:
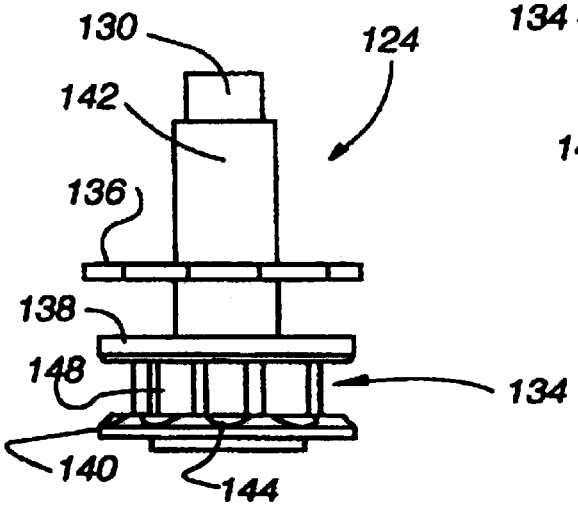
FIG. 38 is an elevation of the beaded cord drive member depicted in FIG. 37.
Figure 40:
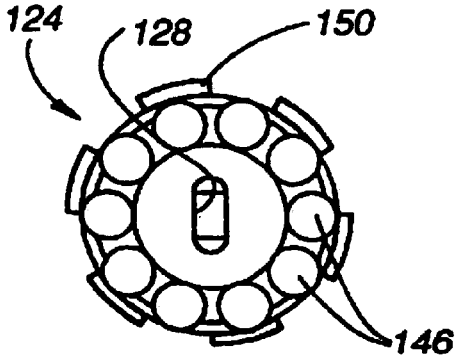
FIG. 40 is a bottom plan view of the beaded cord drive member depicted in FIG. 37.
Figure 37:
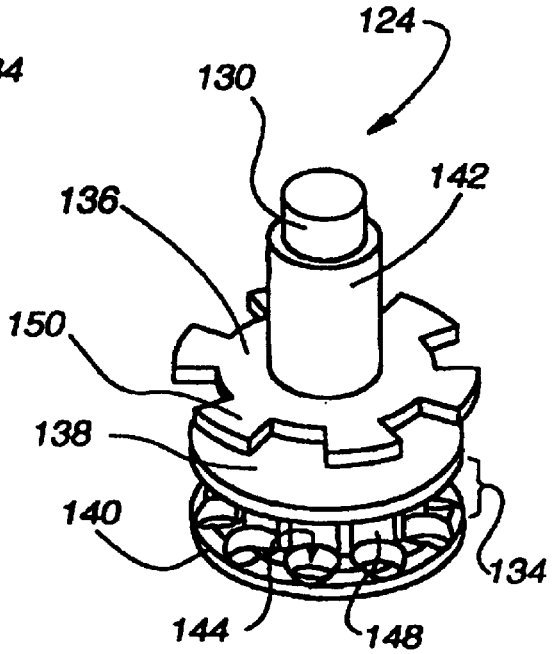
FIG. 37 is an isometric view of a beaded cord drive member including a beaded cord channel defined by bottom and top bead alignment walls, with bead pockets formed in the bottom bead alignment wall, and also including a position indicator disk formed around the beaded cord drive member, the disk defining a plurality of radially extending, regularly spaced tabs, as well as an upper positioning pin.

The beaded cord drive member 124, as also shown in FIGS. 37–41, is vertically positioned within the main housing structure 54 to spin about its vertically oriented longitudinal axis. The top end of the beaded cord drive member 124 defines a pin 130 for placement in a pin receiving port 132 (e.g., FIGS. 8A, 9, 10, and 12) formed on the lid 64 of the main housing structure 54. The pin 130, together with the mounting of the beaded cord drive member 124 on the output shaft 126 of the large motor 58, helps keep the beaded cord drive member 124 rotating along its longitudinal axis. As shown in FIGS. 37–41, the beaded cord drive member 124 also includes a beaded cord channel 134 and a positioning disk 136. The beaded cord channel 134 is defined by a top bead alignment wall 138 and a bottom bead alignment wall 140, each of which extends radially and continuously around the main shaft 142 of the beaded cord drive member 124. The bottom bead alignment wall 140 is positioned very close to the end of the beaded cord drive member 124 as shown in FIGS. 38 and 41. Bead pockets 144 are formed in the bottom bead alignment wall 140, and can extend all the way therethrough, to form apertures 146, if desired (as shown in FIG. 40), to receive the beads on the bead drive cord 32 as the beaded cord is wrapped around the beaded cord drive member 124 and along the beaded cord channel 134. Extending at substantially right angles to the bead pockets 144, and longitudinally with the shaft 142, are curved indentations 148 in the shaft which also receive a portion of the bead in conjunction with the bead pockets 144. The bead pockets and the curved indentations 148 are sized to correspond to the dimensions and shape of the bead structures 274 (FIG. 43) on the beaded cord 32 and help seat and grip the beaded structures for efficient driving of the beaded cord 32 in the translational drive system 12. The bottom bead alignment wall 140 may have a larger radius than the radius of the top bead alignment wall 138 to allow the bead elements of the beaded cord to more easily enter the beaded cord channel and seat in the bead pockets 144.

As shown in FIG. 8A, the beaded cord 32 extends around the beaded cord drive member 124 in the beaded cord channel 134. The beaded cord drive member 124, when actuated by the large motor 58, rotates to move the beaded cord 32 in a loop around the pulley 34 (see, e.g., FIGS. 1 and 2) positioned at the opposite end of the headrail 48. The beaded cord 32 extends along the headrail and, as described above, is attached to a primary carrier 46 (FIG. 2) for an end stack configured vertical blind system or to two different adjacent central carriers 42 and 44 (FIG. 1) for a center draw vertical blind system) in order to drive the carriers 16 along the tilt rod 18. The beaded cord drive member 124 can rotate the beaded cord 32 around the loop in either direction depending on the actuation of the large motor 58.

Referring back to FIGS. 37–41, between the upper positioning pin 130 and the top bead alignment wall 138, the circular flange 136 extends circumferentially around and radially from the shaft of the beaded cord drive member 124. Radially extending tabs 150 are formed on the outer circumference of the circular flange 136 and are equally spaced. These tabs 150 are position indicator tabs and, as described below, allow the logic system to determine to what extent the vanes 20 are retracted or expanded.

Figure 22:
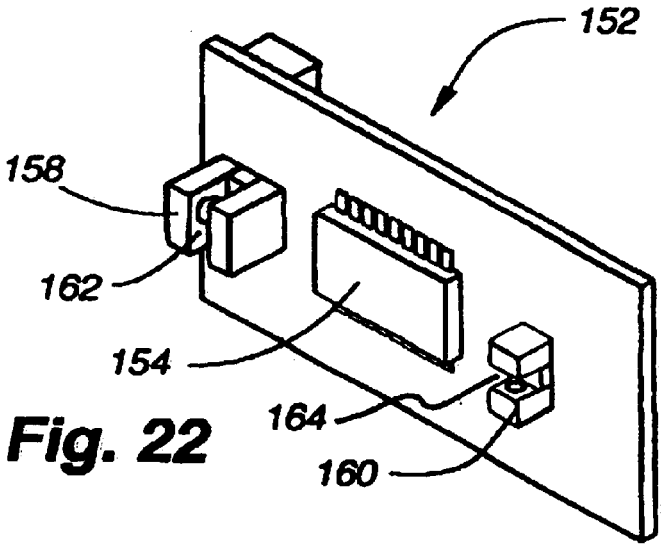
FIG. 22 is an isometric view of a circuit board that contains the integrated circuit components for a logic system and the sensors for detecting both angular vane position and translation vane position.

Referring to FIGS. 8A and 22, the circuit board 152 containing the integrated circuit chip 154 and other required electronic components is shown. In FIG. 8A, the circuit board 152 is shown with two sets of plug contacts 156 extending from one end. These plug contacts extend through the sidewall of the main housing body 60 (see FIG. 4) to allow connection with the wireless sensor signal plug 70 and the power input plug 66. The side of the circuit board 152 shown in FIG. 8A is considered the back side of the circuit board. The front side of the circuit board 152 is shown in FIG. 22. It is to be appreciated that the integrated circuit chip 154 may also be mounted on the front side of the circuit board as illustrated in FIG. 22. Additionally, several chips may be utilized in place of a single integrated chip. Other electronic components may also be mounted to the circuit board as would be obvious to one of ordinary skill in the art. The front side also includes two sensors, an angular position sensor 158 for detecting the angular position of the vanes, and a translational position sensor 160 for detecting the expanded or retracted translational position of the vanes. The angular position sensor 158 is typically U-shaped, with a channel 162 formed between its legs for receiving the indicator flange 116 on the tilt rod drive unit 88. The sensor 158 can detect when the indicator flange 116 is present in the channel 162, which in turn is interpreted by the logic system to determine the angular position of the vanes 20. The sensor 160, to detect the translationary position of the vanes, is also typically U-shaped defining a channel 164. This sensor 160 is able to determine when the position indicator tabs 150 on the beaded cord drive member 124 are present in the channel 164, thus permitting the logic system to determine whether the vanes 20 are retracted or expanded.

Figure 31:
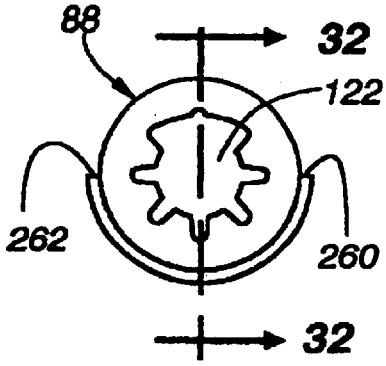
FIG. 31 is an end elevation of the opposite end of the tilt rod drive unit from that shown in FIG. 30 and shows a keyed receiving cavity for the tilt rod.

As shown in FIGS. 27 and 31, the indicator flange 116 of the preferred embodiment tilt rod drive unit 88 defines a first radially-extending edge 260 and a second radially-extending edge 262. In one example, the sensor 158 detects when each of the edges passes through the channel 162. Accordingly, the sensor may detect two positions of the vanes 20.

Preferably, the tilt drive unit 88 is configured for 360 degrees of rotational movement and is arranged so that the angular position of the vanes 20 in the open position and the angular position of the vanes in the closed position correlates with the first edge 260 and the second edge 262, respectively. In this arrangement, the sensor 158 notifies the logic system that the vanes 20 are either closed or open. Additionally, the sensor 158 may be configured to detect the presence or absence of the indicator flange 116 in the channel 162. In this configuration, by detecting the transition from the indicator flange 116 being outside the channel 162 to the indicator flange 116 being inside the channel 162, or by detecting the transition from the indicator flange 116 being inside the channel 162 to the indicator flange 116 being outside the channel 162, the logic system is able to differentiate between the first edge and the second edge.

Referring to FIGS. 27A, 29A, 30A, 31A, and 32A, an alternative tilt drive unit 88' defines a first indicator flange 116' and a second indicator flange 116". It is to be appreciated that the alternative embodiment tilt drive unit 88' is substantially similar to the preferred tilt drive unit 88 except for differences concerning the indicator flanges. The first indicator flange 116' defines a first radially-extending edge 264 and a second radially-extending edge 266, and the second indicator flange 116" also defines a first radially-extending edge 268 and a second radially-extending edge 270. As described previously, each vane 20 rotates angularly about a vertical axis, rotating approximately 180 degrees from the a first closed position, past the fully open position, and back to a second closed position. Preferably, the tilt drive unit 88' is arranged so that the angular position of the vanes 20 in the first closed position, in the fully open position, and in the second closed position each correlates with one of the edges (264, 266, 268, 270) on either the first indicator flange 116' or the second indicator flange 116". In this arrangement, preferably the sensor 158 notifies the logic system that the vanes 20 are in the first closed position, the fully open position, or the second closed position. In one example, the sensor 158 detects when one of the four edges (264, 266, 268, 270) passes through the channel 162 and also detects the presence or the absence of one of the indicator flanges (116', 116") in the channel. Accordingly, the sensor 158 may detect up to four different positions of the vanes 20.

Figure 10:
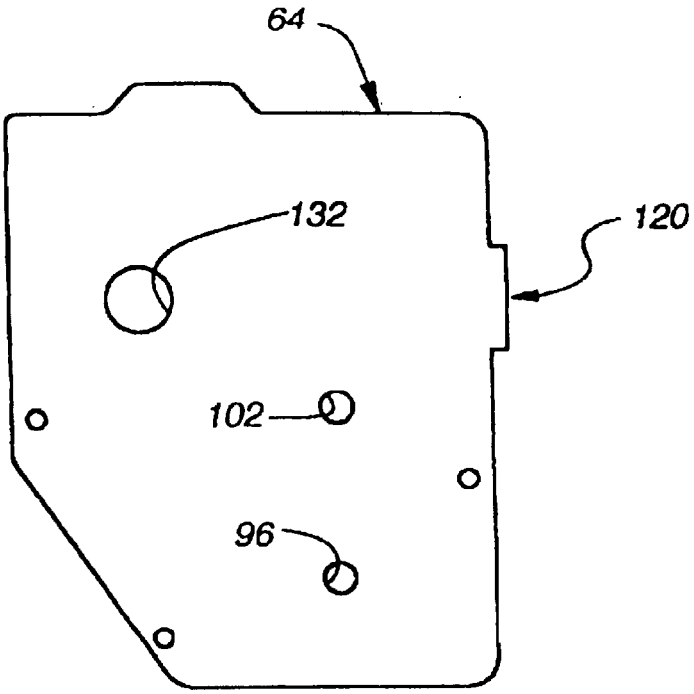
FIG. 10 is a top plan view of the lid depicted in FIG. 9.
Figure 11:
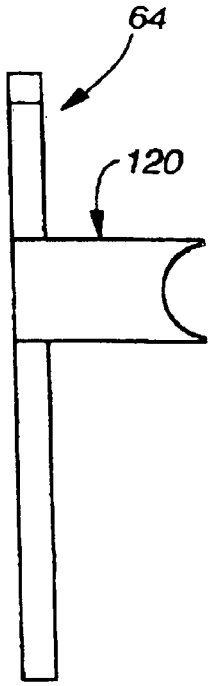
FIG. 11 is an edge view of the lid depicted in FIG. 9 showing a positioning tang.
Figure 12:
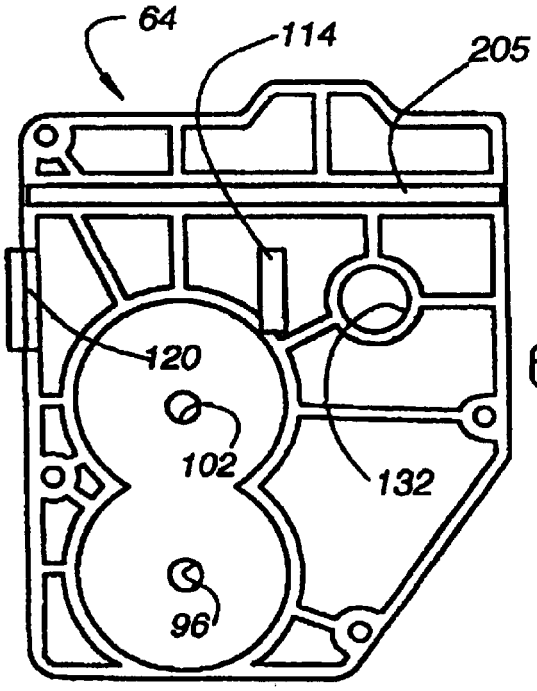
FIG. 12 is a bottom plan view of the lid, showing the support ribs formed on the underside of the lid depicted in FIG. 9.
Figure 9:
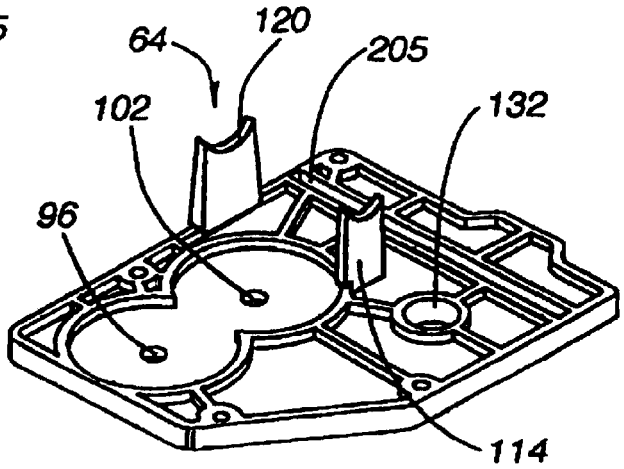
FIG. 9 is an isometric view of the underside of a lid that gets attached to the main housing in which the control system is positioned or mounted.

At the top of FIG. 8A, the lid 64 is shown for covering the open top end of the main body housing 60. The lid 64 attaches to the main body housing 60 by four fastening screws 166. The lid 64 also defines, as described above, three apertures for receiving various ends of components positioned within the housing. The underside of the lid is shown in FIGS. 9 and 12. The top of the lid is shown in FIGS. 8A and 10, and the edge of the lid that includes the positioning tang 120 is shown in FIG. 11. The tilt rod drive unit positioning tang 120 extends downwardly from the lid to be received in the groove 118 (see, e.g., FIG. 29) formed around the tilt rod drive unit 88, which, as explained above, keeps the tilt rod drive unit 88 in a stable axial position while allowing it to rotate. The top support post 114 (FIG. 8) also extends downwardly and has a concave curved end for engaging the axle end 110 of the tilt rod drive unit 88. The post 114 keeps the tilt rod drive unit in the support recess 113 so that the axle end 110 of the tilt rod drive unit 88 is able to rotate but cannot move out of the support recess 113.

Figure 14:
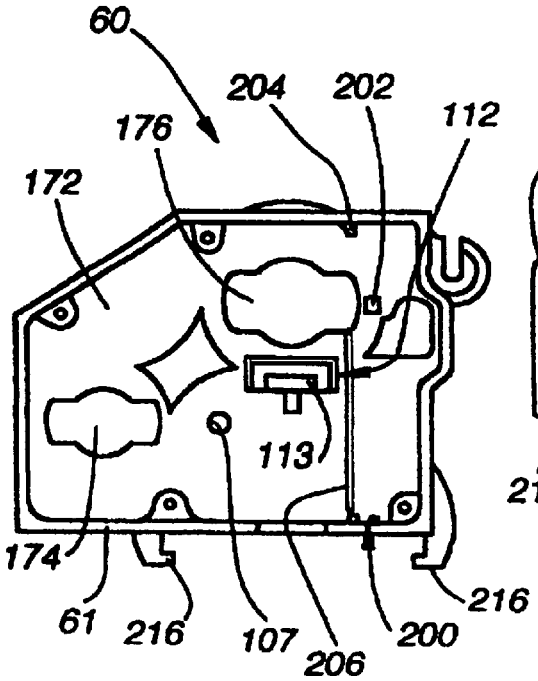
FIG. 14 is a top plan view of the main housing depicted in FIG. 13.
Figure 13:
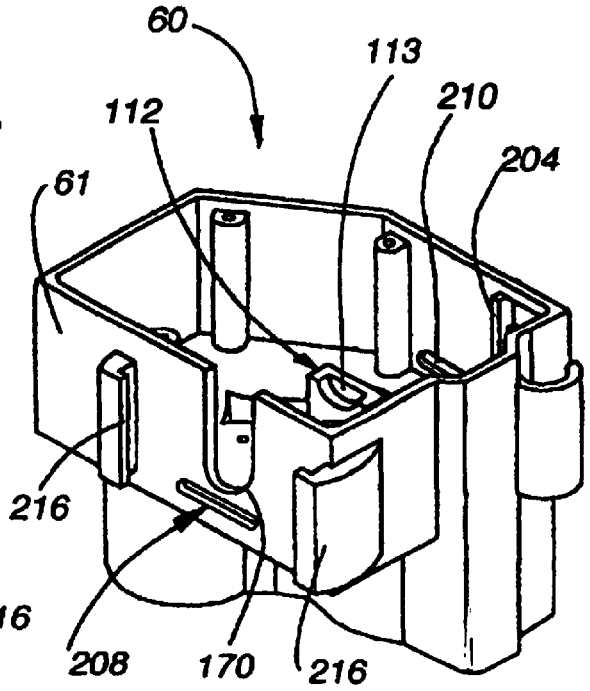
FIG. 13 is a top isometric view of the main housing in which the control system is positioned.

FIG. 8B depicts the main housing 60, the lower housing 62, the motors 56 and 58, the connector bracket 168, and a portion of the headrail 48. The main housing 60 is best shown in FIGS. 8B, 13, and 14. The main housing 60 includes several features that help facilitate the positioning of various components therein. For instance, on an inwardly-facing wall 61 of the main housing 60, a U-shaped slot 170 (FIGS. 8B and 13) is formed. The edge of the U-shaped slot 170 fits into the groove 118 formed around the tilt rod drive unit 88 and works in conjunction with the drive unit positioning tang 120 (FIG. 8A) to help secure the tilt rod drive unit 88 in position while allowing it to rotate. The support post 112 for the tilt rod drive unit 88 extends upwardly from the floor of the main housing 60 and defines the recess 113 for receiving the axial end of the tilt rod drive unit 88, as described above. The floor 172 of the main housing defines two keyed apertures 174 and 176 (FIG. 14) for receiving the top ends of the motors 56 and 58. Alternative housing configurations are contemplated based on various design and aesthetic considerations that would be obvious to one of ordinary skill in the art.

Figure 18:
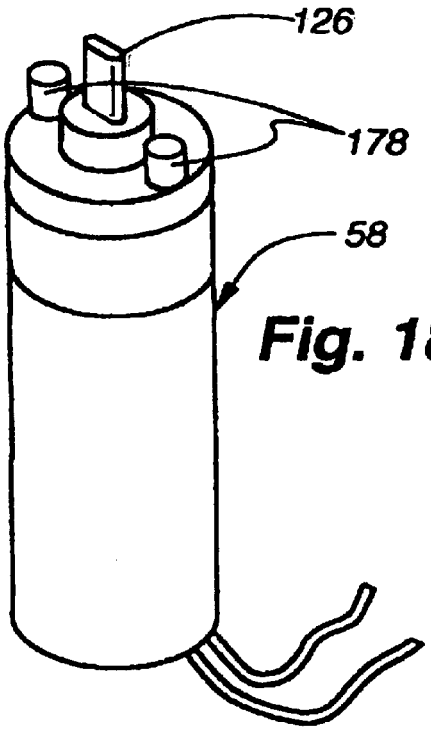
FIG. 18 is an isometric top view of the large motor of the translational drive system.
Figure 20:
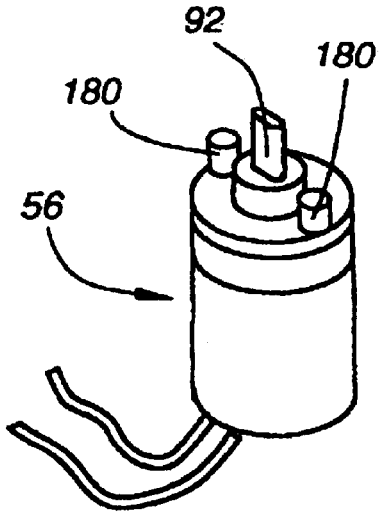
FIG. 20 is an isometric top view of the small motor of the angular drive system.
Figure 23:
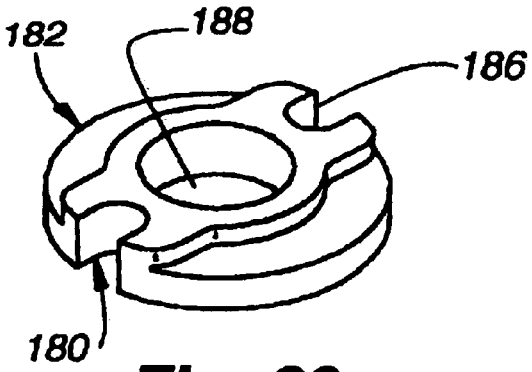
FIG. 23 is a large motor mount bushing.

As shown in FIGS. 18 and 20, the top ends of each of the large motor 58 and the small motor 56, respectively, include the output shaft 126 and 92 and a pair of diametrically opposed positioning pins 178 and 180. The larger keyed aperture 176 formed in the bottom wall of the main housing receives the top end of the larger motor 58. A mount bushing 182, shown in FIG. 23, is first positioned on top of the large motor 58 so that the positioning pins 178 on the top of the motor are received in the outer slots 186 of the mount bushing 182. The output shaft extends through a central aperture 188 in the mount bushing 182. The mount bushing 182 has a shape on its top surface that mates with the keyed aperture 176. The mount bushing 182 provides the torque resistance to cause the motor 58 to turn the shaft 126 when actuated. Without the torque resistance, when the motor 58 was actuated and a load applied to the motor shaft 126, the motor itself would turn instead of the motor shaft turning. In an alternative embodiment, the mounting bushings may be integral with the bottom wall of the main housing 60. Further, it is contemplated that other types of motors may be utilized without positioning pins and other structures such as clamps are utilized to fixedly secure the motors in the housing structure.

Figure 24:
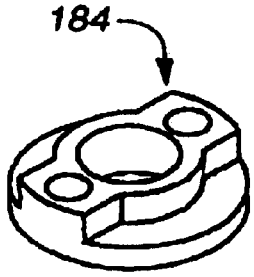
FIG. 24 is a small motor mount bushing.

Similarly, a small motor mount bushing 184 is shown in FIG. 24 and attaches to the top of the small motor 56 shown in FIG. 20 in an analogous manner as described with respect to the large motor 58. The small motor mount bushing 184 fits into the smaller keyed aperture 174 for the same purpose as described above for the large motor mount bushing 182.

Figure 19:
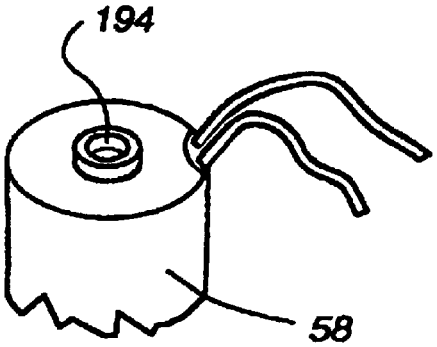
FIG. 19 is an isometric bottom view of the large motor shown in FIG. 18.
Figure 21:
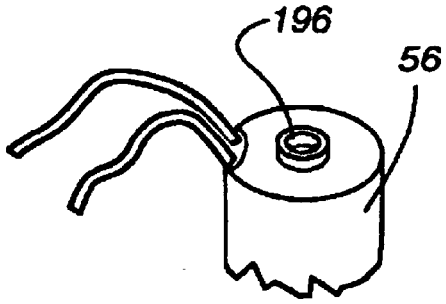
FIG. 21 is an isometric bottom view of the small motor shown in FIG. 20.
Figure 45:
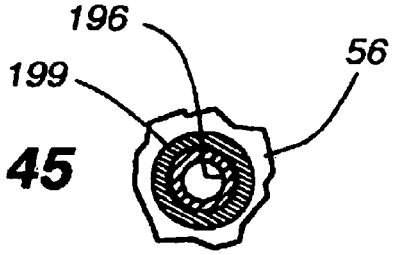
FIG. 45 is a fragmentary cross-sectional view taken along line 45—45 of FIG. 44.
Figure 50:
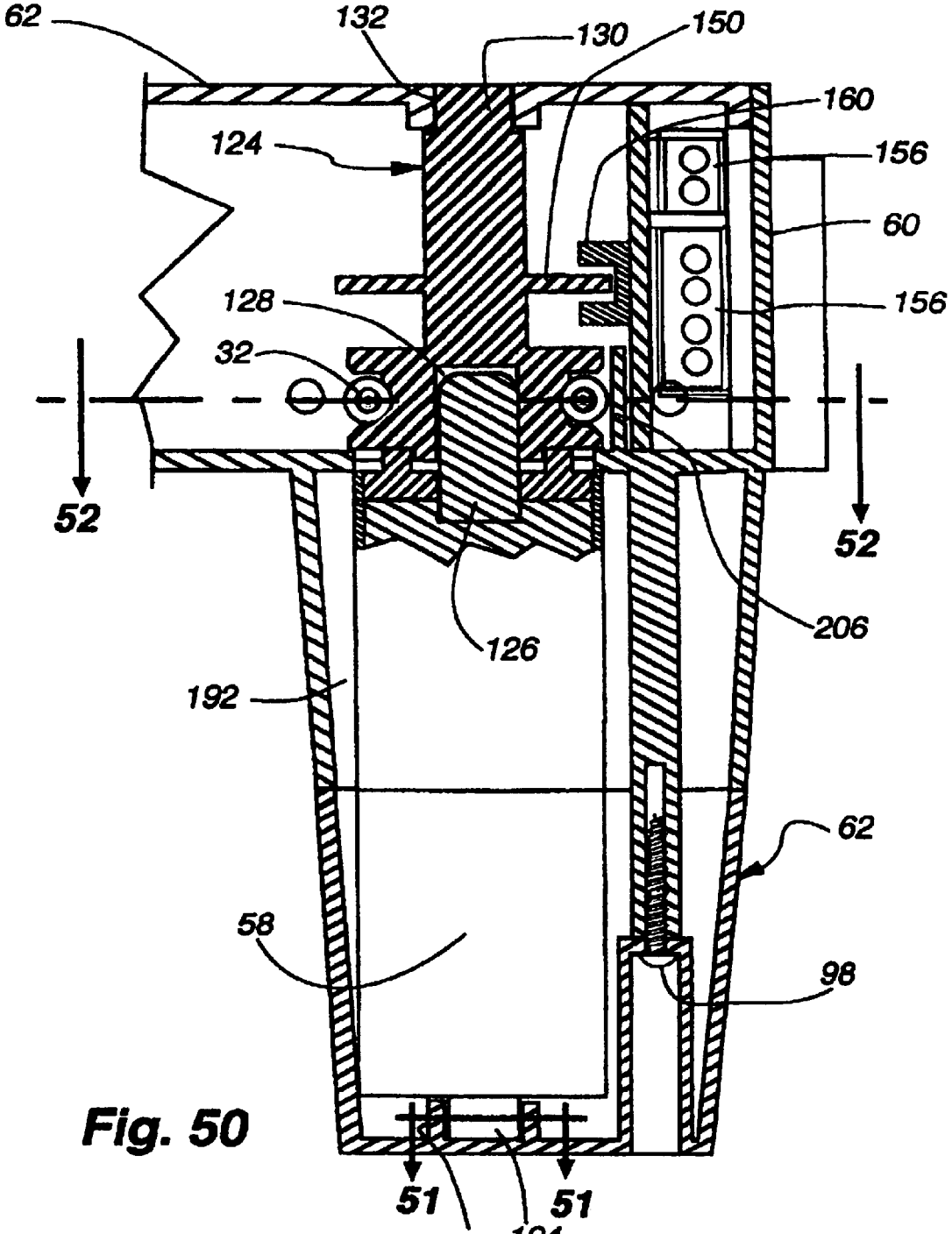
FIG. 50 is a fragmentary cross-sectional view taken along line 50—50 of FIG. 43, and shows primarily the translational drive system components with portions broken away for clarity.
Figure 51:
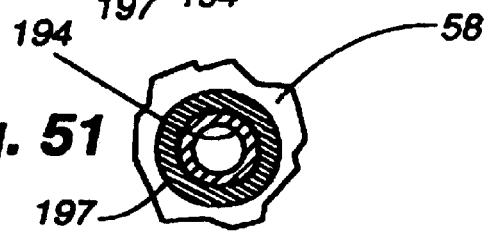
FIG. 51 is a fragmentary cross-sectional view taken along line 51—51 of FIG. 50.

The motors 56 and 58 are held in place by the lower housing 62 (FIGS. 8B, 44, and 50), which includes two cylindrical recesses 190 and 192 for receiving the bodies of the motors 56 and 58, respectively. FIGS. 19 and 21 show details of the bottom of each of the large motor 58 and the small motor 56, respectively. A small circular bearing surface 194 (see FIGS. 19, 50, and 51) is formed on the lower end of the large motor 58, and, as shown in FIGS. 50 and 51, the bearing surface 194 fits within a circular retainer 197 formed at the bottom of the cylindrical recess 192 for the large motor 58. Similarly, a small circular bearing surface 196 (see FIGS. 21, 44, and 45) is formed on the lower end of the small motor 56, and, as shown in FIGS. 44 and 45, the small circular bearing surface 196 fits within a circular retainer 199 formed at the bottom of the cylindrical recess 190 for the small motor 56. The bearing surfaces 194, 196 fit within the circular retainers 197, 199, respectively, to keep the motors 58, 56, respectively, properly positioned within the lower housing 62. The bearing surfaces 194, 196 also help position the motors 58, 56, respectively, at the proper height so that the motor drive shafts 126, 92 remain engaged with the beaded cord drive member 124 and the drive gear 82, respectively, inside the main housing 60. The lower housing 62 can be removed from the main housing 60 in order to replace the motors 56 and 58 or to service the motors as needed. Screw fasteners 198 are used to attach the lower housing 62 to the main housing 60.

Referring primarily to FIGS. 8B, 13, and 14, the circuit board 152 (FIGS. 8A and 22) is set inside the housing 60 on edge and is held in place by a circuit board guide channel 200 at one end and a combination of spaced apart braces 202, 204 at the other, and by a top channel 205 on the lid 64 (FIGS. 9 and 12) along the top edge. The circuit board guide channel 200 is formed on the inside wall adjacent to the curved slot 170 formed on the inwardly-facing wall 61 of the main housing 60. The guide channel 200 is sized to receive the edge of the circuit board 152 securely. On the opposing wall of the main housing 60, a front brace 204 (FIG. 13) for the circuit board extends lengthwise to engage the front side of the other end of the circuit board. A circuit board back brace 202 (FIG. 14) is positioned on the floor 172 of the main body 60 and spaced away from the front brace 204. The circuit board back brace 202 is positioned close to the edge of the keyed aperture 176 for the large motor mount bushing 182. When the circuit board 152 is inserted, one end fits into the circuit board guide channel 200 and the other end engages the circuit board front brace 204 while at the same time is engaged on its back by the circuit board back brace 202. As previously mentioned, the circuit board 152 is also held in position by the channel 205 formed on the underside of the lid 64, which receives the entire top edge of the circuit board 152 when the lid 64 is positioned on the top of the main body. A plate 206 (FIGS. 14 and 44) extends upwardly from the bottom wall 172 of the main body 60 near the end of the circuit board that is positioned in the guide channel 200 to protect the circuit board 152 from the beaded cord 32 as the beaded cord moves back and forth around the pulley loop. This protection plate 206 keeps the beaded cord 32 from contacting the circuit board 152 and possibly dislodging electronic components positioned thereon. It is to be appreciated that other structures may be utilized to secure the circuit board in a housing as would be obvious to one of ordinary skill in the art with the benefit of this disclosure. For example, the circuit board could be fastened to the housing via screws or clips.

Figure 70:
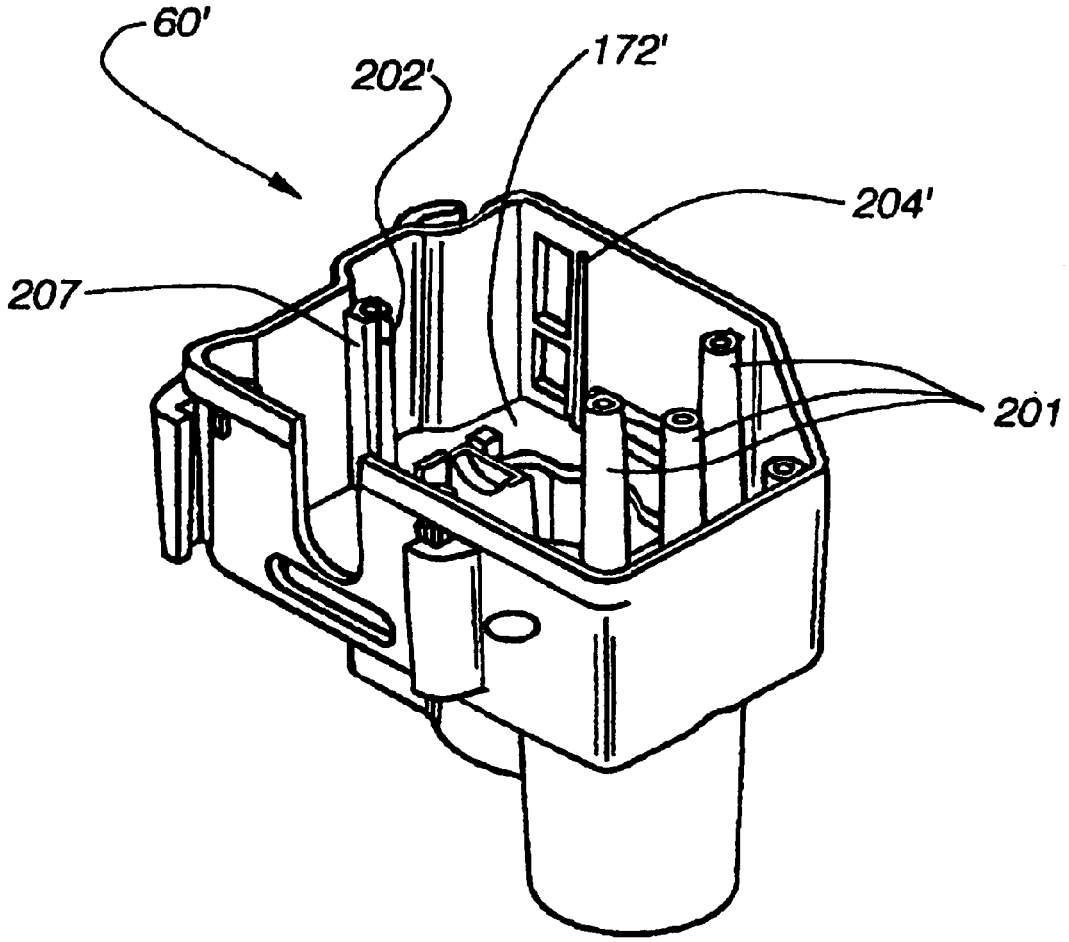
FIG. 70 is a top isometric view of an alternative embodiment main housing in which the control system is positioned.

An alternative main housing 60' is illustrated in FIG. 70 and is generally similar to housing 60 of the preferred embodiment. There are two primary differences between the main housings. Most noticeably, the alternative housing 60' includes several screw bosses 201 that extend upwardly from the floor 172' of the housing 60'. Secondly, in place of the free standing circuit board back brace 202 of the preferred main housing 60, the alternative main housing includes a back brace 202' that extends from a new screw boss 207 that is attached to a side wall of the housing.

Figures 16, 17:
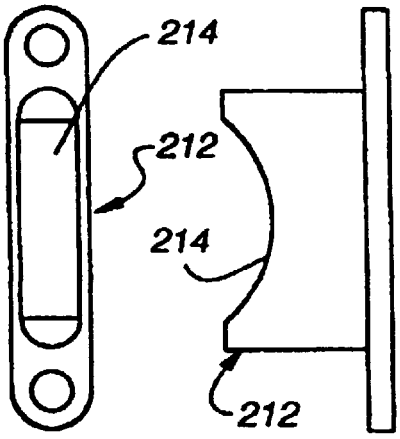
FIG. 16 is a top plan view of the beaded cord guide depicted in FIG. 15.
FIG. 17 is an end elevation of the beaded cord guide of FIG. 15 looking at its curved front surface.
Figure 15:
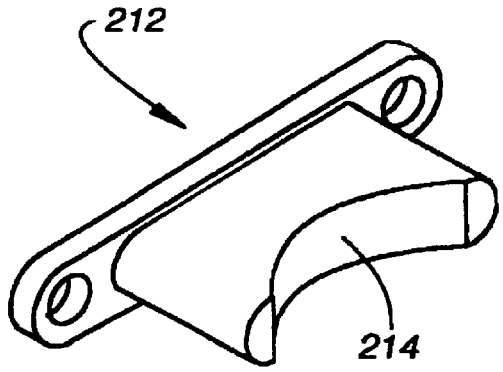
FIG. 15 is an isometric view of a beaded cord guide.

FIGS. 8B, 13, and 14 also show a beaded cord slot 208 formed in the inwardly-facing wall 61 of the main body 60 below the slot 170. The beaded cord slot 208 allows the beaded cord 32 to enter into and exit from the main body without any interference. On the opposite wall of the main body, a similar slot 210 is formed. However, this similar slot receives a beaded cord guide 212 (FIGS. 15–17). The beaded cord guide 212 mounts from the outside of the housing 54 and extends through the slot 210 to capture the length of the beaded cord 32 that is wrapped around and in engagement with the beaded cord channel 134 on the beaded cord drive member 124. FIGS. 15, 16, and 17 show various views of the beaded cord guide 212. The curved front surface 214 of the beaded cord guide 212 basically keeps the beaded cord 32 from disengaging from the beaded cord channel 134 and the bead pockets 144. The curved surface 214 of the beaded cord guide 212 does not contact the beaded cord 32 unless the beaded cord 32 tries to disengage from the beaded cord channel 134. In alternative embodiments, a cord guide may be integrally formed with the housing.

Referring still to FIG. 8B, the outer surface of the inwardly-facing wall 61 of the main body 60 defines mounting rails 216 for use in attaching the main body 60 to the connector bracket 168, which is attached to the headrail 48. The connector bracket 168, shown in FIGS. 25 and 26, allows the main housing 60 to be attached to the headrail 48. The headrail 48, as is known in the art, is generally U-shaped with an upwardly open channel 225 formed along the free edge of each leg (FIG. 8B). It is to be appreciated that other headrail configurations are contemplated and the connector brackets will vary as necessary to mount to the alternative headrails. The connector bracket 168 has two attachment structures, one on its front face 218 and one on its rear face 219. The attachment structure on the front face 218 is a U-shaped recess 229 that matches the U-shape of the headrail 48 such that an end of the headrail can be inserted into the U-shaped recess 229. Two fastening screws 220 are used to fasten the connector bracket 168 onto the headrail 48. The fastening screws 220 fit through apertures 221 (FIG. 26) formed in the backside of the connector bracket 168 and extend into the channels 225 on the headrail 48 to secure the connector bracket 168 to the headrail 48.

Figure 25:
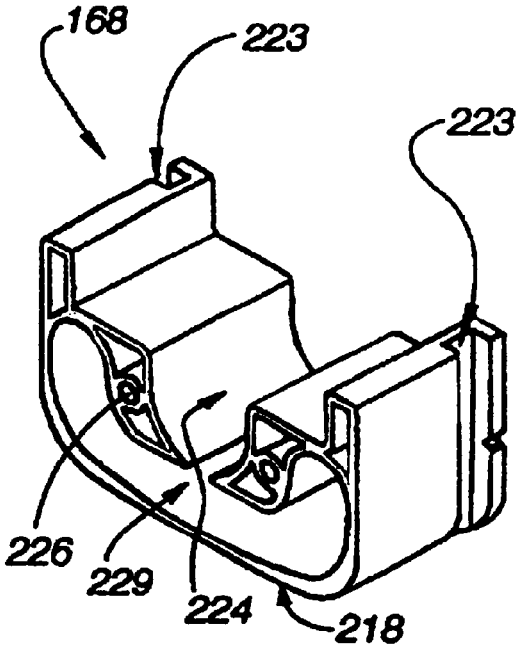
FIG. 25 is a connector bracket for connecting the main housing containing the control system to the end of the headrail.
Figure 26:
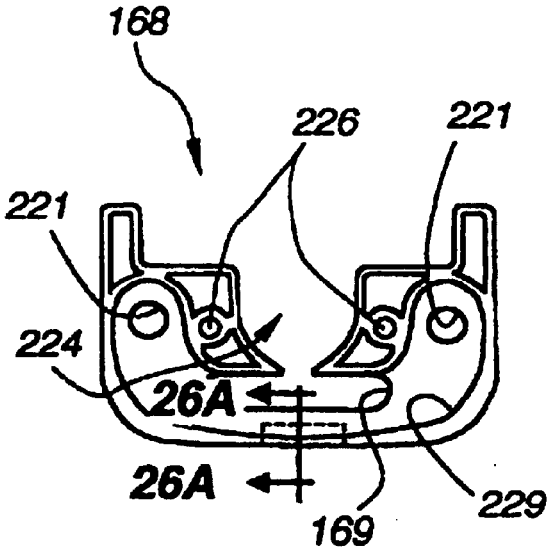
FIG. 26 is an end view of the connector bracket depicted in FIG. 25.
Figure 26A:
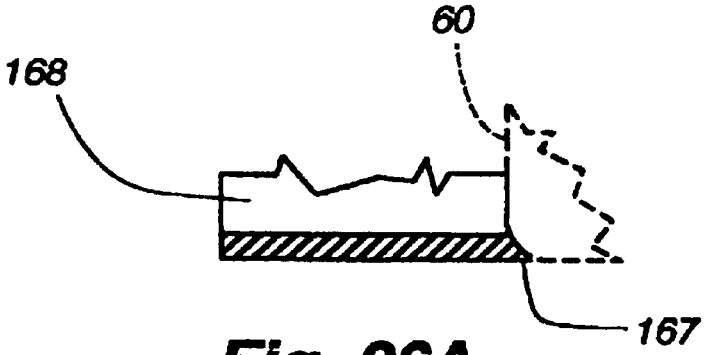
FIG. 26A is a fragmentary cross-sectional view taken along line 26A—26A of FIG. 26 and showing the interface between the connector bracket and the main housing.
Figure 30:
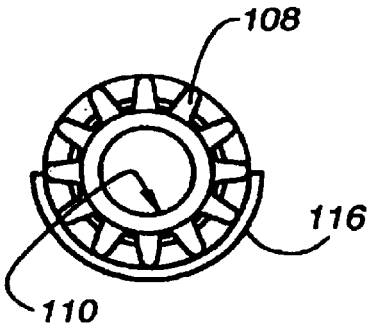
FIG. 30 is an end elevation of the tilt rod drive unit depicted in FIGS. 27, 28, and 29.
Figure 28:
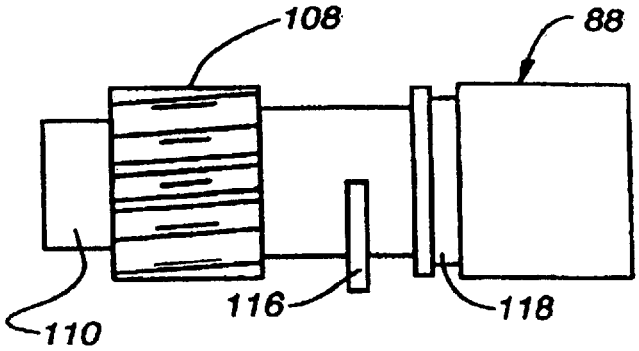
FIG. 28 is a side elevation of the tilt rod drive unit depicted in FIG. 27, showing the indicator flange as extending only halfway around the circumference of the tilt rod drive unit.
Figure 29:
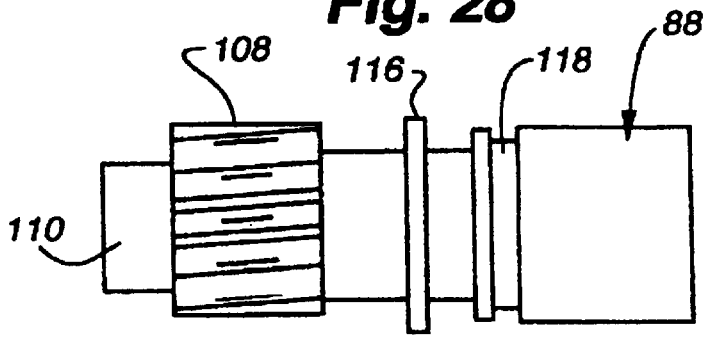
FIG. 29 is a second side elevation of the tilt rod drive unit depicted in FIG. 27 that is different from the view depicted in FIG. 28.
Figure 42:
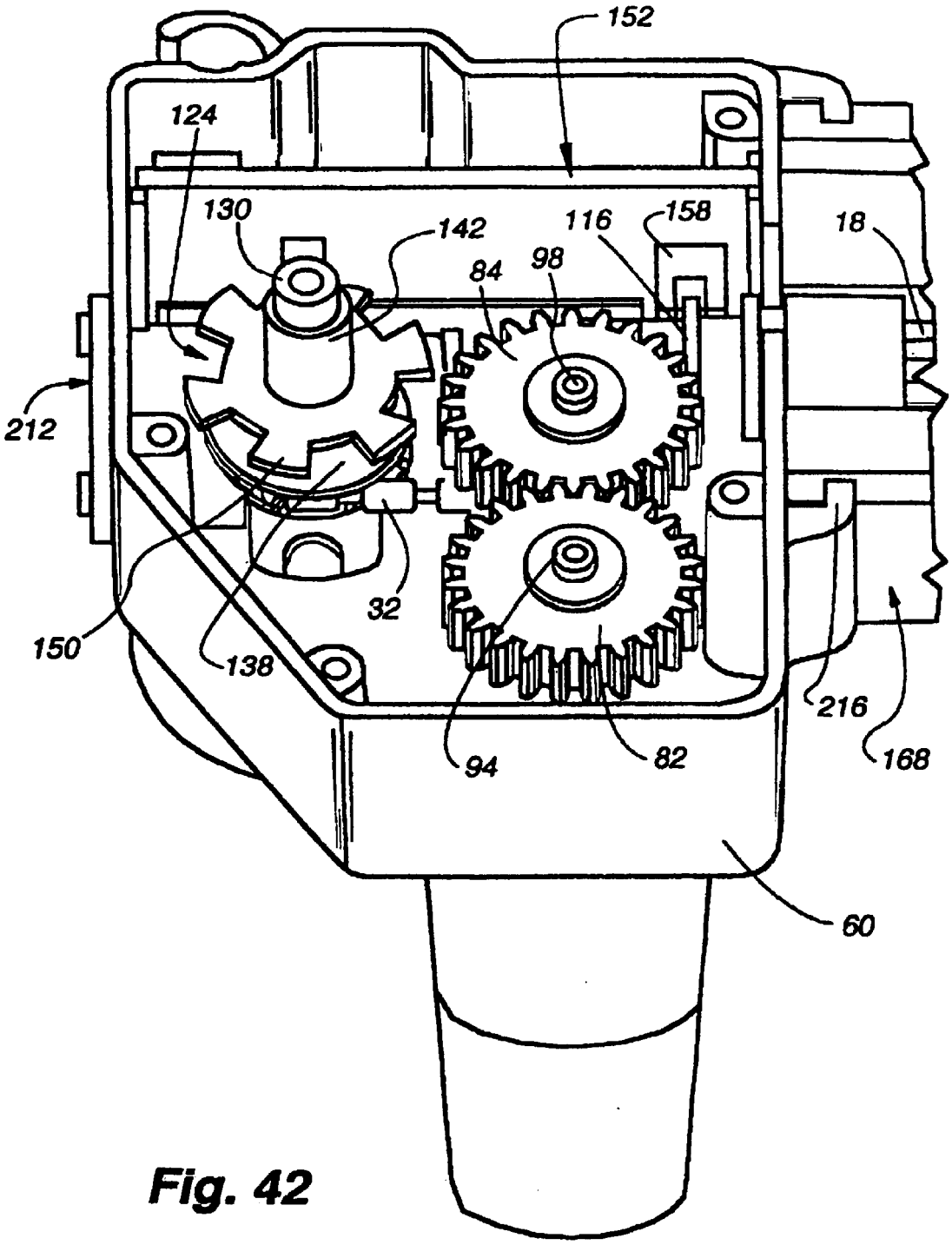
FIG. 42 is an isometric view of the main housing of the control system including the internal component parts of the control system excluding the beaded cord.
Figure 49:
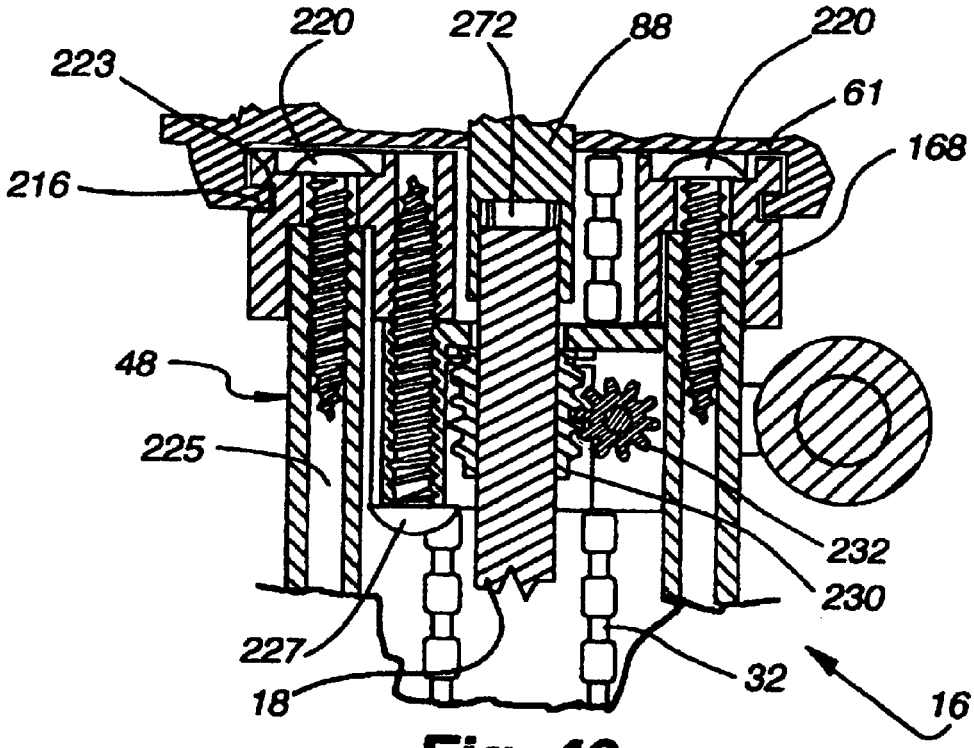
FIG. 49 is a fragmentary cross-sectional view taken along line 49—49 of FIG. 48, and shows primarily the angular drive system components.

Still referring to FIGS. 8B, 25, and 26, the backside 219 of the connector bracket 168 defines mounting channels 223 along each opposing edge. The mounting channels 223 are formed to mate with corresponding mounting rails 216 formed on the inwardly-facing wall 61 of the main housing 60. FIGS. 42, 43, and 49 provide views of the engagement of the mounting rails 216 with the mounting channels 223. The mounting channels 223 and mounting rails 216 are designed with a downwardly opening V-shape (the distance between the two rails increases from top to bottom, and the distance between the two channels increases from top to bottom) such that the main housing 60 can be slid onto the mounting channels 223 from the top, but then wedges into place when properly seated. The width of the mounting channels 223 also decreases from top to bottom, as do the rails 216 so that the rails 216 become wedged in the channels 223 as a second means of seating the housing 60 with respect to the connector bracket 168. In addition, a tab 167 (FIG. 26A) is formed on the bottom edge of the connector bracket 168 to engage the bottom of the inwardly-facing wall 61 of the main housing 60 to also act as a positioning stop. This tab 167 engages the housing 60 as the housing 60 is placed on the connector bracket 168 as an extra measure to ensure that the connector bracket 168 and the housing 60 are properly aligned with one another.

A horizontal extending oval slot 169 (FIGS. 26 and 47) is formed through the connector bracket 168 to mate up with the slot 208 formed through the inwardly-facing wall 61 of the main body 60. The beaded cord 32 passes through both slots 169, 208 without interference. A central U-shaped groove 224 (FIG. 25) is formed in the middle of the connector bracket 168 to allow the tilt rod 18 to extend therethrough without interference by the connector bracket 168. On the front face 218 of the connector bracket 168, inwardly of the U-shaped recess 229 and outwardly of the U-shaped groove 224, two mounting apertures 226 are positioned for receiving a screw 227 (see FIGS. 47 and 48) through at least one of them to attach the first carrier 16 to the front side 218 of the connector bracket 168. This will be described in greater detail below.

As described above, the component parts required for both the translational drive system 12, the angular drive system 14, and the logic system 240 are primarily contained within the main housing 60. As part of the angular drive system, each carrier 16 also includes components to enable rotation (i.e., tilting) of the vanes 20 about pivot axes parallel to, or collinear with., the vanes' longitudinal, vertical axes. For example, each carrier could include a rack and pinion system for pivoting (or tilting) a suspended vane. This rack and pinion system, which is operatively engaged with a tilt rod that runs the length of the headrail, is fully disclosed in related U.S. utility patent application Ser. No. 09/525,613, which has been incorporated by reference as though fully set forth herein. Alternatively, the components that enable tilting of the vanes could include the meshing gear system that is also fully disclosed in related U.S. utility patent application Ser. No. 09/525,613. The tilt rod 18 is mounted for rotational movement about its longitudinal axis such that selective rotation of the tilt rod 18 in either rotational direction effects reversible pivotal movement of the vanes 20 about their vertical longitudinal axes.

A more detailed description of the angular drive system 14 will be made with respect to FIGS. 42–49. FIG. 42 is a top isometric view, and FIG. 43 is a top plan view, of the main housing 60 with the lid 62 removed. These figures show the angular drive system 14, which includes the small motor 56 (not shown in FIGS. 42 and 43), the drive gear 82 attached to the top of the small motor 56, the driven slave gear 84 engaged to the drive gear 82, the tilt rod drive unit 88 engaged with the driven slave gear 84, and the tilt rod 18 engaged with the tilt rod drive unit 88. As the small motor 56 is actuated, the motor shaft 92 rotates, thus turning the drive gear 82. The drive gear 82, which rotates in a horizontal plane, engages the driven slave gear 84, which also rotates in a horizontal plane. The worm gear 86 (FIG. 44) formed on the shaft below the driven slave gear 84 engages the drive unit actuator gear 88 on the tilt rod drive unit 88 (see FIG. 44), which converts the rotation of the horizontally positioned gears about a vertical axis to the rotation of the tilt rod drive unit 88 about a horizontal axis. The actuation of the tilt rod drive unit 88 by the worm gear 86 on the driven slave gear member 84 causes the tilt rod 18 to rotate. The rotation of the tilt rod 18 in turn causes the vanes 20 to angularly move because of the gear train 24 positioned in the carriers 16, which transfer the rotation of the tilt rod 18 along its longitudinal axis to the angular rotation of the vanes 20 along a vertical axis. The gear train 24 in the carrier is shown in part in FIG. 43 wherein the idler gear 228 in the first carrier 16 mounted to the connector bracket 168 is shown. Referring to FIG. 44, the small motor 56 is shown with its motor shaft 92 engaged with the bottom end of the lower end 90 of the drive gear shaft. The interaction of the worm gear 86 with the drive unit actuator gear 108 is shown also. It is to be appreciated that other combinations and configurations of gears may be utilized to effectively couple a motor, such as the small motor 56, to a tilt rod drive unit 88 and the tilt rod 18 itself.

Figure 46:
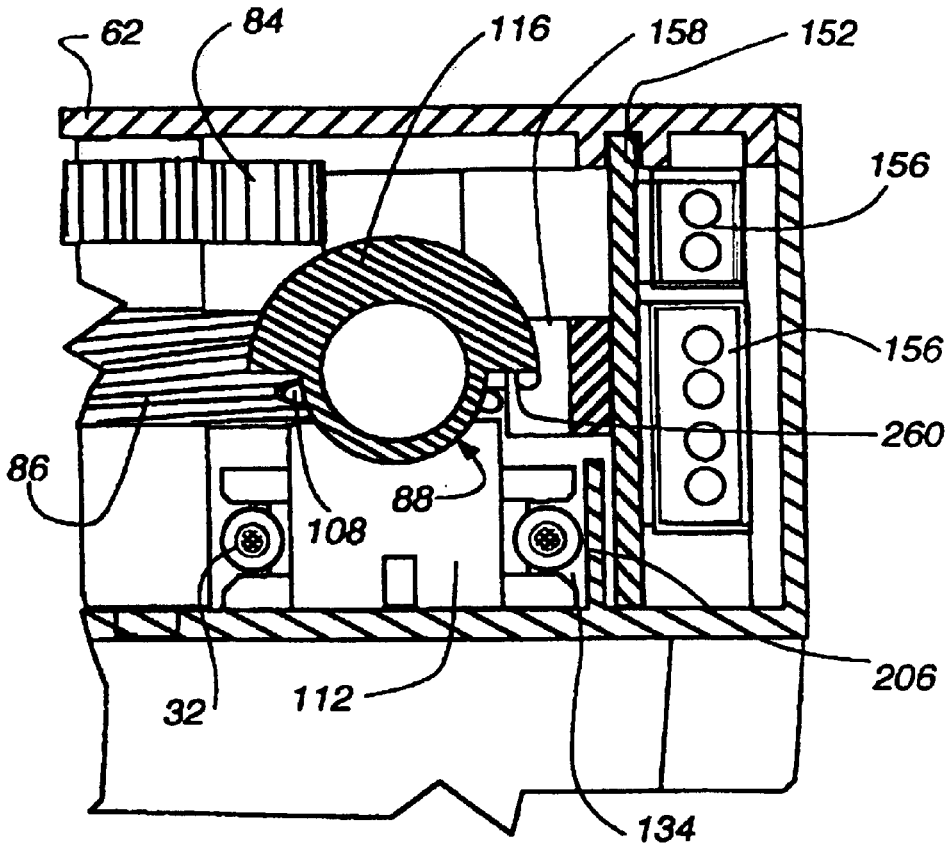
FIG. 46 is a fragmentary cross-sectional view taken along line 46—46 of FIG. 43, and shows primarily the angular drive system components.

FIG. 46 shows the relationship of the indicator flange 116 on the tilt rod drive unit 88 with the angular position sensor 158 mounted on the circuit board 152. As the tilt rod drive unit 88 rotates about its horizontal axis, the indicator flange 116 rotates in a vertical plane about the horizontal axis also. The sensor 158 is positioned on the circuit board such that this flange 116 passes between the two legs of the sensor 158. The sensor 158 is designed to sense when the flange 116 is present and when the flange 116 is not present, thus indicating to the logic system the angular orientation of the vanes 20. Preferably, the sensor is a photo sensor which works with the flange 116 to allow the logic system to know when the vanes 20 are rotated all the way to either side as well as in the open position. Other types of sensors may be utilized as well. For example, a magnetic induction type sensor could be utilized in conjunction with a ferrous indicator flange. In FIG. 46, the right radial edge 260 of the indicator flange 116 is just impinging on the central region 162 (FIG. 22) of the sensor 158. If the tilt rod drive unit 88 is rotated counterclockwise from this position the indicator flange 116 will move out of the sensors range. If the tilt rod drive unit 88 is rotated clockwise, the indicator flange 116 will move through the central region 162 of the sensor 158. As explained elsewhere herein, the logic system interprets these signals in order to determine the angular position of the vanes 20.

FIG. 46 also shows the worm gear 86 on the bottom of the driven slave gear 84, as well as the beaded cord 32 positioned in the beaded cord channel 134. The circuit board shield 206 is also clearly illustrated.

Figure 47:
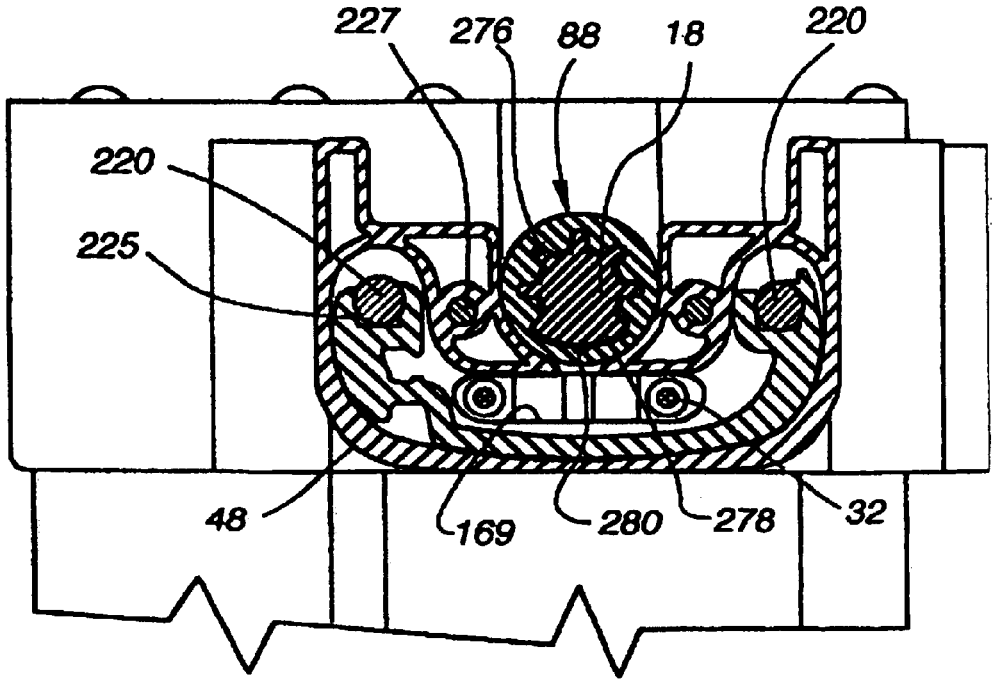
FIG. 47 is a fragmentary cross-sectional view taken along line 47—47 of FIG. 43, and shows primarily the angular drive system components.

FIG. 47 is a cross-sectional view taken along line 47—47 of FIG. 43 through the connector bracket 168, with the tilt rod drive unit 88 in the same position as shown in FIG. 46. FIG. 47 also shows the fasteners 220 used to hold the connector bracket 168 to the headrail 48, as well as the fastener 227 used to hold the first carrier 116 to the connector bracket 168. Also, the slot 169 in the connector bracket 168 is shown through which the beaded cord 32 passes and which is coextensive with the slot 208 formed in the front wall of the housing 60 for that purpose.

As is shown in FIG. 47, the tilt rod 18 has a keyed outer surface configuration that includes approximately one-half of the circumference forming radially extending splines 276 with the balance of the outer circumference forming a relatively smooth enlarged lobe 278 (see FIG. 69 also). These structures extend along the entire length of the tilt rod. This outer surface configuration is designed to be received securely and nonrotatably within the corresponding keyed recess 122 (see FIGS. 27, 31, and 32) of the tilt rod drive unit 88. In the middle of the enlarged lobe portion 278, there is a relatively small protrusion 280. Referring to FIGS. 68 and 69, this protrusion is the web material created when two of the tilt rods 282 are made by an extrusion process as a pair. The protrusion forms a web between two tilt rods 282 during the extrusion process, providing lateral and dimensional stability between the two rods as they are formed. Extruding two rods at one time creates efficiencies in the manufacture of the dual-extruded rods 282. Additionally, the added rigidity of the pair of tilt rods 282 during extrusion and subsequent cooling minimizes the amount of longitudinal bend or warp introduced into the tilt rods during fabrication. These rods can be used in blind systems incorporating the present invention, as well as in other types of blind systems. It is appreciated that the actual outer surface configuration of the tilt rod 18 (one tilt rod of a tilt rod pair 282) may vary as long as it is configured to keyably interface with corresponding structures of the translational drive system and the carriers.

Figure 48:
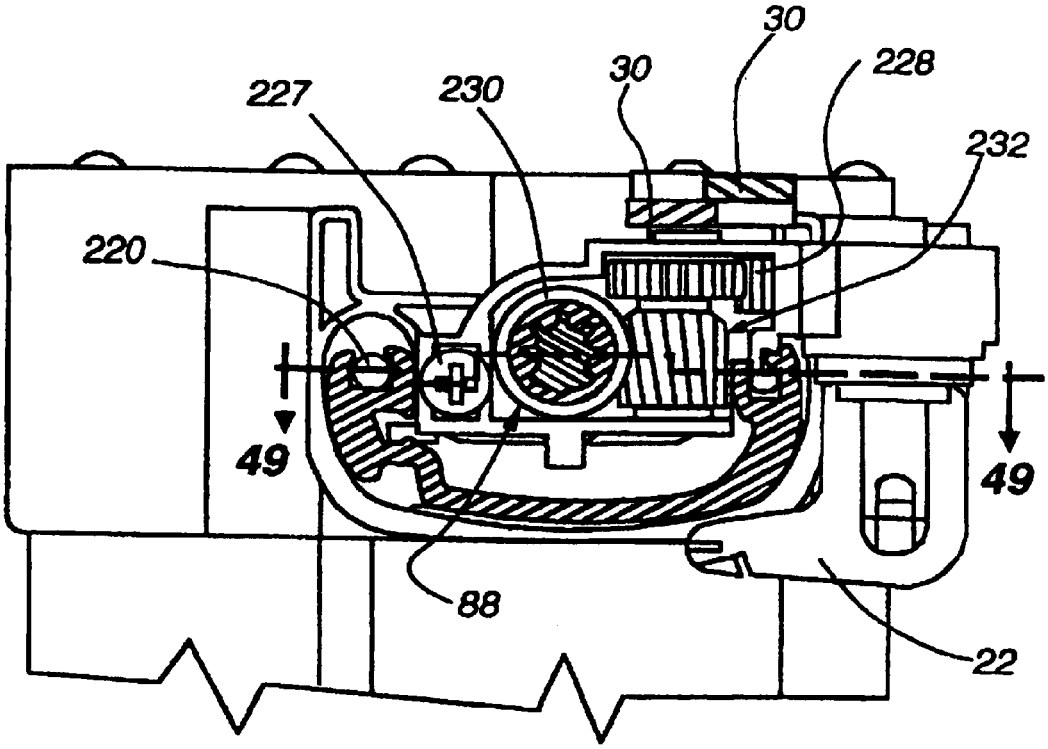
FIG. 48 is a fragmentary cross-sectional view taken along line 48—48 of FIG. 43, and shows primarily the angular drive system components.

Returning to the angular drive system 14, FIG. 48 shows a cross-sectional view along line 48—48 of FIG. 43, adjacent to a carrier 16. In each carrier, a worm gear 230 is positioned on the tilt rod 18 such that when the tilt rod turns the worm gear turns. The worm gear 230 is in engagement with the angular rotation gear train 24 that is in turn connected to the hanger pin 22, which holds the vane 20.

The angular rotation gear train 24 in the carrier 16 includes a transitional gear 232, which changes the rotation of the tilt rod 18 around a horizontal axis to the rotation of the transition gear member 232 about a vertical axis. The transition gear 232 has a top gear structure, which engages an idler gear 228, which in turn engages a gear 243 (FIG. 43) mounted on the top of the hanger pin 22. So as the tilt rod 18 is rotated, the worm gear 230 mounted on the outside of the tilt rod 18 inside the carrier 16 is rotated, which in turn engages a transition gear 232, which in turn rotates and idler gear 232, which in turn rotates the gear 234 (FIG. 43) mounted on the hanger pin 22 to change the angular orientation of the vane 20 attached to the hanger pin 22. Also shown in FIG. 48 are two links of the pantograph structure 30 attached to the top of the carrier.

Looking at FIGS. 48 and 49 together, when the tilt rod drive unit 88 is rotated clockwise as viewed in FIG. 48, the tilt rod 18 is also rotated clockwise. The transition gear 232 in FIG. 49 however is rotated then counterclockwise, which then rotates the idler gear 228 clockwise, which in turn rotates the gear 243 on the top of the hanger pin 22 counterclockwise, which finally causes the vane 20 to move in a counterclockwise direction around a vertical axis (as viewed from the top as FIG. 49). FIG. 49 shows the engagement of the worm gear 230 on the tilt rod 18 with the transition gear 232 in the carrier 16.

FIG. 49 also shows clearly the attachment of the connector bracket 168 to the headrail 48 by two threaded screws 220. The threaded screws 220 each are positioned through an aperture 221 in the connector bracket 168 and extend into the channels 225 (see also FIGS. 8B and 47) at the ends of the legs of the U forming the headrail 48. The screw 227 is shown fixing the first carrier 16 to the connector bracket 168. The engagement of the tilt rod 18 in the tilt rod drive unit 88 is also shown, with a space 272 being left between the end of the keyed cavity 122 in the tilt rod drive unit 88 near the end of the tilt rod 18 in order to allow for changes in length of the tilt rod 18 as the tilt rod 18 is flexed and bent to the extent that occurs. The engagement of the opposing rails 216 formed on the front panel 61 of the main housing 60 with the channels 223 formed on the connector bracket 168 is shown also in FIG. 49. The rails 216 extend into the corresponding channels 223 to securely attach the main housing 60 to the connector bracket 168.

The translational drive system 12 is now described with respect to FIGS. 42, 43, 50, 51, and 52. FIG. 42 shows the beaded cord drive member 124 positioned in the housing atop the large translation drive motor output shaft 126 (FIG. 50). The beaded cord 32 extends around a pulley 34 (FIG. 1) positioned at the other end of the headrail 48 to form the loop. The beaded cord drive member 124, as described above, drives the beaded cord 32 in the loop, which is formed to extend from one end of the headrail 48 to the other. A combination of the attachment of all the carriers 16 to be moved along the tilt rod 18 by the pantograph structure 30, the attachment of the end carrier 46 at one end to the beaded cord 32 and the attachment of a terminal carrier 16 to the connector bracket 168 at the housing end sets up the structure for the translation drive system 12. The carriers 16 positioned between the end and terminal carriers are not attached to the beaded cord, but instead are only attached to the pantograph.

The beaded cord 32 includes the bead structures to provide a positive drive engagement between the cord 32 and the beaded cord drive member 124 in order to avoid slipping and inefficient operation. The beaded cord drive member 124 is positioned in the housing 60 with respect to the other component parts to allow the beaded cord 32 to extend through the slot 208 (e.g., FIG. 8B) formed in the front wall 61 of the housing 60 and along the rail 48 without interfering with, or being interfered with by, any other components.

FIG. 43 shows the beaded cord drive member 124 having the beaded cord 32 positioned therearound. A sensor tab 150 on the beaded cord drive member 124 is shown positioned within the translational position sensor 160 mounted on the circuit board 152. As the beaded cord drive member 124 rotates, the series of sensor tabs 150 on the beaded cord drive member 124 move into and out of the sensor 160 thereby allowing the sensor 160 to keep track of the movement of the beaded cord drive member 124, and, in turn, allow the logic system to track the position of the carriers 16 and vanes 20 in their expanded and retracted state. Preferably, the sensor 160 is a photo sensor that works with the sensor tabs 150 as a nondirectional shaft encoder, although other types of sensors are contemplated. FIG. 43 shows the beaded cord 32 extending from the beaded cord member 124, through the housing 60 amongst the other component parts, out of the housing 60, into the connector bracket 168, and through the connector bracket 168 into the headrail 48. FIG. 44 also shows a sensor tab 150 on the beaded cord drive member 124 positioned between the two legs of the translational position sensor 160 mounted on the circuit board 152.

FIG. 50 shows the large motor 58 for driving the transverse and translational motion on the carriers 16 and the vanes 20 in position with its output shaft 126 extending through the bottom wall of the main housing 60. The output shaft 126 engages the keyed recess 128 (see also FIGS. 40 and 41) in the bottom of the beaded cord drive member 124 in order to rotate the beaded cord drive member 124 about its vertical axis when the large motor 58 is actuated. The bead drive cord 32 is shown in the beaded cord channel 134 and is tightly and snuggly positioned against the curved vertical wall 148 of the beaded cord channel 134 as well as in the bead pockets 144 for a positive drive, which minimizes slipping and thus wear and tear on the translational drive system 12. The pin 130 at the top end of the beaded cord drive member 124 is shown received in the pin receiving port 132 in the lid 62 of the housing 60, which helps keep the beaded cord drive member 124 rotating about its vertical axis.

FIG. 51 is a fragmentary cross-sectional view taken along line 51—51 of FIG. 50 illustrating the fitment of the small circular bottom bearing 194 of the motor within the circular retainer 197 of the lower motor housing.

Figure 52:
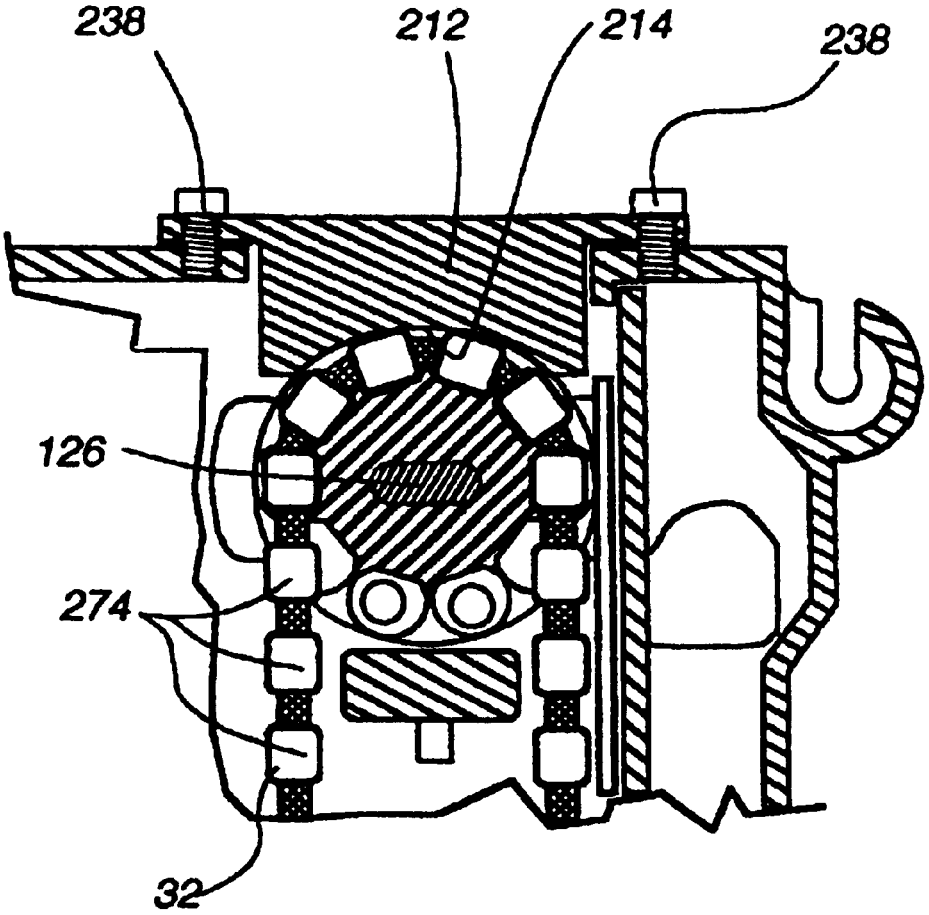
FIG. 52 is a fragmentary cross-sectional view taken along line 52—52 of FIG. 50, and shows primarily the translational drive system components.

FIG. 52 is a fragmentary, cross-sectional view along line 52—52 of FIG. 50 through the housing 60 and through the beaded cord drive member 124, and shows the beaded cord 32 in engagement with the beaded cord channel 134 on the beaded cord drive member 124, and also shows the bead structures 274 seated in the bead pockets 144 and along the vertical wall for a positive drive engagement. The beaded cord guide 212, which is inserted from the outside of the housing 60, is shown in position and attached to the housing 60 by two fastening members 238. The curved front surface 214 of the beaded cord guide 212 closely matches the path of the beaded cord 32, but only keeps the beaded cord 32 in position on the beaded cord drive member 124 if the beaded cord 32 attempts to jump or slip on the beaded cord drive member 124.

When the large motor 58 is actuated by the logic system 240, the output shaft 126 of the motor 58 turns the beaded cord drive member 124, which in turn drives the beaded cord 32 around the loop which extends down the headrail 48. The distal end carrier 46 is then moved along with the beaded cord 32, and, since the other carriers 16 are attached to that end carrier 46 by the pantograph structure 30, the other carriers 16 are thus moved accordingly between the expanded and retracted positions as desired by the user and actuated by the logic system 240. As the beaded cord drive member 124 moves, the sensor tabs 150 formed on the beaded cord drive member 124 pass through the translational position sensor 160 on the circuit board 152 which allows the logic system to keep track of how far the vanes 20 and carriers 16 are extended or retracted. Other configurational arrangements of the translational drive system are contemplated. For example, the large motor's shaft need not be directly connected to the beaded cord drive member as illustrated. Rather, one or more gears could be positioned in an operative configuration in-between the beaded cord drive member and the motor's shaft as would be obvious to one of ordinary skill in the art.

In operation, referring back to FIG. 1, the control system 8 of the instant invention, which includes the translational drive system 12, the angular drive system 14, and the logic system 240 all work together to allow the user to move the vanes 20 along the headrail 48 to any extent desired, as well as to rotate the vanes 20 about a vertical axis to any desired extent, during which time the logic system monitors the current position both translationally as well as angularly, all for the convenience of the user. The wireless sensor 68 allows the user to operate the system with a remote control 246 for the ultimate in convenience.

The instant powered control system 8 invention is contemplated to be retro-fitable to existing coverings for architectural openings with the proper slight structural modifications. Further, the instant invention can also be applied to other types of window coverings that include at least one guide rail, and vanes or slats able to be moved relative to the guide rail in translational and angular motion. This would include horizontal blinds, such as venetian blind structures. The requisite modifications, such as the use of a control system at either end of the guide rail, synchronized with each other, would allow the horizontal blind slats to be raised and lowered together. It would also allow each of the slats to be rotated about a horizontal axis.

Operator Firmware Description

Figure 53:
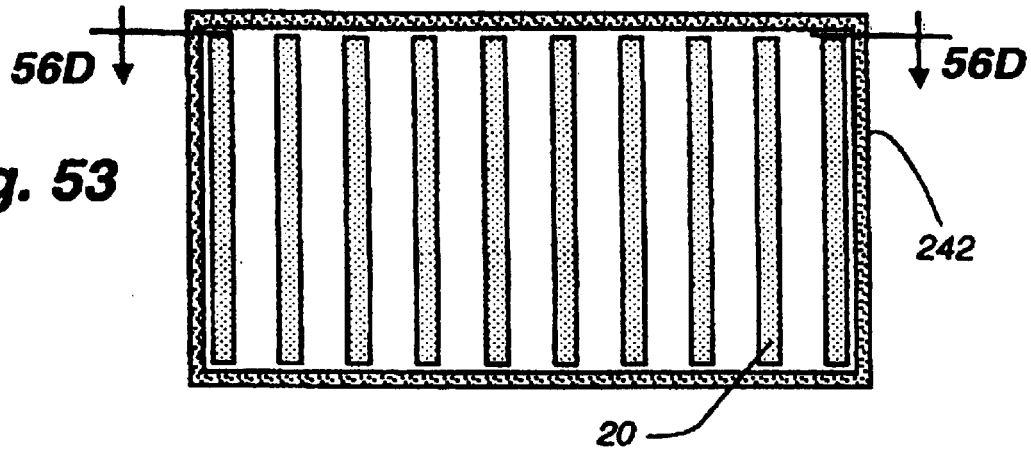
FIG. 53 is a schematic front view of the covering in a configuration similar to that depicted in FIG. 3.
Figure 54:
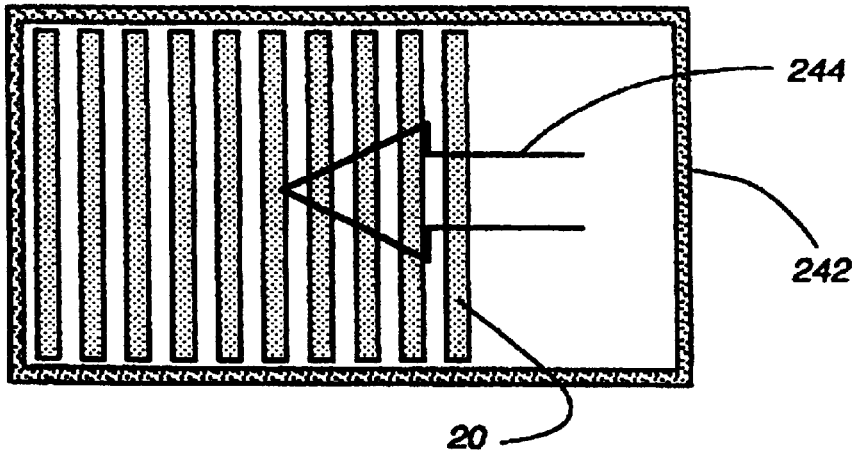
FIG. 54 is a schematic front view similar to FIG. 53, but showing the covering in the process of opening in a single-draw architectural covering.
Figure 55:
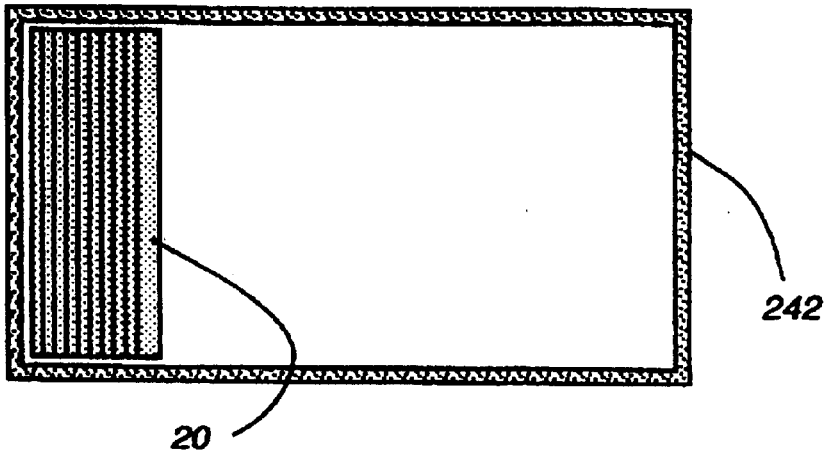
FIG. 55 is similar to FIGS. 53 and 54, but depicts the covering in its fully open or retracted configuration.

As described above, the present invention includes a motorized control system 8 for opening and closing, and for extending and retracting, the vanes 20 of an architectural covering like the one depicted schematically in FIGS. 53, 54, 55, and 56A–56G. FIG. 53 is a schematic elevation of a covering for an architectural opening 242. The covering includes a plurality of vertical vanes 20, which may be distributed across the architectural opening 242 as shown in FIG. 53, or retracted to one or both sides of the architectural opening 242. FIG. 54 depicts the vanes 20 being retracted to the left side of the architectural opening 242 as indicated by arrow 244, and FIG. 55 depicts the vanes 20 fully retracted to the left side of the architectural opening 242. In each of FIGS. 53–55, the vanes 20 are tilted or rotated about their longitudinal axes (or axes parallel to their longitudinal axes) to be oriented perpendicularly to the direction of extension and retraction. This configuration can be seen by looking at FIG. 56D, which is a top plan view taken along line 56D—56D of FIG. 53 and showing the vanes 20 in their fully expanded and fully open configuration.

Figure 56A:
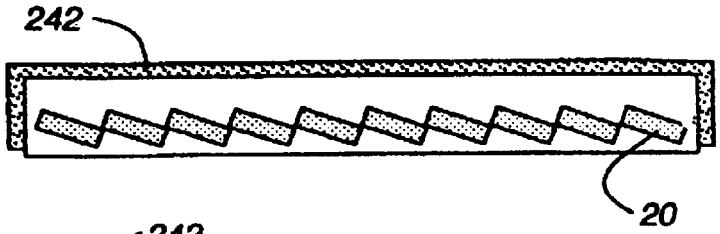
FIG. 56A is a plan view looking downwardly when the vanes are fully extended and closed by rotating them fully counter-clockwise (CCW)
Figure 56B:
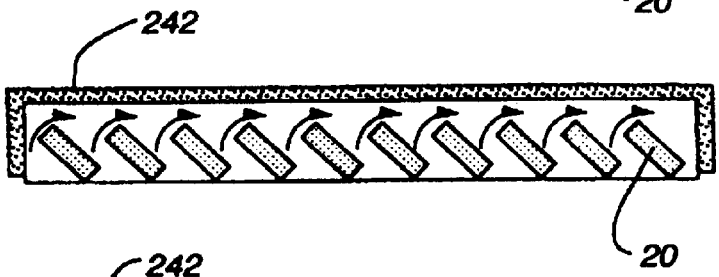
FIG. 56B is similar to FIG. 56A, but depicts the vanes as they commence to rotate clockwise (CW)
Figure 56C:
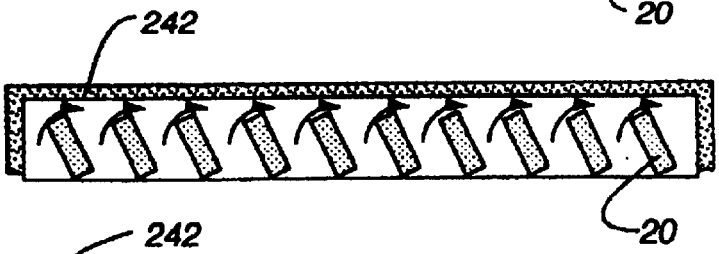
FIG. 56C is similar to FIG. 56B, but the vanes have rotated further clockwise and are approaching an open configuration.
Figure 56D:
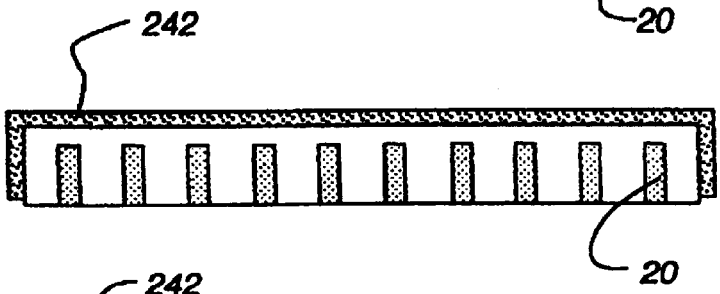
FIG. 56D is similar to FIG. 56C, but depicts the vanes in a stationary and fully-open configuration.
Figure 56E:
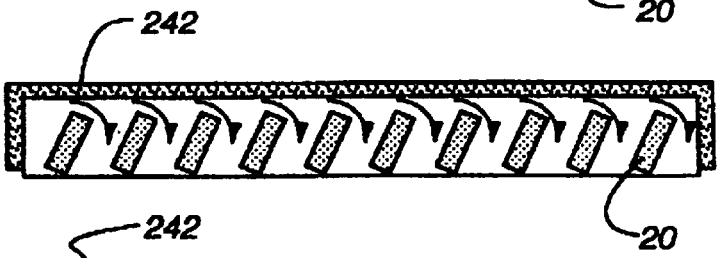
FIG. 56E is similar to FIG. 56D, but depicts the vanes commencing to rotate clockwise toward a closed configuration.
Figure 56F:
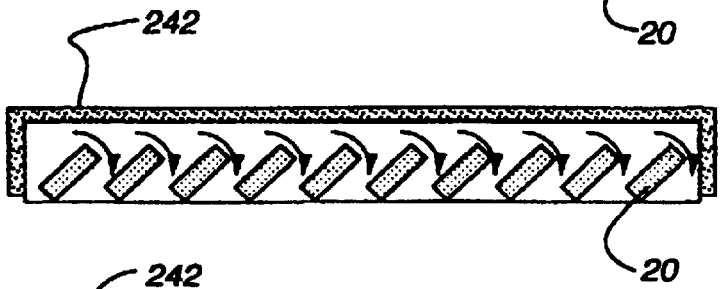
FIG. 56F is similar to FIG. 56E, but depicts the vanes continuing to rotate clockwise toward their closed configuration.
Figure 56G:
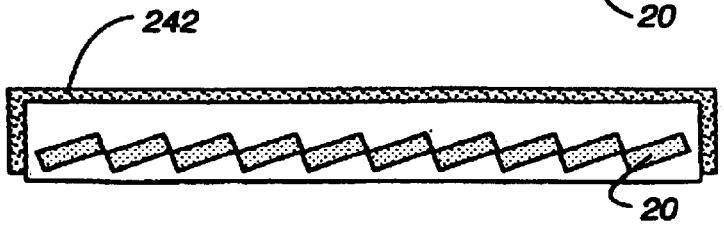
FIG. 56G is similar to FIG. 56F, but depicts the vanes rotated fully clockwise and stationary in a fully extended and closed configuration.

In the present invention, the vertical vanes 20 may be not only extended (FIG. 53) and retracted (FIGS. 54 and 55), but also tilted or rotated about vertical axes (FIGS. 56A–56G). FIGS. 56A–56G depict a possible series of angular positions for the vertical vanes when they start from a fully closed configuration (FIG. 56A), where they have been rotated fully counter-clockwise, and then are transitioned through the clockwise rotation of the vanes 20 (FIGS. 56B and 56C) to their fully open configuration (FIG. 56D), and then continue to be rotated clockwise as shown in FIGS. 56E and 56F until they reach their opposite, fully-closed configuration depicted in FIG. 56G, where the vanes 20 are rotated fully clockwise.

Figure 58:
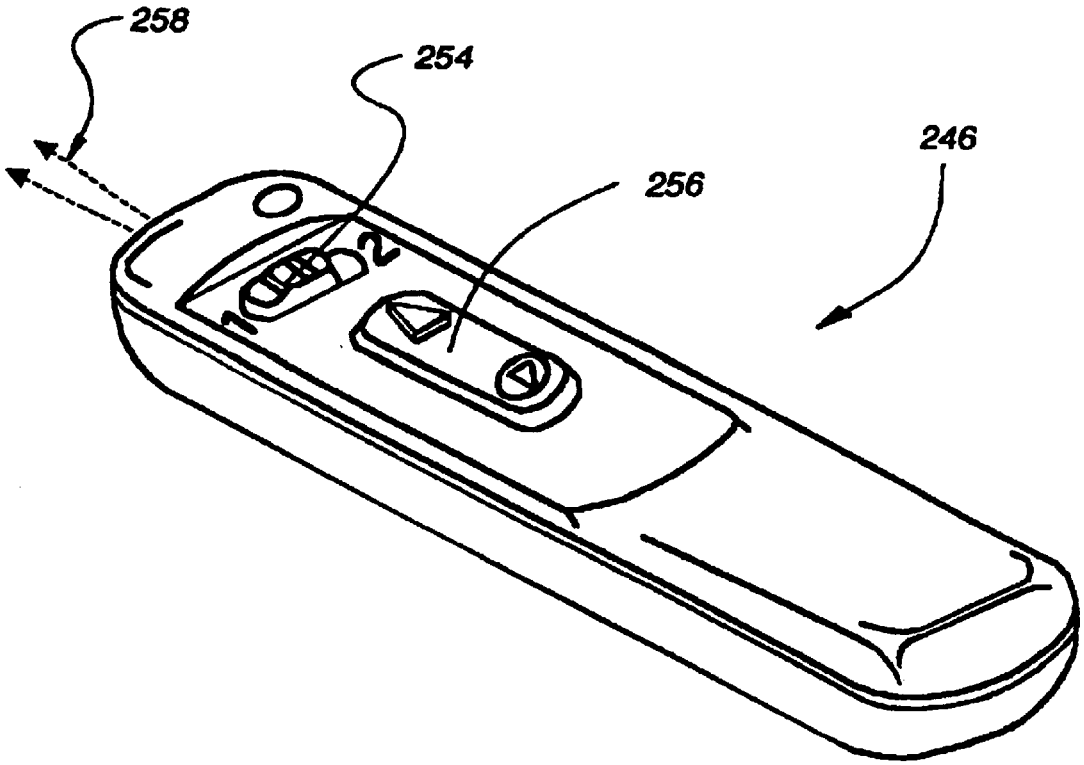
FIG. 58 is an isometric view of a possible infrared (IR) remote control (RC) that could be used in conjunction with the present invention.

In the present invention, the logic system of the control system 8 (FIG. 57) receives infrared (IR) signals 258 from a remote control 246 (also shown in FIG. 58). The logic system 240 running a main operating program decodes the IR signal (IRS) to determine whether a user wants to (i) open or close the vanes 20 by rotating them clockwise or counterclockwise about vertical axes, (ii) extend the covering across an architectural opening 242, or (iii) retract the covering to one or both sides of the architectural opening 242. The block diagram depicted in FIG. 57 depicts the hardware comprising a typical control system 8 incorporating the logic system 240. The hardware includes a large motor 58 to extend and retract (i.e., traverse) the covering horizontally. The small motor 56 is used to rotate (i.e., tilt) the vanes 20 about their longitudinal axes or about axes that are substantially parallel to the longitudinal axes of the vanes 20. A relative, nondirectional shaft encoder (comprising the translational position sensor and the tabbed beaded cord drive member in the preferred embodiment) is present to detect turns of the large motor 58. A cam- or flange-operated switch 250 (comprising the angular position sensor and the flanged tilt rod drive unit of the preferred embodiment) is present to detect if the vanes 20 are rotated counter-clockwise or clockwise or fully open. The control system hardware further includes two H-bridge power amplifiers 251 and 253 to drive the small 58 and large 56 motors. An IR receiver 248 is present to receive IR signals from the remote control 246. In the preferred embodiment, the logic system 240 includes a PIC microprocessor 252 contained within the integrated circuit chip 154 is present to run the operational logic or program. Finally, a power source is present to power the logic system 240. In the embodiment depicted in FIG. 57, the power source is a battery 76 (see also FIG. 6). Alternatively, the power source could be in AC power cord 74 and transformer 76' as shown in FIG. 7.

It is to be appreciated that the operational logic is typically contained in the main operational program, which is preferably resident in nonvolatile memory within the microprocessor or a separate memory chip. During power-up, the program is loaded into the microprocessor for directing the operation of the logic system. In alternative embodiments, however, the hard-wired integrated circuits may be used in place of a program and microprocessor, wherein the configuration of the hard-wired circuits determine the operation of the logic and control systems. Further, any suitable combination of hard-wired circuits and configurable circuits in conjunction with one or more operating programs may be utilized as would be obvious to one of ordinary skill in the art.

The control system 8 hardware shown diagrammatically or schematically in FIG. 57 is shown in greater detail in other figures. For example, the remote control 246 depicted in FIG. 58 could be used to send infrared signals 258 to the infrared receiver 248. As shown in FIG. 58, the remote control 246 preferably includes a frequency or channel selection switch 254, and a control rocker switch 256 permitting two different signals to be sent on each of the selected channels. In the preferred embodiment of the remote control 246, the remote control 246 is powered by a plurality of batteries (not shown) mounted in the remote control unit 246 itself. A remote control signal 258 is generated when the control rocker switch 256 is pressed.

The large motor 58 depicted schematically in FIG. 57 is also depicted isometrically in FIGS. 18 and 19. FIG. 18 shows the top end of the large motor 58, including its output shaft 126, and FIG. 19 shows the bottom end of the large motor 58. This large motor is also depicted clearly in FIGS. 8B and 50. Similarly, the small drive motor 56 is depicted isometrically in FIGS. 20 and 21. FIG. 20 depicts the top end of the small motor 56, including its output shaft 92, and FIG. 21 depicts the bottom or lower end of the small motor 56. FIGS. 8B and 44 clearly depict how the small motor 56 is mounted to the main housing 60 of the control system 8.

Portions of the IR receiver 248 depicted schematically in FIG. 57 may also be seen in, for example, FIGS. 4–6. In the preferred embodiment depicted in the drawings, the wireless control signal sensor 68 comprises a fiber optic cable, which routes the incoming IR signal to the integrated circuit chip 154 that is clearly visible in FIGS. 8A and 22.

The cam- or flange-operated switch 250 that is shown schematically in FIG. 57 comprises multiple components depicted in the other figures. For example, the flange-operated switch 250 includes the indicator flange 116 comprising part of the tilt rod drive unit 88 (FIGS. 8A, 27, 28, 29 30, 31, and 32). It also includes the vane angular position detector or sensor 158 that is clearly visible in FIG. 22 and visible in cross-section in FIG. 46. In the preferred embodiment, the angular position sensor 158 is an option detector. The flange-operated switch 250 detects when the vertical vanes 20 are in their fully-open configuration (e.g., FIGS. 3–6 and 56D) by detecting when a radial edge 260 of the vane angular position indicator flange 116 passes by the flange position detector 158, as clearly shown in FIG. 46. With this interaction between the vane angular position indicator flange 116 and the angular position sensor 158, the logic system knows when the vertical vanes 20 are rotated clockwise (CW) or counter-clockwise (CCW) and when they are fully centered. The logic system does not necessarily know the precise extent to which the vertical vanes 20 are rotated, but the logic system knows precisely when the vanes 20 are in their fully-open configuration since, at that moment, the radial edge 260 of the indicator flange 116 passes by the position sensor.

The relative, nondirectional shaft encoder depicted schematically in FIG. 57 also comprises multiple components that are shown to good advantage in other figures. The shaft encoder includes, for example, the position indicator tabs 150 (FIG. 8A) comprising part of the beaded cord drive member 124. These position indicator tabs 150 extend radially outward from the axis of rotation of the beaded cord drive member 124, which is also clearly shown in FIGS. 37–41, 42, and 43. As depicted in FIGS. 44 and 50, the position indicator tabs pass through a second detector 160 mounted to the circuit board 152 that carries the integrated circuit chip 154. Once the logic system registers a digital position to a physical position of the vanes 20 along the horizontal headrail 48, the relative, nondirectional shaft encoder is able to determine whether the vertical vanes 20 are fully extended across the architectural opening 242, fully retracted to one or both sides of the architectural opening 242, or somewhere in-between. In particular, the logic system knows how far the vanes 20 move horizontally with each passing of a position indicator tab 150 through the tab sensor 160. By calculating how much the beaded cord drive member 124 has rotated under the influence of the large motor 58, the logic can calculate the relative horizontal position of the vanes 20 along the headrail 48. Since the translational position sensor 160 in the preferred embodiment is nondirectional, it cannot determine whether the beaded cord drive member 124 is rotating clockwise or counter-clockwise. The logic system, however, knows which button has been pressed on the remote control 246 when the channel selection switch 254 is in the position that permits the IR signals to carry extension and retraction information. With the two pieces of information, the logic system can determine how retracted or extended the covering is.

Figure 66:
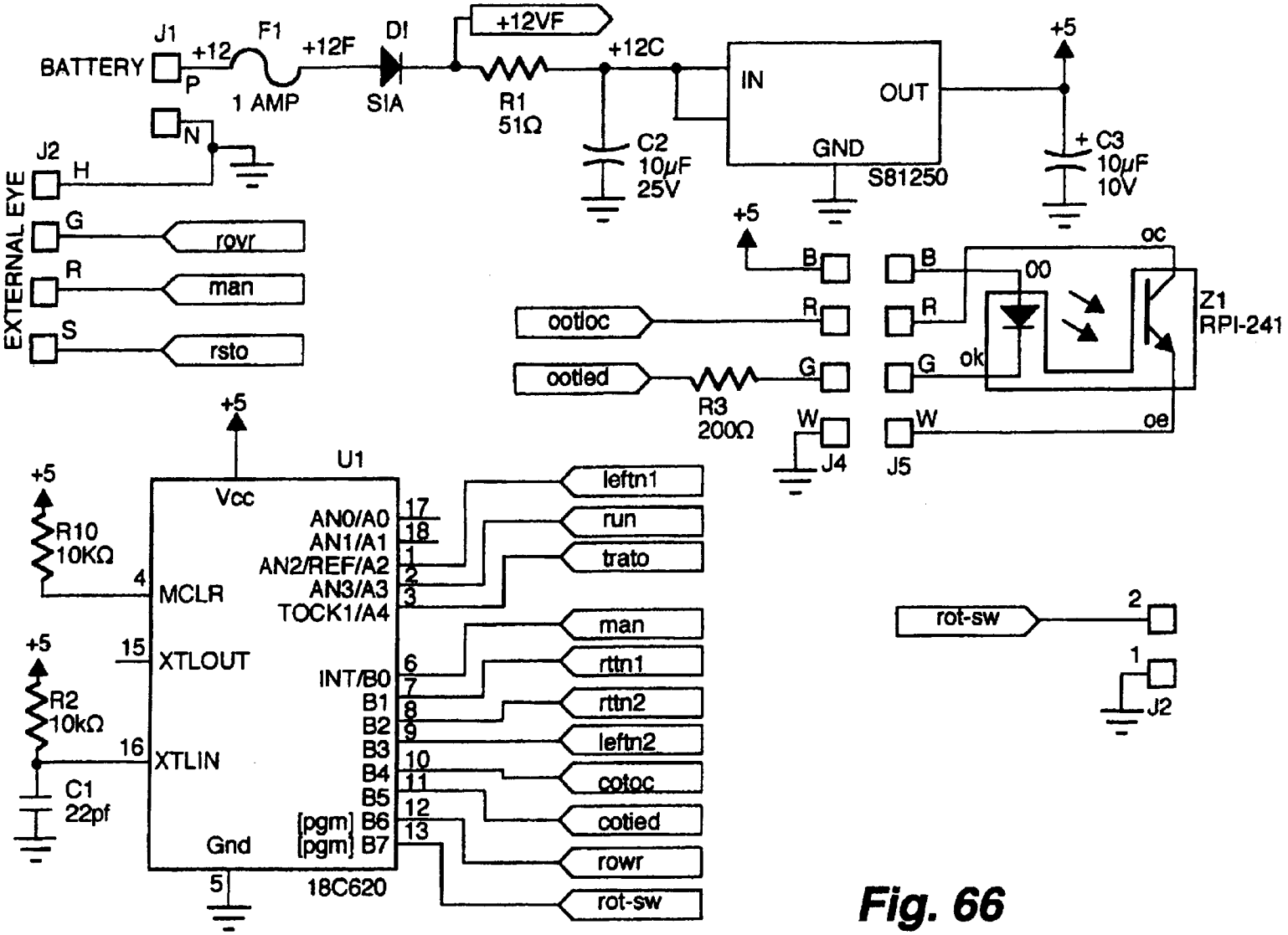
FIGS. 66 and 67 are schematic diagrams of operator circuits.
Figure 67:
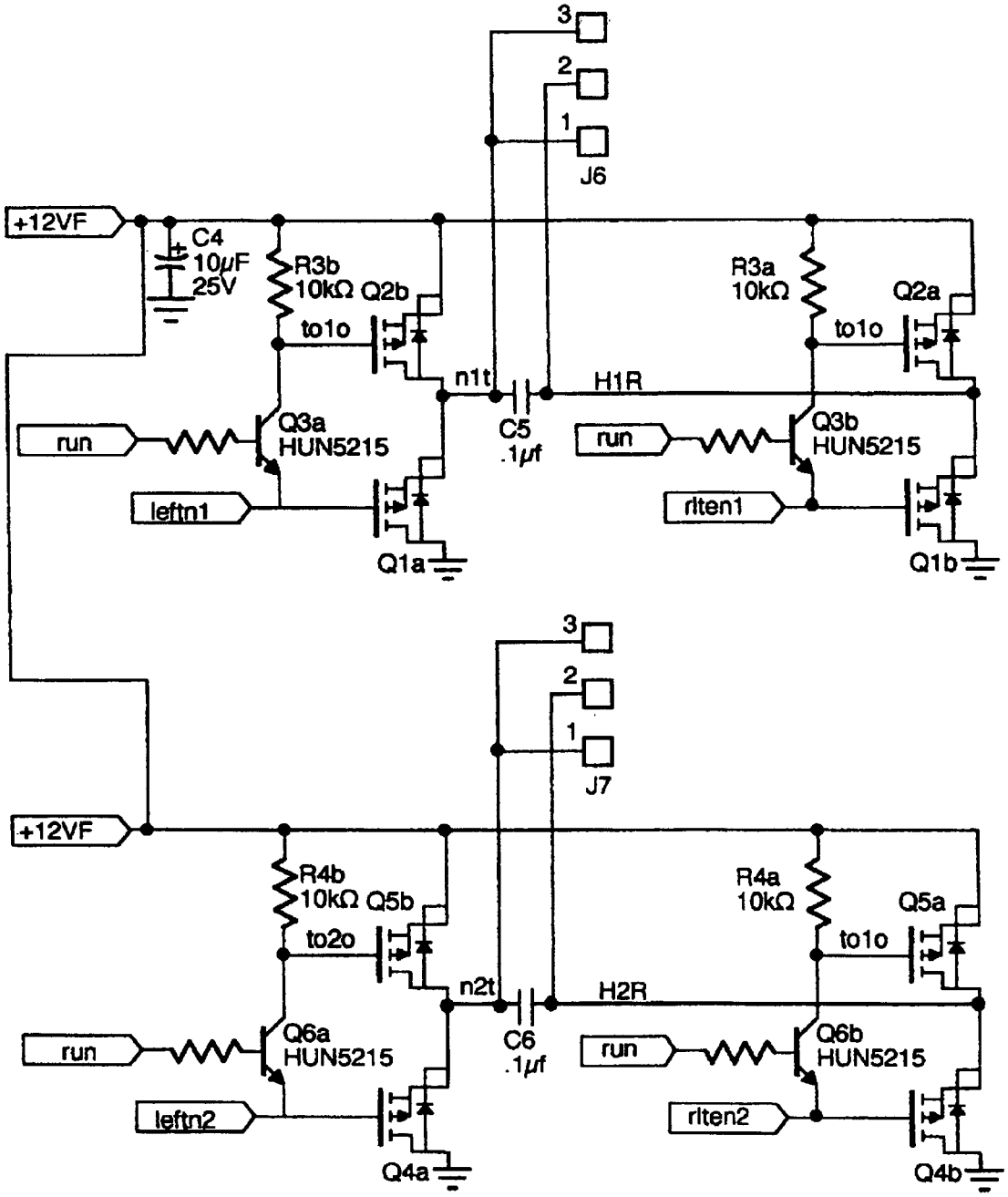

The microprocessor 252 that is depicted schematically in FIG. 57 incorporates some of the circuits depicted in FIGS. 66 and 67. In the preferred embodiment, as previously mentioned, the microprocessor 252 that runs the main operator program is a PIC microprocessor.

Although the vertical vanes 20 comprising the covering may be tilted or rotated clockwise or counter-clockwise to regulate the transmission of light or air through an architectural opening 242, in the preferred embodiment the vanes 20 must typically be oriented perpendicularly to the traversing direction 244 (FIG. 54) before the covering can traverse. Thus, the main operating program of the logic system 240 includes logic instructions to ensure that the vertical vanes 20 are properly oriented before traversing commences. As mentioned above, the IR remote control 246 of the preferred embodiment includes a rocker switch 256 and a channel selector 254. When the traverse channel (channel 1) is selected and "position 1" is activated, the vanes 20 will pivot (as necessary) until they are fully open and then make the covering move leftwardly (in FIGS. 53–55) until either the button is released or the covering reaches the leftmost end of travel (FIG. 55). Similarly, when "position 2" is pressed, the vertical vanes 20 will pivot (as necessary) until they are fully open and then move rightwardly (i.e., in the opposite direction from the direction 244 shown in FIG. 54) until they are fully extended as shown in FIG. 53.

When the logic system 240 is first powered up, it has no idea where the covering is positioned on the headrail. However, when powered up and in use after a power-up initialization, the logic system, using the positioning indicator radially extending tabs 150 and the translational position sensor 160, is able to keep track of how far the covering has traveled and the coverings position in whichever direction the covering is traversing. When the logic system 240 determines that the covering, which is moving leftwardly (FIG. 54) has stopped, it assumes that the blind has reached the leftward limit of its travel (FIG. 55). Accordingly, the logic system 240 sets the relative position of the covering as being at its left limit. In the preferred embodiment, this position becomes the digital retraction limit, which the logic system assumes corresponds with the physical retraction limit (in other words, the logic system assumes that the covering is fully retracted as shown in FIG. 55). The logic system similarly learns the right limit, which is the digital extension limit (in other words, for the digital extension limit, the logic system assumes the covering is fully extended as shown in FIG. 53).

Once the logic system 240 learns the left and right digital limits, the logic system 240 during a traversing operation, will stop the covering before it reaches the corresponding physical limits to avoid undue wear on the hardware due to the rapid deceleration of impacting a physical limit. It is possible that the covering may be stopped by an obstruction before reaching a limit. If that were to occur, the logic system 240 would relearn that position as a digital limit. Thus, it is possible that the internal, digital position may lose registration with the actual, physical position of the covering because there is no on-going mechanism to register the digital position to the physical one. If a user notes that the digital limit does not correspond with, or is not registered with, the physical limits, the logic system 240 permits the user to override the digital limits. In particular, if the rocker switch 256 on the remote control 246 for the desired direction of movement is held down for approximately 1.5 seconds, the logic system 240 will attempt to move the covering even though it "thinks" the covering is at a physical limit. Thereafter, once the covering stops at the true physical limit, the logic system 240 relearns the new limit as its digital limit.

As mentioned above, the logic system 240 does not know how much the vanes 20 may be tilted clockwise or counter-clockwise. It does know, however, when the vanes 20 are tilted clockwise or counter-clockwise from the fully-open position (e.g., FIG. 56D) by reading the signal from the angular position sensor 162 comprising part of the flange-operated switch 250, as described above. While the logic system 240 is tilting the vanes 20, the moment the flange-operated switch 250 changes state, the logic system 240 knows that the vanes 20 are in their fully-open configuration.

Figure 59:
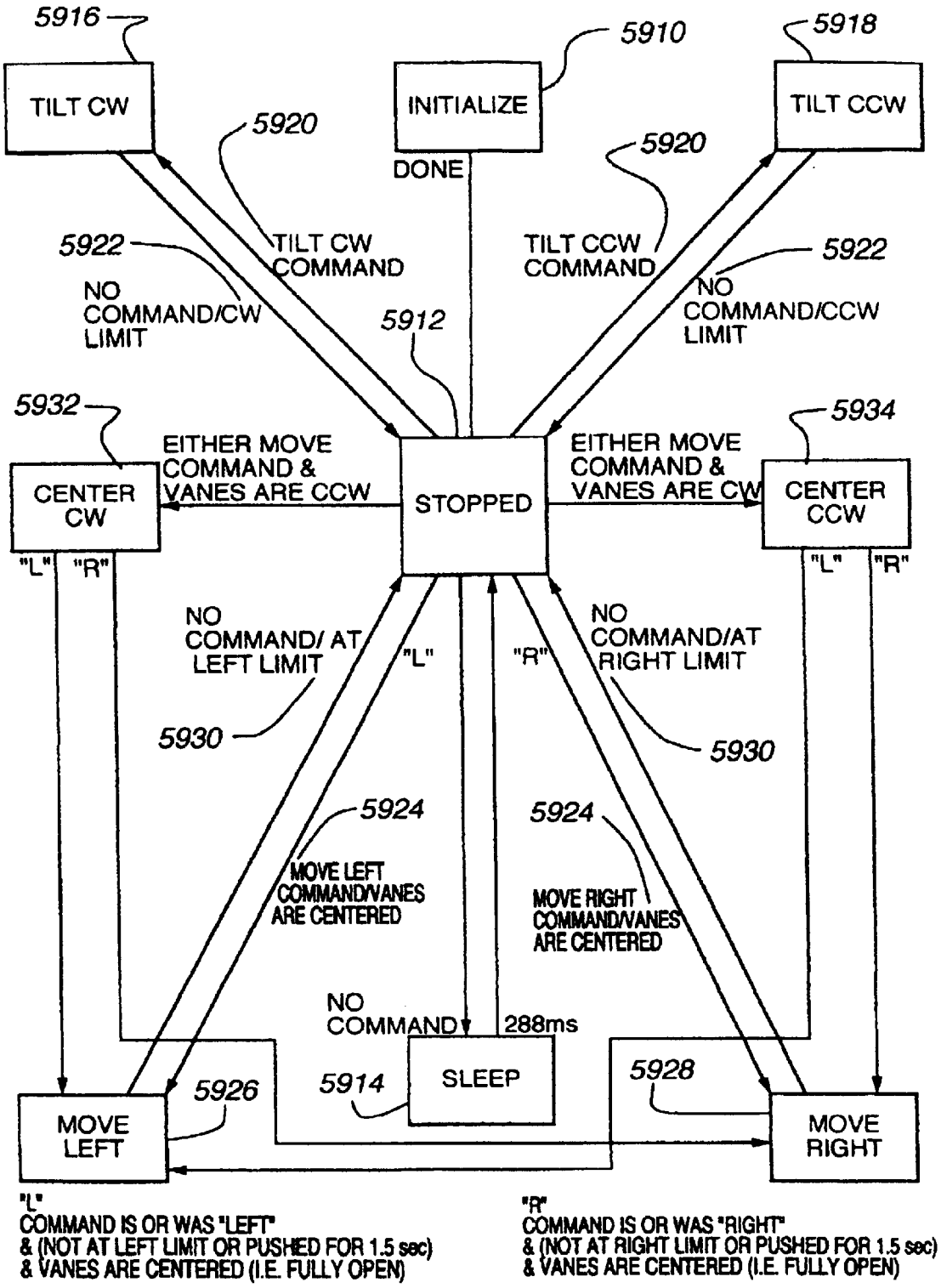
FIG. 59 is a state diagram representation of the main operator program.

In order to ensure that the large drive motor 58 is not activated to extend or retract the covering horizontally before the vanes 20 are oriented in their fully-open configuration, the main operating program instructs the logic system to conduct various checks to determine whether the vertical vanes 20 are oriented for extension or retraction. During this process, the logic system executing the main operating program can be represented schematically as a state machine that is in one of the nine states shown in FIG. 59. As shown in FIG. 59, after power-up (i.e., after the power source is connected), the logic system enters the Initialize State represented by block 5910. During this time, the logic system 240 initializes itself, the processor hardware, and the operator hardware. The logic system 240 never enters this Initialize State again, except if the power source is disconnected and then reconnected. After being initialized, the logic system alternates between the Stopped State represented by block 5912, where it checks whether there is a command from the IR remote 246, and the Sleep State represented by block 5914, which conserves energy. The Sleep State lasts for 288 milliseconds in the preferred embodiment.

If a user were to send a tilt command (action 5920) while the program is in the Stopped State, the Main Program would go into the Tilt CW State represented by block 5916 in FIG. 59 or the Tilt CCW State represented by block 5918 in FIG. 59. The vertical vanes 20 would then be tilted or rotated until either the command to tilt discontinues 5922 (i.e., the user stops transmitting a tilt IR signal) or the clockwise or counter-clockwise tilt limit is reached. In the preferred embodiment, the logic system also returns to the Stopped State 5912 after the vertical vanes 20 have moved for four seconds. Subsequently, the Main Program returns to cycling between the Stopped State 5912 and the Sleep State 5914.

Continuing to look at FIG. 59, if the user sends a traverse command (action 5924), the main operating program causes the logic system 240 to first check whether the vanes are fully open, which it remembers from the last time it tilted the vanes. As shown in FIG. 59, the blind will not move leftwardly, for example, unless (i) the traverse command is "left," (ii) the covering is not at a left digital limit or the user presses the remote button for 1.5 seconds, and (iii) the vanes 20 are centered (i.e., fully open). If all of these conditions are met (received valid move command; covering not a digital limit or the user presses the direction button on the remote for at least 1.5 second; and the vanes are centered), the logic system goes into the Move Left State represented by block 5926 or the Move Right State represented by block 5928 (if the traverse command is "right") to traverse the blind in the desired direction. The logic system 240 stops the traverse operation 5924 when the user either releases the button or when the covering reaches a digital limit position stored in memory (i.e., the digital limit 5930). The logic system 240 will start moving the covering in the desired direction only if the logic system does not think that the covering is already at the digital limit for that direction. Even if the logic system 240 thinks that the covering is at the digital limit, however, if the user keeps pressing the remote button, after about 1.5 seconds, the logic system 240 erases the digital limit and traverses the blind as requested, until the user releases the button, or the blind is physically stopped 5930. If the blind is physically stopped, the logic system sets that position as the new digital limit.

If the vertical vanes 20 are not fully open when a user attempts to initiate a traverse operation 5924, the logic system 240 first tilts the vertical vanes 20 until they are fully open by entering the Center CW State represented by block 5932 or the Center CCW State Block 5934. The logic system 240 determines which way to tilt the blinds according to which orientation the vertical vanes 20 are in at the beginning of the requested traverse operation. After centering the vertical vanes, the program then proceeds to the Move Left State 5926 or the Move Right State 5928, to transverse the covering in the desired direction. In the preferred embodiment, once the logic system 240 starts tilting the vanes 20 toward the fully-open configuration, even if the user releases the traverse button, the operator continues tilting the vanes until they are fully open. Then, the Main Program returns to cycling between the Stopped State, represented by block 5912, and the Sleep State, represented by block 5914.

Figure 60:
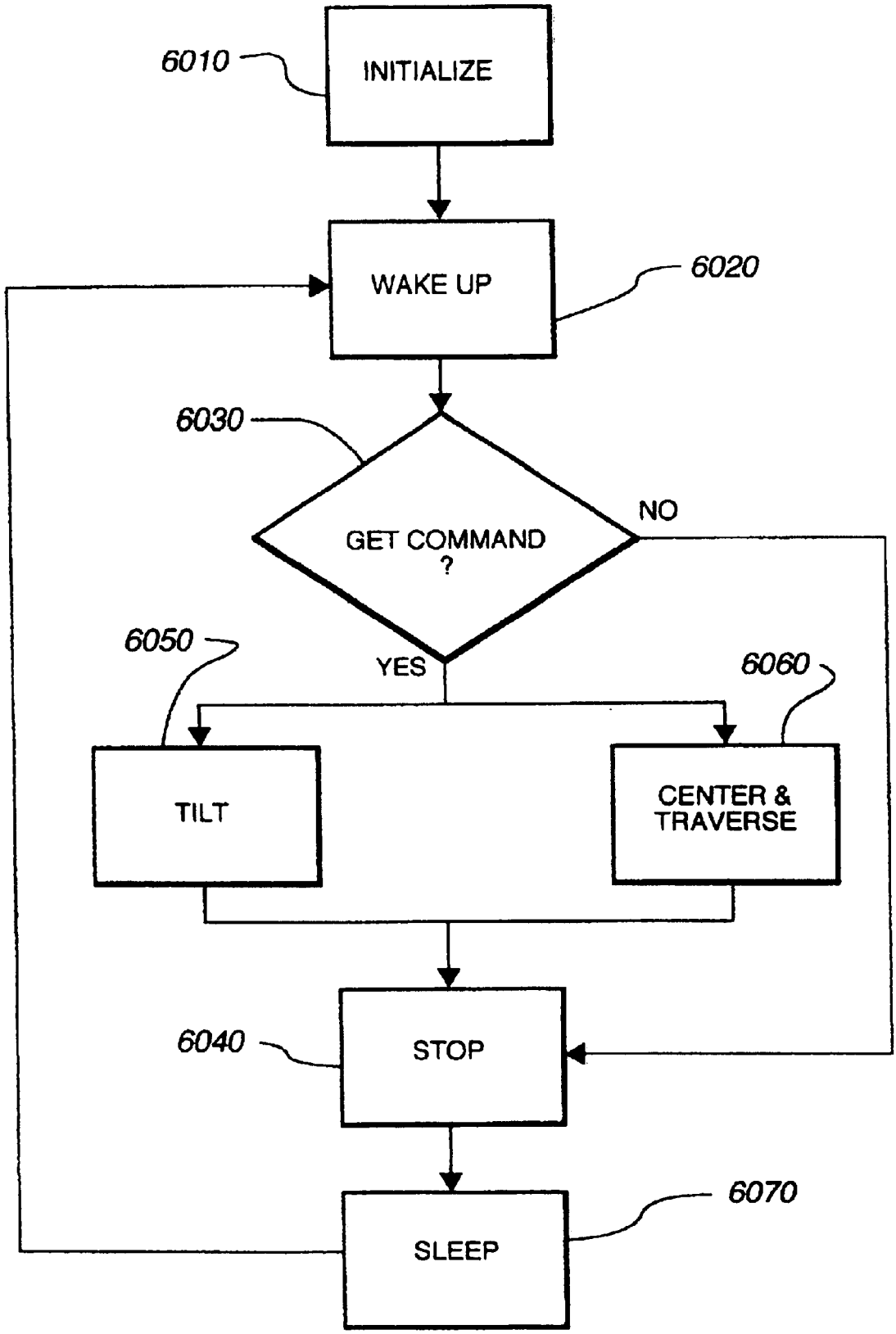
FIGS. 60 60A, 60B, 60C, 60D, and 60E together comprise a representative flowchart of the main operation program.

Referring now to FIGS. 60, 60A, 60B, 60C, 60D, and 60E, a flowchart of the main operating program is described. FIG. 60 is a simplified flowchart representation of the overall process carried out by the logic system under the direction of the main operating program, and FIGS. 60A–60E provide a more detailed flowchart representation. At block 6010, the logic system is initialized. The initialization step typically occurs only once unless the logic system 240 loses power and loses all of its settings. As shown in block 6010A of FIG. 60A, the process of initialization includes the following steps: (i) loading the main operating program into the microprocessor registries during logic system setup; (ii) clearing any random access memory (RAM registers are used to store positioning data); (iii) braking the motors; and (iv) setting the motors position at midpoint (even though the logic system does not know the actual position of the vanes translationally or angularly at this time).

Figure 60A:
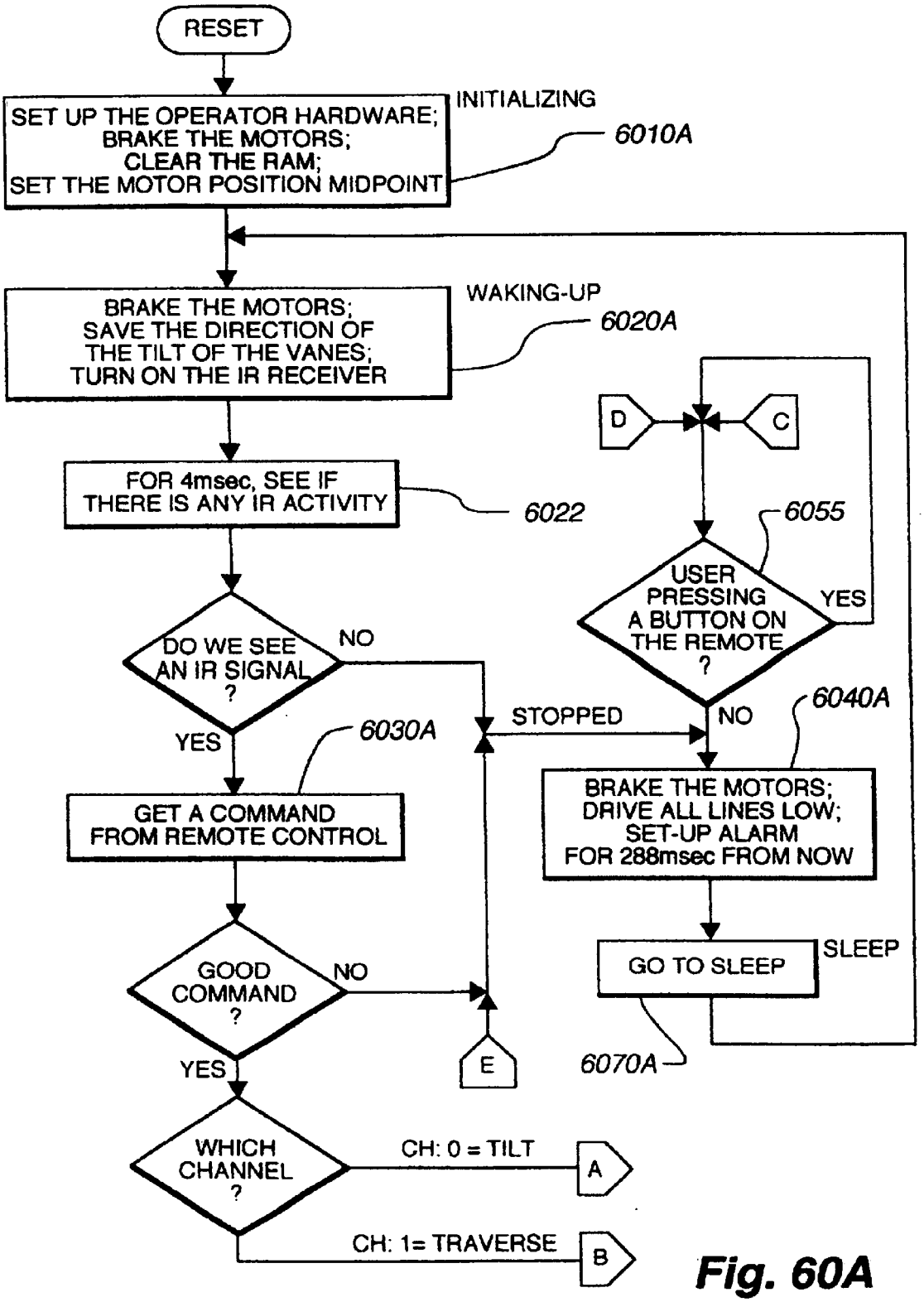

At blocks 6020 and 6020A of FIGS. 60 and 60A respectively, the logic system wakes up, adjusts and activates various components, stores certain parameters concerning the positioning of the vanes in RAM (if available). Next, the logic system looks for a signal from the remote control 246 for a time period of 4 milliseconds as shown at block 6022 of FIG. 60A. If a signal is received, the logic system, through a Decoder Machine, attempts to retrieve a command from the IR receiver as shown in blocks 6030 and 6030A of FIGS. 60 and 60A, respectively. Operation of the decoder machine is discussed in detail below.

If no command is received in the prescribed time the logic system 240 does the following: (i) shuts down the various components including the motors; and (ii) sets an alarm at block 6040 and 6040A for 288 milliseconds as shown in Blocks 6040 and 6040A. Next, as shown in blocks 6070 and 6070A, the logic system goes into the sleep state for the period of the alarm to be reawaken at the expiration of the alarm to repeat the flowchart cycle at block 6020 and 6020A.

If, on the other hand, a command is received from the Decoder Machine, the logic system 240 will proceed to either the tilt operation (block 6050) or the center and traverse operation (block 6060), depending upon what command was received. A detailed flowchart for the tilt operation is provided in FIG. 60B and a detailed flow chart for the traverse operation is provided in FIGS. 60C–60E. After performing the requested tilt or traverse operation, the logic system 240 again shuts down various components and sets an alarm at block 6040. Following the stop operations represented by block 6040, the logic system 240 goes to sleep at block 6070. After the alarm time passes, the logic system 240 returns to block 6020, wakes up, and repeats the cycle.

Figure 60B:
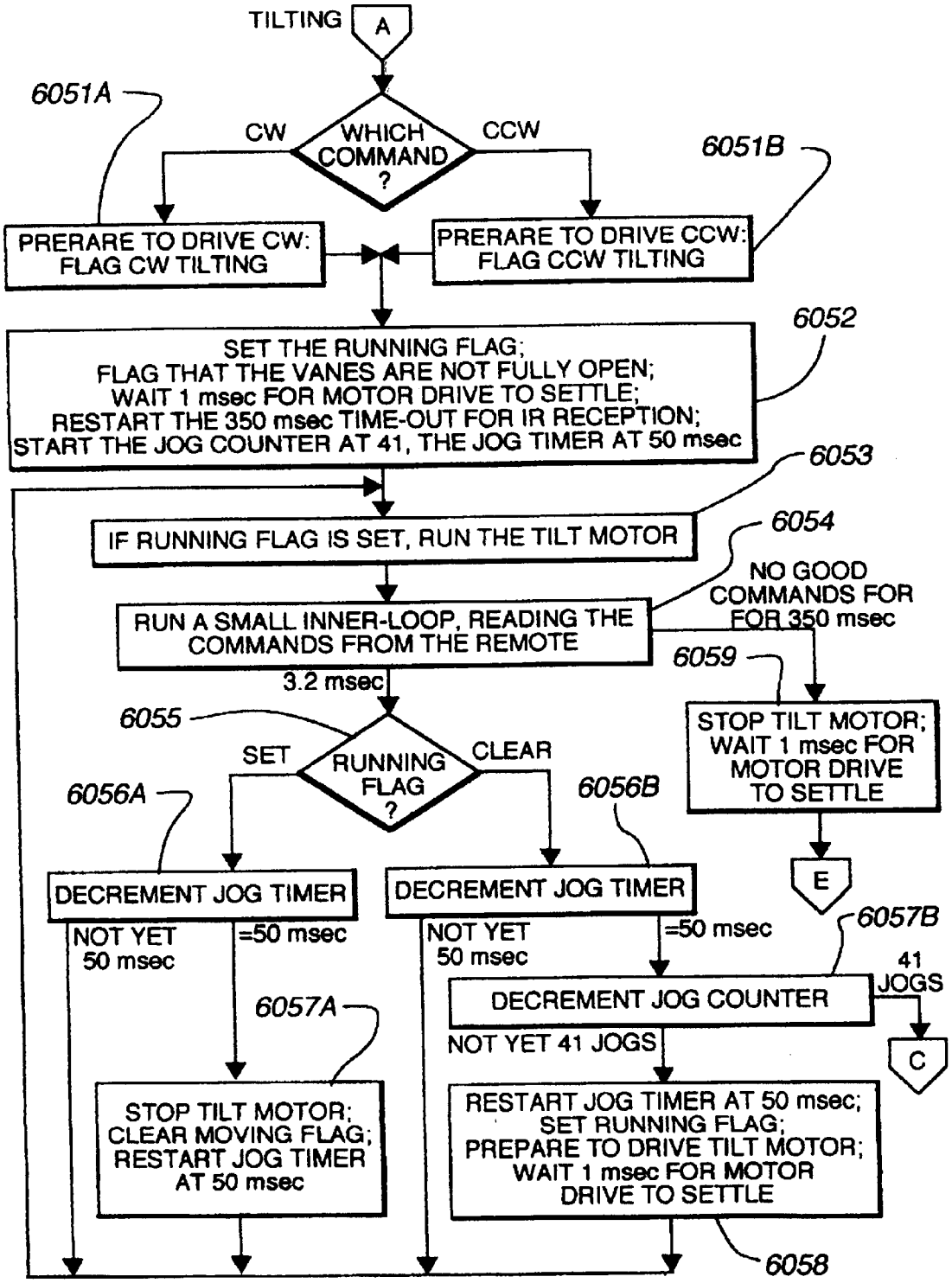

Referring to FIG. 60B, the logic system first determines whether the tilt command is to tilt the vanes clockwise or counterclockwise, and the logic systems prepares to drive the small motor 56 in the appropriate direction in blocks 6051A and 6051B. At block 6052, a flag is set that the vanes are not fully open, a 350 millisecond time-out timer is started concerning the continued IR reception of the appropriate command, and a jog counter is incremented to 41 and an associated jog time is set at 50 milliseconds. At block 6053, the tilt motor is activated and run in the proper direction. As shown in block 6054, commands are read from the remote by a Decoder Machine (described in detail below) as the motor is running. After the motor has run 3.2 milliseconds, the status of the running flag is checked in decision block 6055. If the Running Flag is still set the jog timer is decremented in block 6056A. If the Running Flag is cleared, the jog time is decremented in block 6056B. As long as the timer has not reached 50 milliseconds, the motor continues to run as indicated. Once the jog timer reaches 50 millisecond, the running flag is cleared and the motor is momentarily stopped, the jog counter is decremented, and a new 50 millisecond jog timer is started as illustrated in blocks 6057A, 6057B, and 6058, respectively. It can be appreciated that, based on this algorithm, the tilt motor does not move continuously, rather, it cycles off and on, running for no more than 50 milliseconds at a time.

Given the known speed of the tilt motor, the time to move the tilt motor from one closed position to another is less than approximately 4 seconds. If the motor is taking longer to move the vanes from the one angular position to another, there is likely undue strain or load on the associated angular drive system mechanisms. Accordingly, once the jog counter has been decremented 41 times (equivalent to just over 4 seconds motor run time), the motor is braked and the system is put into sleep mode indicated by blocks 6040A and 6070A of FIG. 60A.

Referring back to FIG. 60B, block 6054, if no appropriate command is read from the remote in 350 milliseconds from the start of the IR time-out timer, the tilt motor is stopped in block 6059 and the motor is braked and the system is put into sleep mode indicated by blocks 6040A and 6070A of FIG. 60A. If a good command is received in block 6054, the IR time-out timer is reset for another 350 millisecond period.

Figure 60C:
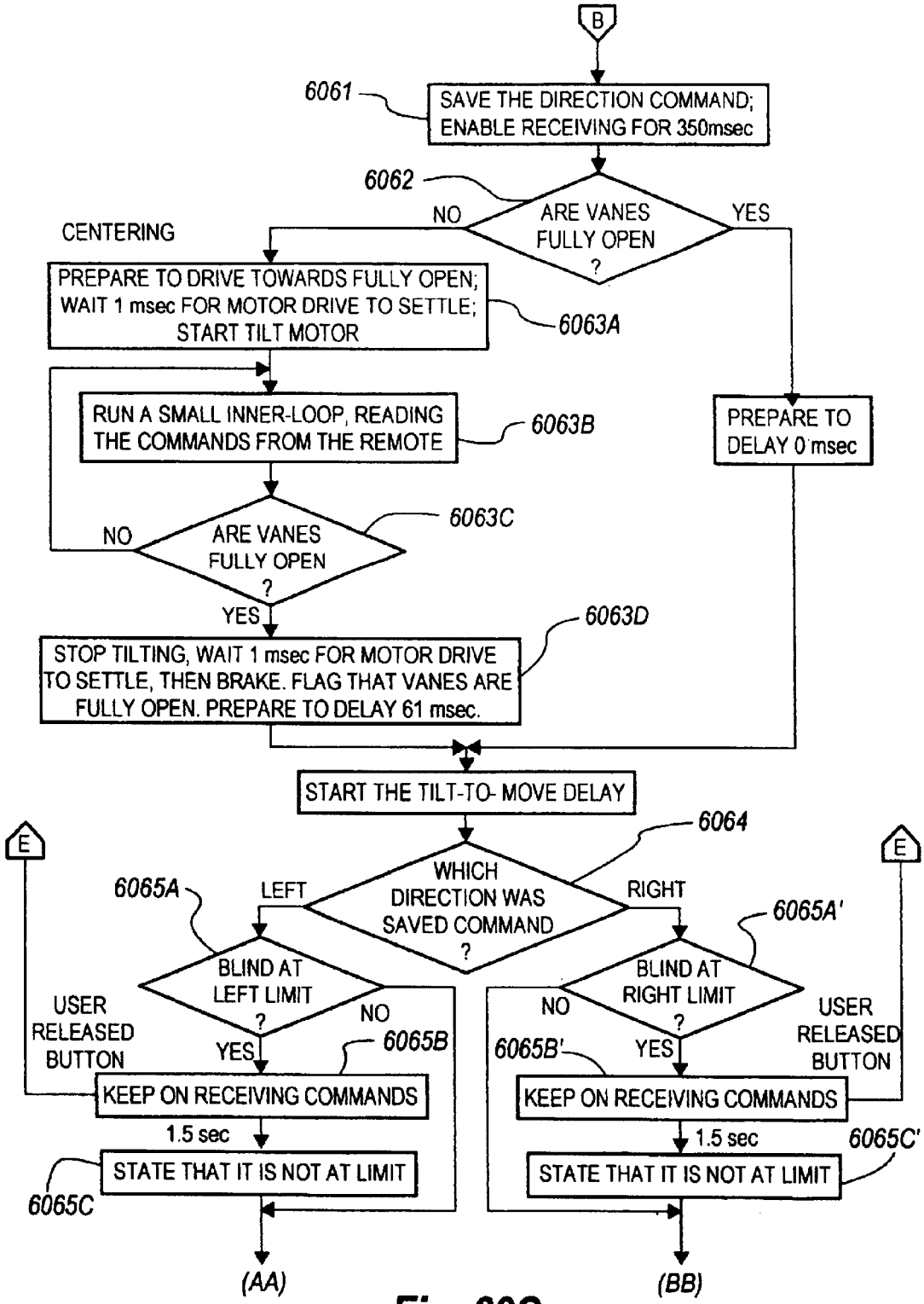
Figure 60D:
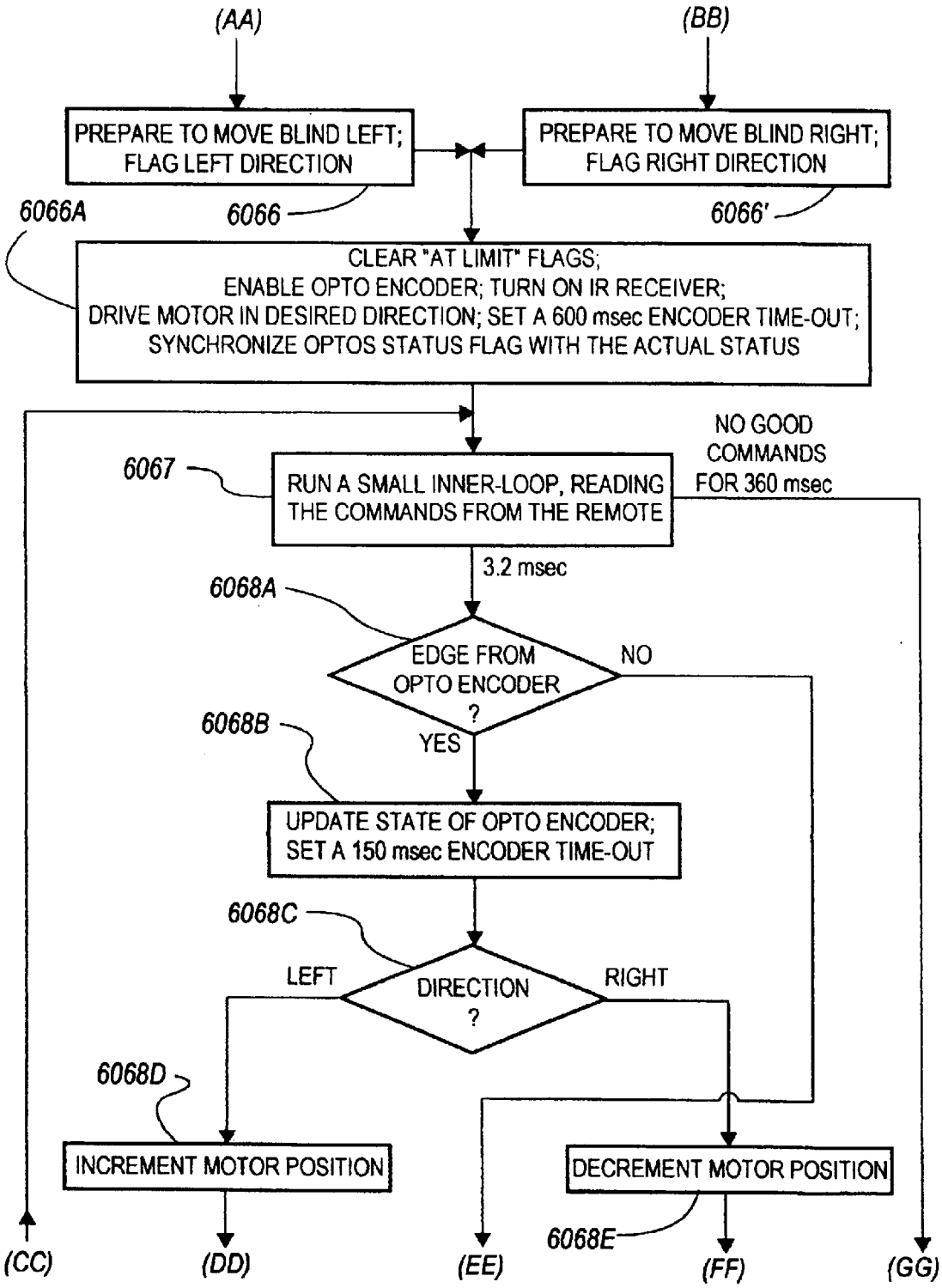
Figure 60E:
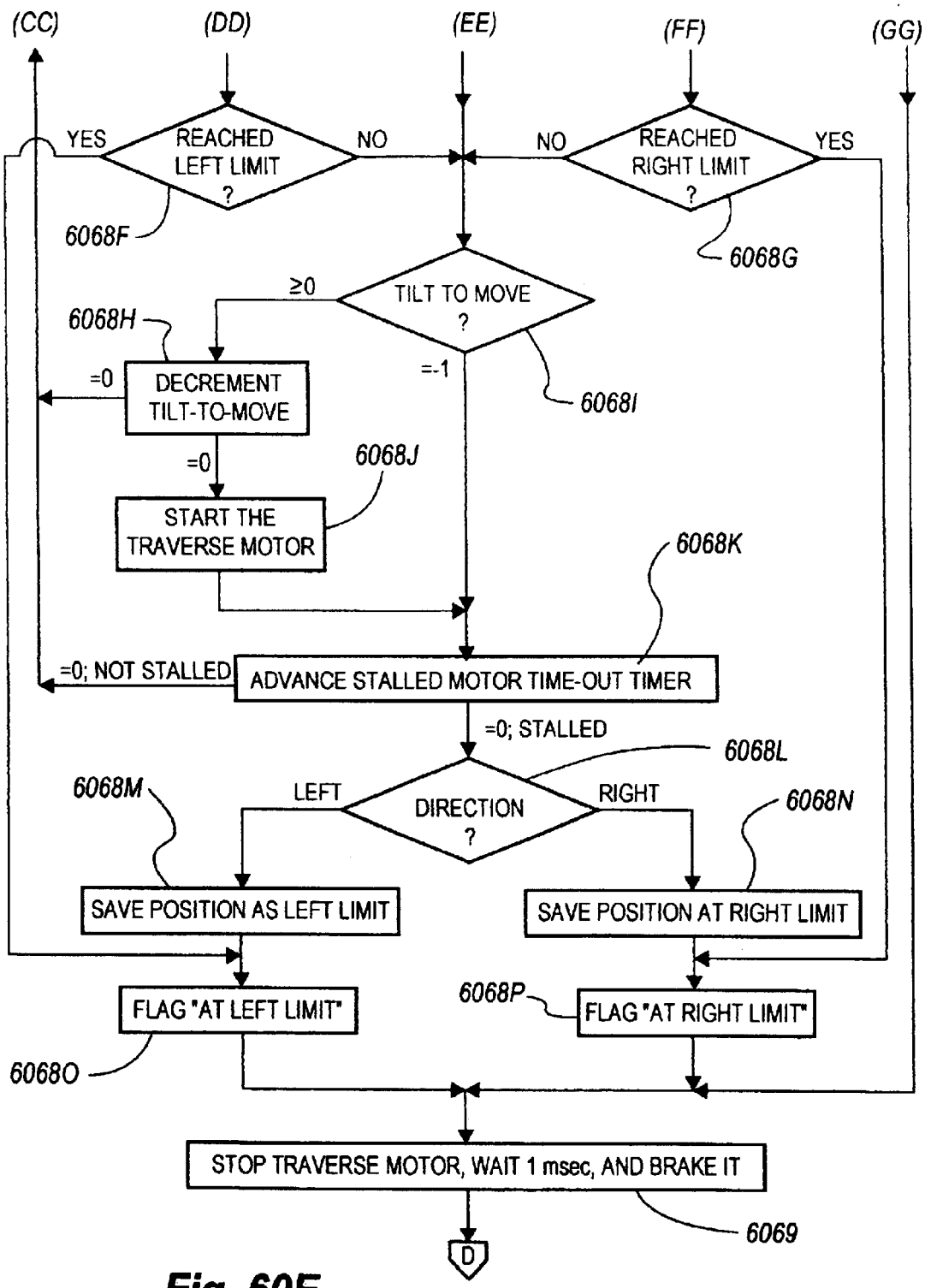

Referring to FIG. 60C, the logic system saves the direction command indicating the direction in which the vanes are to be traversed and enables the IR receiver for 350 milliseconds. Next, in decision block 6062, the logic system determines whether the vanes are fully open so that traversing may begin by accessing and reading the appropriate register in RAM. If the vanes are not centered, the logic system centers the vanes as indicated in blocks 6063A–D. The logic system then determines which direction the vanes are to be moved in block 6064 and determines whether the vanes are at either their left or right digital limits in blocks 6065A and 6065A'. If they are at one of their limits, the logic system determines whether it has continued to receive the traverse command for 1.5 seconds to override the digital limit as indicated in blocks 6065B–C and 6065B'–C'. If the command has not been received for the necessary override period, the logic system proceeds to block 6040A as shown in FIG. 60A. If the vanes are not at a digital limit, the logic system proceeds to block 6066 or 6066' and prepares to proceed with traversing the vanes and begins traversal by starting the large motor 58 in block 6066A.

At block 6066A, the "at limit" flags are cleared, the translation sensor is enabled (opto encoder), the IR receiver is activated, and a 600 millisecond encoder flag is set. At block 6067, a 360 millisecond timer is set and the Decoder Machine is called to read commands from the remote control. If no appropriate commands are received in the 360 millisecond period directing the logic system to continue its traversing operation, the motor is stopped and braked, and the logic system proceeds to block 6055 of FIG. 60A, where it remains until the user stops pressing the rocker switch on the remote. Once the user has stopped pressing the switch, the program proceeds to the sleep mode as indicated in blocks 6040A and 6070A. If a new code is received during the 360 millisecond period, the traversal operation continues to proceed as indicated by blocks 6068A–P. It is to be appreciated that the process by which the Decoder Machine is looking for a "good command" occurs simultaneously with the operation of the main operating program as is explained in greater detail below. Accordingly, while the Decoder Machine is looking for a message during the 360 millisecond period, the logic system is causing the vanes to traverse the headrail as indicated by the flowchart of FIG. 60A.

Referring to blocks 6068A–P, the direction that the vanes are to move is determined, the position of the vanes as determined by the position of the motor relative to the left and right digital limits is determined, and, provided the vanes are not registered as being at one of the digital limits, the motor is started and the vanes are moved translationally. If a left or right limit is reached during the movement of the vanes that causes the motor to stall before the motor reaches one of the current digital limits, the logic system sets the current position as the new digital limit for the associated direction of travel. Once the digital limit for extension or retraction has been reached, the motor is stopped and braked and the logic system advances to block 6040A and 6070A of FIG. 60A wherein the logic system enters the sleep mode.

In FIGS. 60 and 60A, the flowcharts depict the process of decoding a command from the remote control as a single block operation. This process is, however, rather involved and is executed by a Decoder Machine described in more detail below in connection with FIGS. 61–65C.

Figure 61:
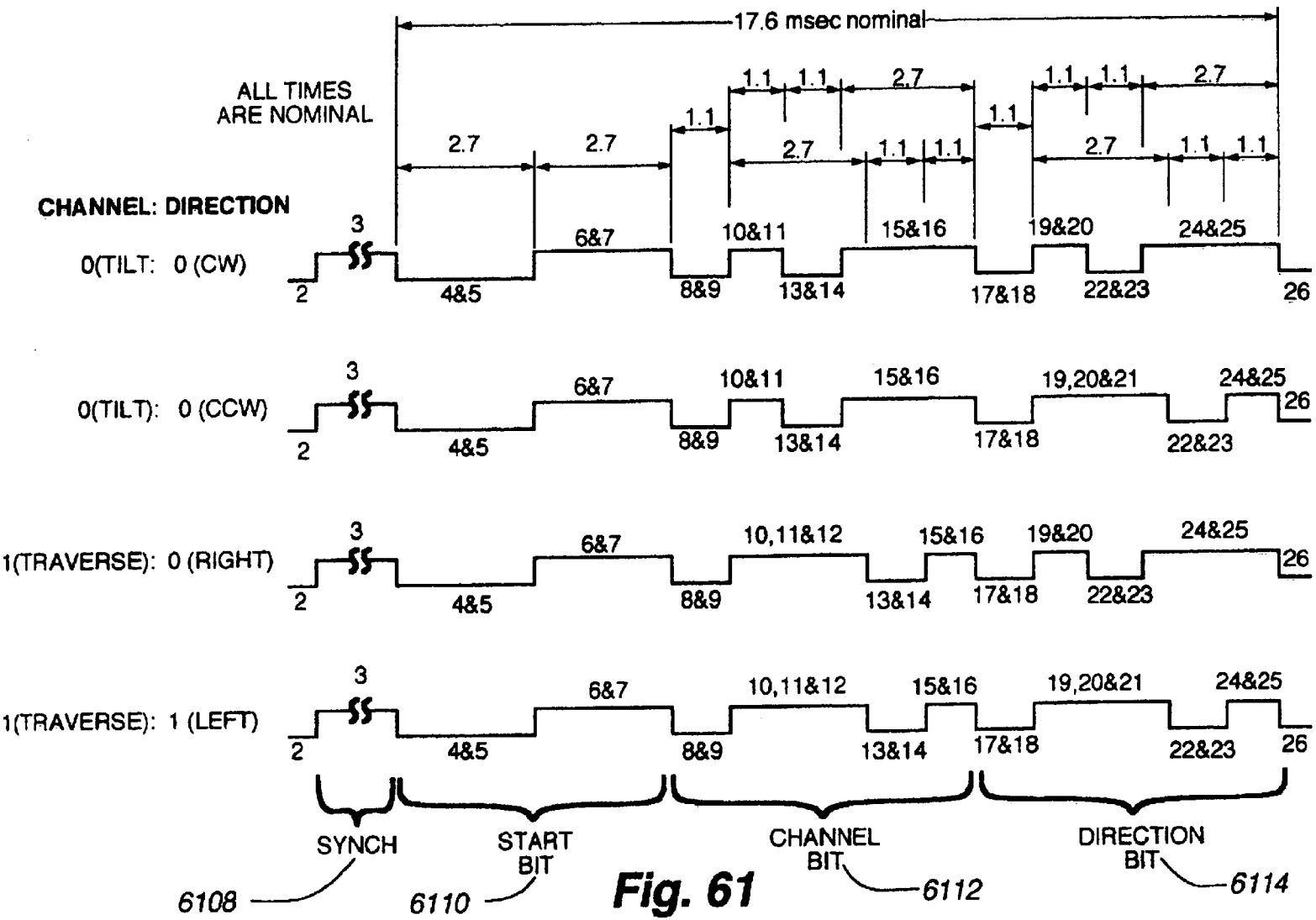
FIG. 61 depicts the pulse and pause format of messages or commands sent from the remote control to the infrared receiver comprising part of the operator hardware.

FIG. 61 depicts the format of messages delivered from the IR remote control 246. The IR remote control sends messages and commands to the logic system 240. These messages and commands consist of pulses of IR light. It is to be appreciated, as described above, other types of remote control systems and receiving sensors may be utilized in alternative embodiments of the invention. The time base of the message is a 550 microseconds clock, nominal. Tolerances are due to the clock in the remote control 246 and to the remote control clock that runs the microprocessor 252 in the logic system 240. Each pulse or each pause between the pulses lasts either two or five of the 550 microseconds time base periods. A "short" pulse or a "short" pause between pulses lasts, therefore, 1.1 milliseconds; and a "long" pulse or a "long" pause lasts 2.75 milliseconds.

Each message or command contains three bits: a Start Bit 6110, a Channel Bit 6112, and a Direction Bit 6114. This is clearly visible in FIG. 61, which shows each of the four possible IR messages, given the four permutations of the Channel 6112 and Direction Bits 6114. The Start Bit 6110 is used to synchronize the command or message. The Channel Bit 6112 contains the code for the selected channel (tilt or traverse). The Direction Bit 6114 contains the code for direction. When the tilt channel is selected in the Channel Bit 6112, the Direction Bit 6114 indicates CW or CCW. When the transverse channel is selected in the Channel Bit 6112, the Direction Bit 6114 indicates right or left.

As also shown in FIG. 61, the Start Bit 6110 consists of a long pause followed by a long pulse independent of value of the Channel Bit 6112 and Direction Bit 6114. The Channel Bit 6112 is coded in either of the following two ways:

Channel 0 (tilt command): short pause, short pulse, short pause, long pulse; or

Channel 1 (traverse command): short pause, long pulse, short pause, short pause.

The Direction Bit 6114 is coded in either of the following two ways:

Direction 0 (clockwise if tilting or right if traversing): short pause, short pause, short pause, long pulse; or Direction 1 (counter-clockwise if tilting or left if traversing): short pause, long pulse, short pause, short pause.

Note that the Channel Bit and the Direction Bit, whether a "0" bit or a "1" bit, each lasts the same total time (6 milliseconds). The total length of the message or command, including the Start Bit 6110, Channel Bit 6112, and Direction Bit 6114, is 17.4 milliseconds, nominal. In FIG. 61, the numbers noted along the waveforms are Decoder Machine States. As described further below, the Decoder Machine decodes the messages and commands.

Figure 62:
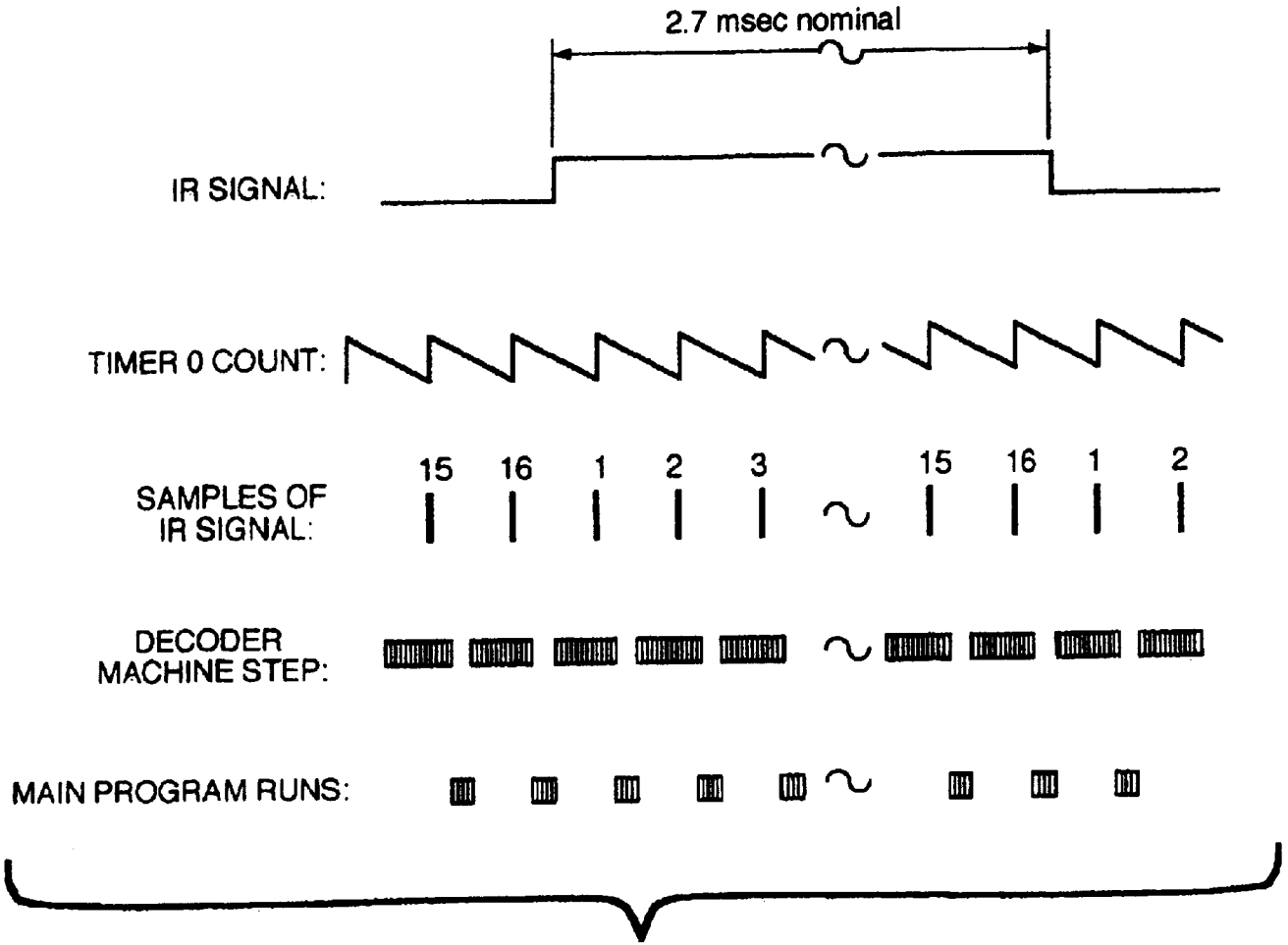
FIG. 62 is a timing diagram for a Decoder Machine used to decode the same message or command from the remote control.
Figure 64A:
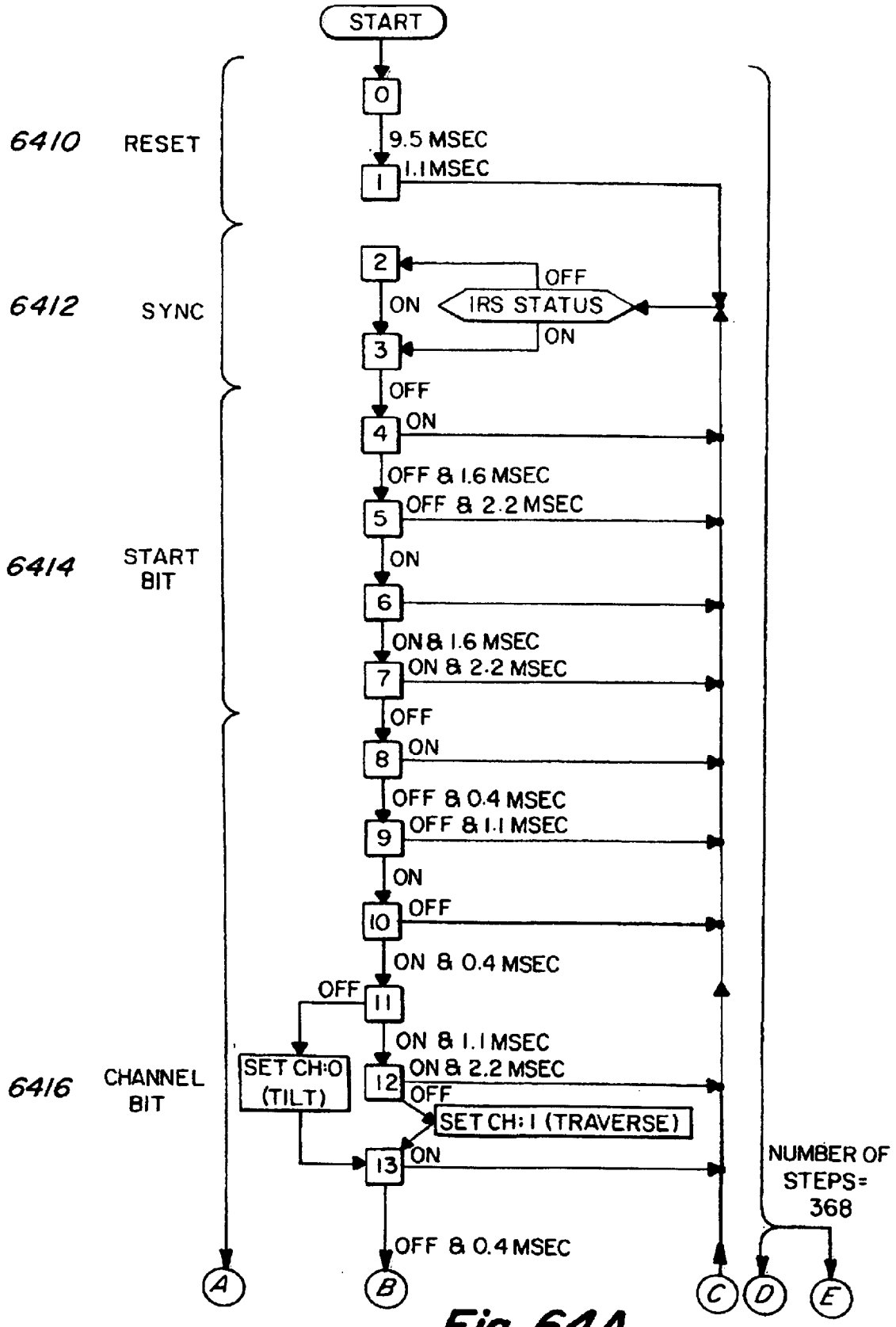
FIGS. 64A and 64B together show a state diagram for the Decoder Machine.
Figure 64B:
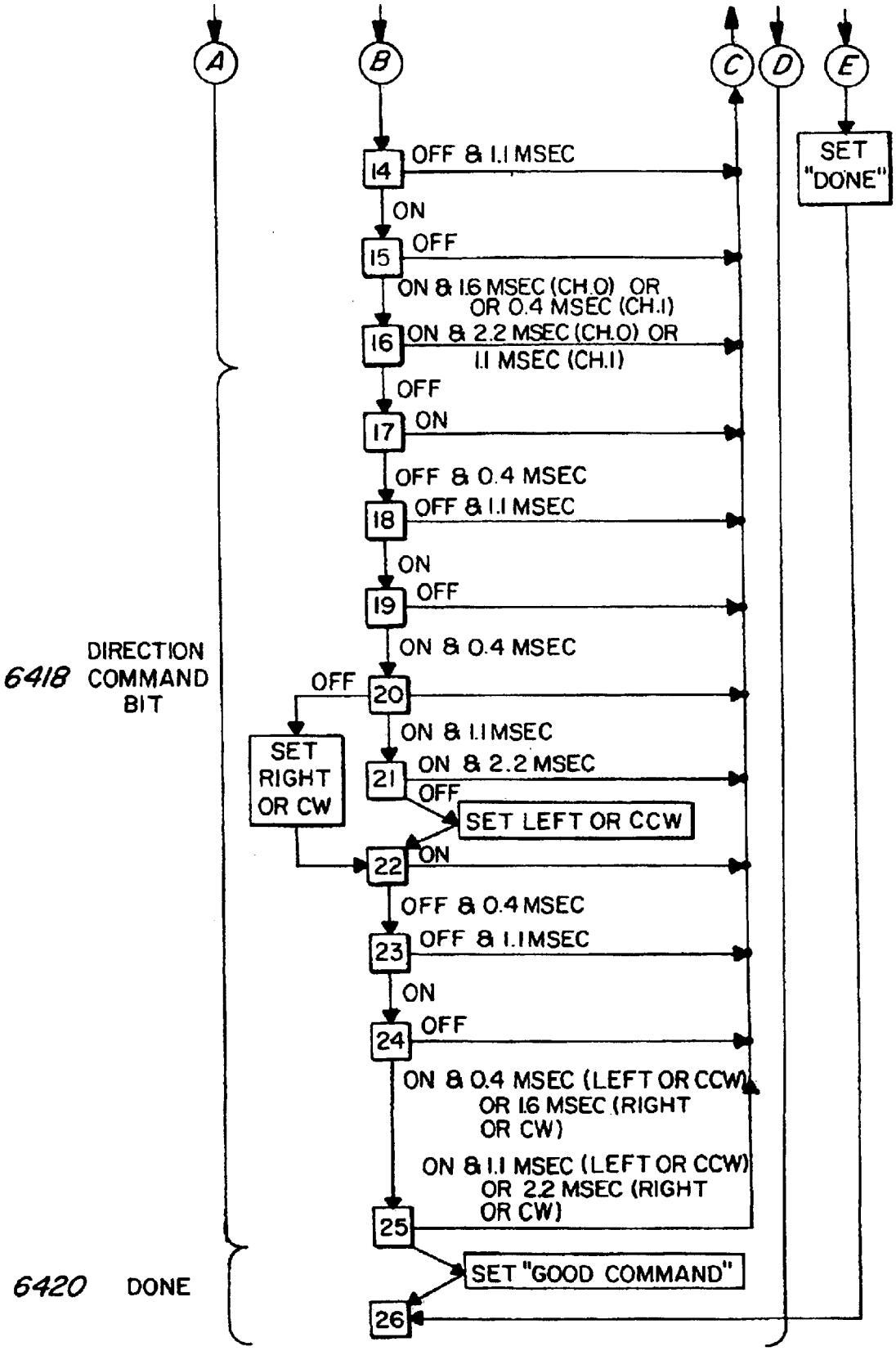

FIG. 62 provides the timing for the Decoder Machine. When ready for a command from the IR remote control, the logic system 240 calls the routine that executes one run through the Decoder Machine. Each run through the Decoder Machine comprises 368 steps as indicated in FIGS. 64A–64B. During a single step, the decoder determines whether the IR receiver 248 is receiving an IR pulse and updates the appropriate state counter, and, if applicable, changes the state of the Decoder Machine. Each step requires 160 microseconds, for a total of 59 milliseconds each time the Decoder Machine is activated. After each step, the Decoder Machine momentarily returns control to the main operating program. This allows the logic system running the main operating program to operate normally, while the decoder machine "simultaneously" decodes a message.

The Decoder Machine synchronizes itself with this 160 microseconds time base by looking at a free-running timer, Timer 0, until it underflows. Then, it restarts Timer 0 so that it will underflow again in 160 microseconds. Once it restarts Timer 0, the Decoder Machine then runs a single step and returns control to the main operating program. Within that time, the main operating program running on the logic system executes whatever it needs to do, and calls the Decoder Machine again. The Decoder Machine then catches the next 160 microsecond tick. With the 160 microsecond time base, the Decoder Machine samples the IR signal from the remote control about seven times per 1.1 millisecond period and about sixteen times per 2.7 millisecond period. Based on the number of successive steps in which a pulse is encountered and/or the number of pulses in which a "pause" is encountered in combination, the Decoder Machine can advance its state.

Even if the Decoder Machine decodes a good message before it has completed all 368 steps, it still keeps running until all 368 steps have been completed. After the Decoder Machine has run 368 steps, it declares that it is done, independent of whether it has been able to decode a good message. Therefore, the Decoder Machine typically runs for 59 milliseconds each time it runs.

Figure 63:
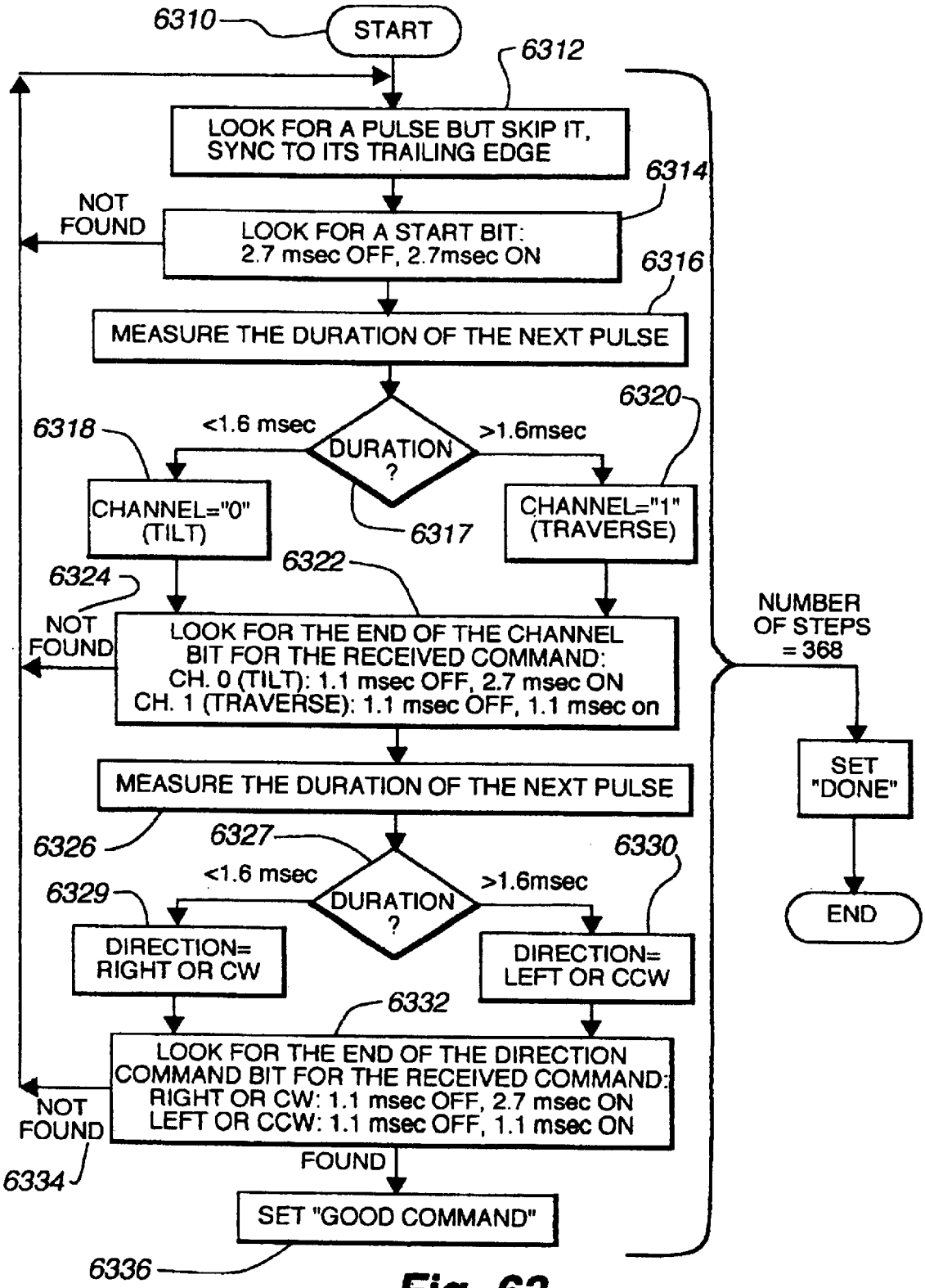
FIG. 63 is a flowchart of the algorithm used to decode messages and commands.

The Decoder Machine algorithm is depicted in FIG. 63. After the algorithm starts, block 6310, the Decoder Machine attempts to sync to the message. It does this by looking for a sync pulse 6108 (FIG. 61) in block 6312. When it sees a pulse (which may or may not be the sync pulse 6108), the Decoder Machine looks at the trailing edge of the pulse. From there, control moves to block 6314 where the Decoder Machine looks for the Start Bit. If the Decoder Machine cannot sync (e.g., because of a bad transmission or noise from other IR sources), the Decoder Machine goes back along the "not found" path and tries to catch the next message. If at block 6314, the Decoder Machine finds the start bit 6110 (FIG. 61), which, as indicated in block 6314, consists of a long pause followed by a long pulse, and is thus able to sync, it then measures the duration of the next pulse, which is the first pulse of the Channel Bit 6112 (FIG. 61), at block 6316. It is to be appreciated that durations of the pulses or pauses are measured in terms of the number of consecutive 160 microsecond steps in which the Decoding Machine measures a high condition (a pulse) or a low condition (a pause). If it is determined at block 6317 that the pulse is "short" (1.1 milliseconds), the Decoder Machine sets the channel to "0" in block 6318. This indicates that the user wants to tilt the vanes. If, on the other hand, it is determined at block 6317 that the pulse measured at block 6316 is greater than 1.6 milliseconds (i.e., a "long" (2.7 millisecond) pulse), the Decoder Machine sets the channel to "1" in block 6320. In block 6322, the Decoder Machine verifies that it has set the channel correctly. If channel "0" is correct, the Decoder Machine confirms that by recognizing a 1.1 millisecond pulse completing the Channel Bit 6112 (FIG. 61). If channel "1" is correct, the Decoder Machine confirms that by recognizing a 1.1 millisecond pause, followed by a 1.1 millisecond pulse. If the Decoder Machine is unable to confirm the channel selection, control transfers along the "not found" branch, and the Decoder Machine starts over looking for the next message.

Assuming that the channel selection is confirmed, control transfers to block 6326. In block 6326, the Decoder Machine measures the duration of the next pulse, which should be part of the Direction Bit 6114. Next, in block 6327, the Decoder Machine determines based upon the duration of the first pulse which command was sent. If the duration is less than 1.6 milliseconds, the direction is set to right traverse or clockwise tilt in block 6329. If, on the other hand, the duration is greater than 1.6 milliseconds, the direction is set to left traverse or counter-clockwise tilt in block 6330. In block 6332, the Decoder Machine verifies that it has set the direction correctly. If direction "right or CW" is correct, the Decoder Machine confirms that by recognizing a 1.1 millisecond pause followed by a 2.7 millisecond pulse completing the Direction Bit 6114 (FIG. 61). If direction "left or CCW" is correct, the Decoder Machine confirms that by recognizing a 1.1 millisecond pause, followed by a 1.1 milliseconds pulse. If the Decoder Machine is unable to confirm the direction setting, control transfers along the "not found" branch at action 6334, and the Decoder Machine starts over looking for the next message. Assuming that the direction setting is confirmed, control transfers to block 6336, where a "good command" is set.

FIGS. 64A–64B depict the states of the Decoder Machine. The Decoder Machine can be in one of twenty-seven States (0 to 26). In States 0 and 1 (6410), the Decoder Machine resets the IR receiver 248. In States 2 and 3 (6412), the Decoder Machine synchronizes itself to the message by skipping a pulse and starting its time base at the trailing edge of that pulse. In States 4–7 (6414), the Decoder Machine detects the Start Bit. In States 8–16 (6416), the Decoder Machine detects the Channel Bit. It should be noted that State 12 only occurs if the channel is "traverse." The Decoder Machine decides if the channel is "tilt" or "traverse" based upon the duration of State 11 (i.e., whether at the trailing edge of State 11, the pulse remains on (channel 1: traverse) or switches off (channel 0: tilt)). States 17–25 (6418) detect the Direction Bit. It should be noted that State 21 only occurs if the direction is "left" or "counter-clockwise." The Decoder Machine decides if the command is "right" or "left" based upon the duration of State 20 (i.e., whether, at the trailing edge of State 20, the pulse remains on (direction left or counter-clockwise) or switches off (direction right or clockwise)). When the message is over, the Decoder Machine is in State 26.

Each State comprising part of one of the three bits (Start Bit=States 4–7; Channel Bit=States 8–16; and Direction Bit=States 17–25) in a command or message has two exit points, based upon the time in the State (in milliseconds) and the status of the IR signal (i.e., on or off). Typically, each State flows to the following State. If the input IR signal does not behave as expected, however, the State flows back into States 2 and 3, to try to catch a new message or command. It should also be noted that State 11 flows into State 12 or State 13, depending upon whether the channel selected is "traverse" or "tilt," respectively. Similarly, it should be noted that State 20 flows into either State 21 or State 22, depending upon whether the direction is "left/counter-clockwise" or "right/clockwise," respectively. Finally, it should also be noted that State 26 is reached when the 368th step is performed independent of whether a good message or command was received.

Figure 65A:
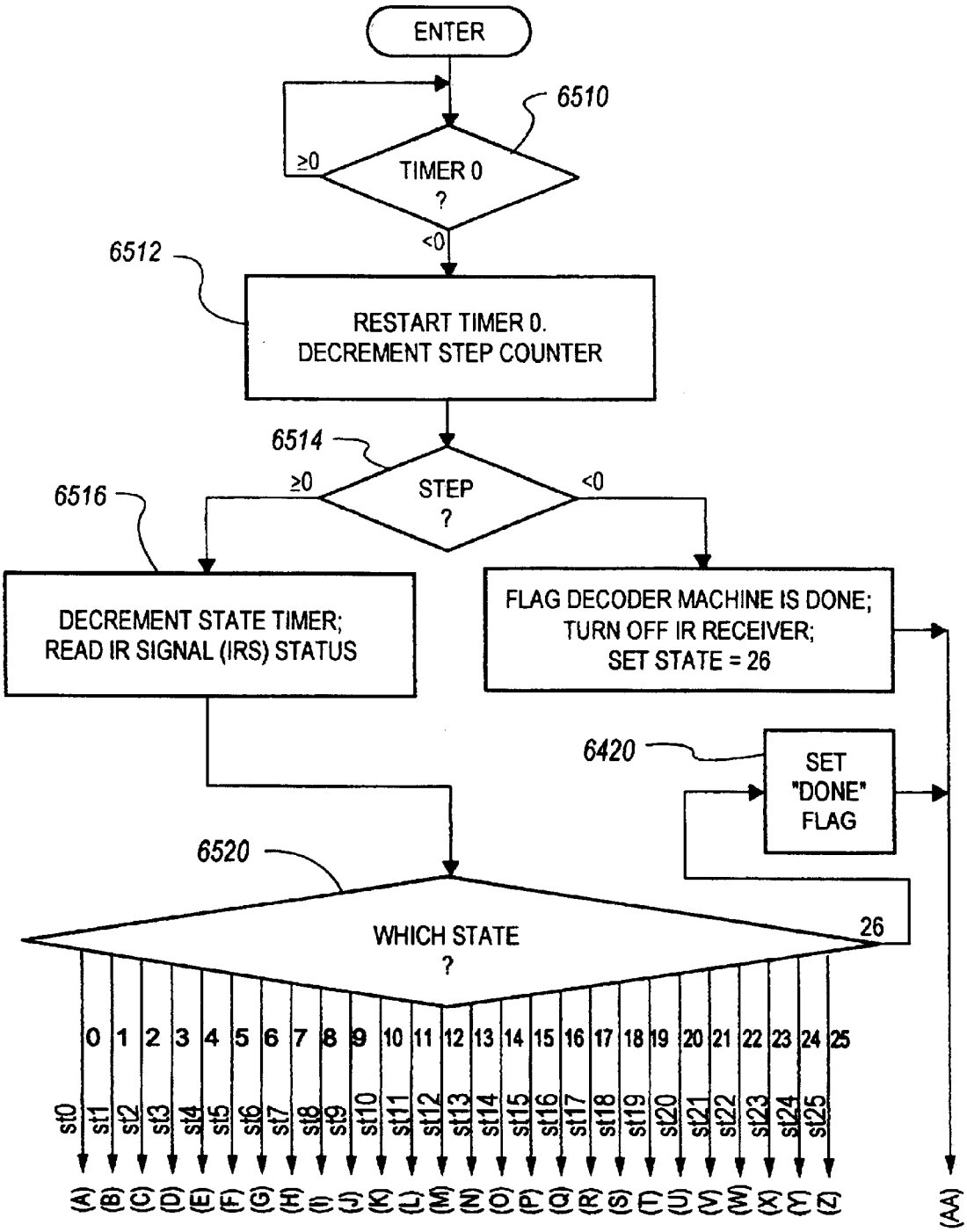
FIGS. 65A, 65B, and 65C together show a flowchart for a step through the Decoder Machine.
Figure 65B:
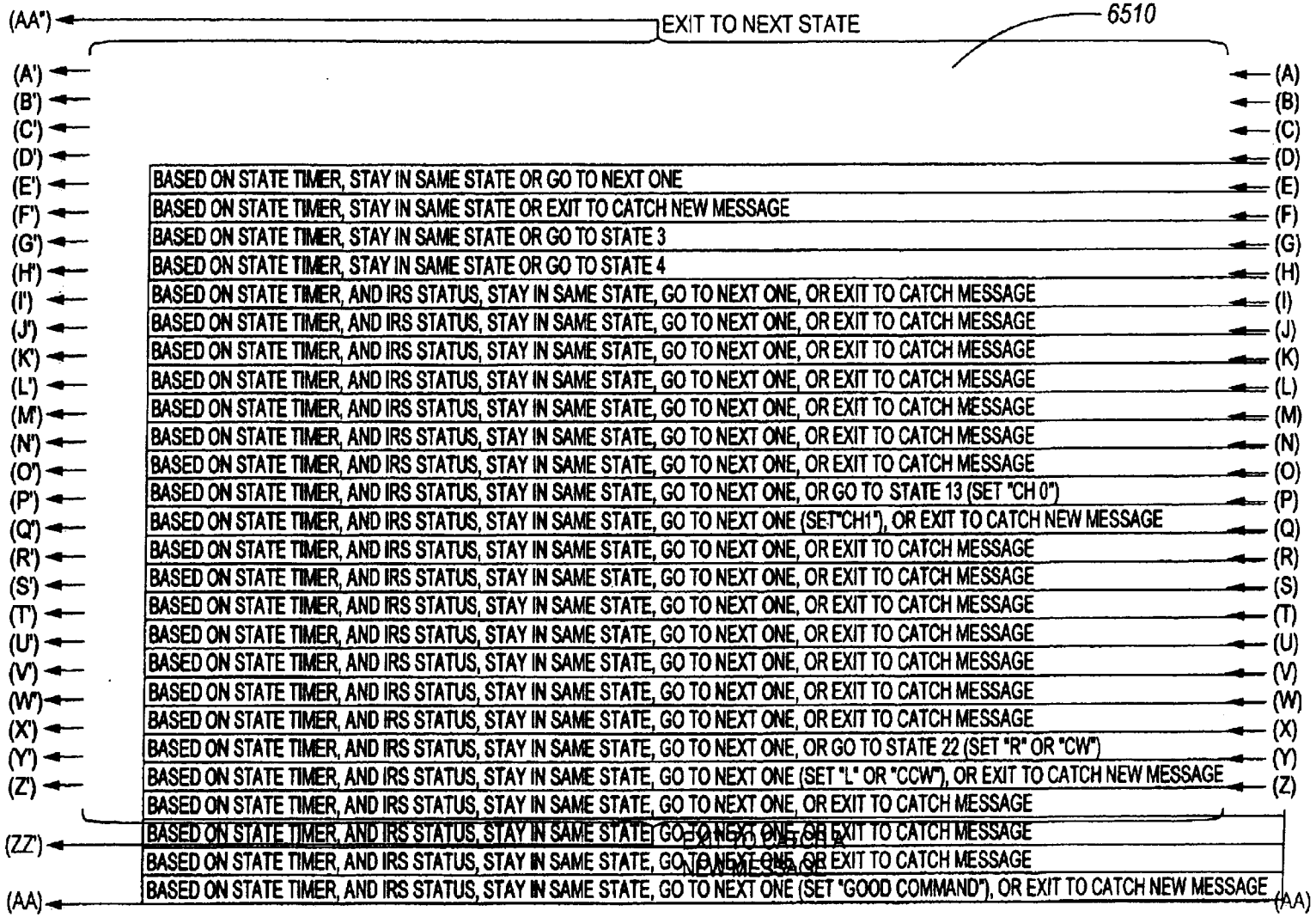
Figure 65C:
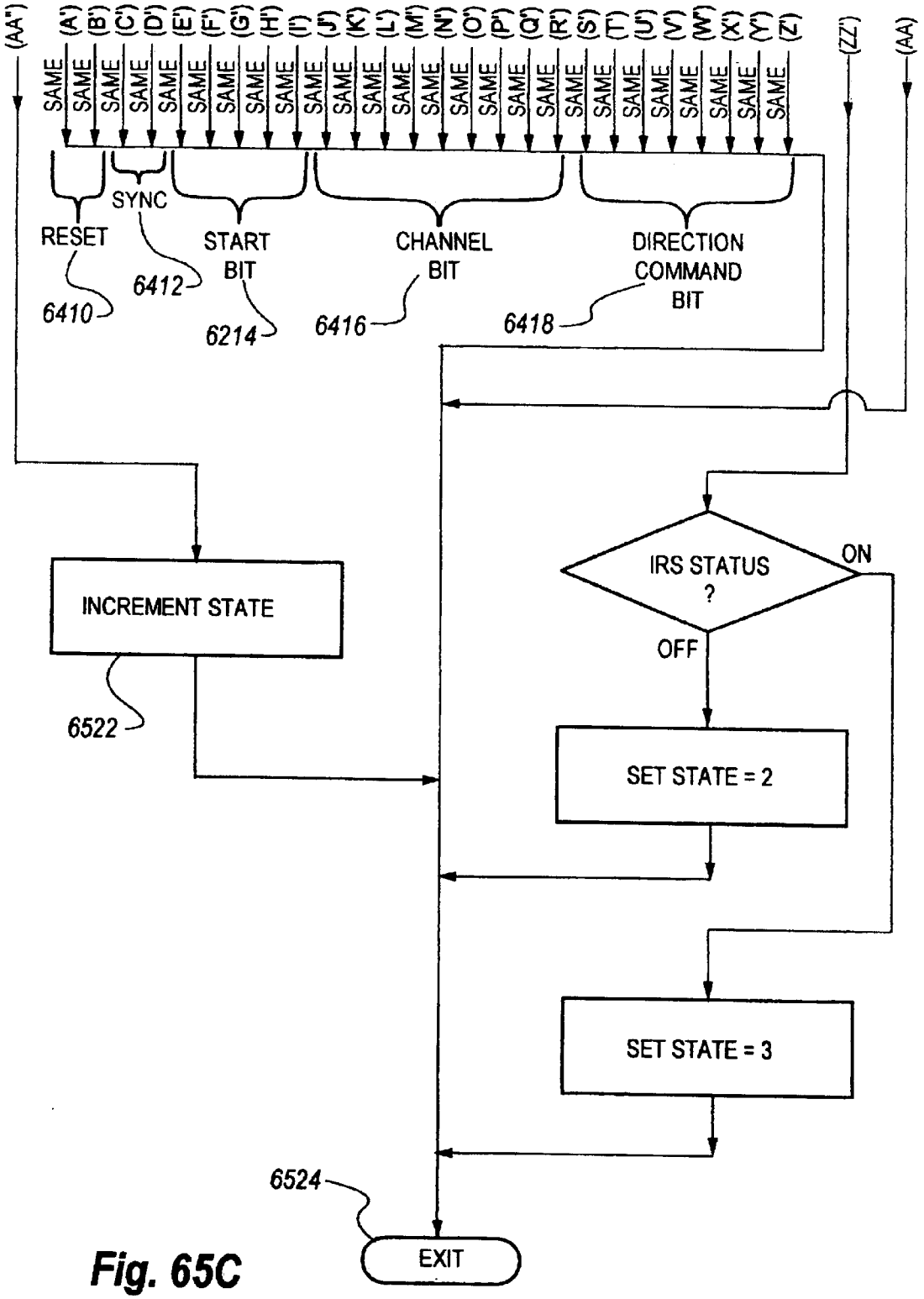

FIGS. 65A–65C are the Decoder Machine state flowchart for decoding a message. This flowchart provides an overview, demonstrating how the program decodes a message in a plurality of steps. The action taken during each step depending on what state the Decoder Machine is in as represented in block 6510.

Using FIGS. 65A–65C, an example of the typical advancement of the Decoder Machine from one state to another will be described. In boxes 6510 and 6512, the 160 microsecond timer is synchronized to the Decoder Machine. Also in box 6512, the step counter is decremented. For sake of this example, assume the step counter is lowered from step 242 to 241 (meaning 117 steps have already been completed and 241 steps including the current one remain to be completed). Since the Decoder Machine is processing step 241, which is greater than zero, the state timer is decremented in block 6516. If the step was −1 in block 6514, the Decoder Machine would move into state 26 in block 6518 and exit the Decoder Machine routine. In other words, the logic system would exit the get command block 6030 of FIG. 60 and proceed to the stop block 6070 as directed by the main operating program.

Referring back to block 6516, the IR signal is sampled. For this example we will assume that the Decoder Machine is in State 6 and an IR signal is registered and that it is the 10th consecutive signal recorded decrementing the state timer to zero. Next, the decoder Machine advances through block 6520 to the State 6 row in column 6510. Referring to the State 6 box in FIG. 64A, the Decoder Machine advances to State 7 if there has been a 160 millisecond pulse. Since each step has a time base of 160 microsecond and the state timer has registered an IR signal in 10 consecutive steps (10×160 microsecond=1.6 milliseconds), the Decoder Machine is advanced to the State 7 through box 6522. At box 6524, the 241st step has been completed and the control is momentarily returned to the main operating program of the logic system 240 until the process is repeated for step 240. The Decoder Machine will continue to advance its state until (i) a completed message is received, (ii) the failure to satisfy a state advancement condition as shown in FIGS. 64A–64B causes the Decoder Machine to return to either State 2 or 3, or (iii) the step counter is decremented to <0.

Although various embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not limiting. Changes in detail or structure may be made without departing from the spirit of the invention as defined in the appended claims.

We claim:

1. A covering system for an architectural opening, the covering system comprising at least one guide rail;

at least one vane operatively attached to said at least one guide rail;

a powered control system, said powered control system including a translational drive system operatively engaging said at least one vane to cause selective translational movement of said at least one vane along said at least one guide rail;

an angular drive system to cause selective rotation of said at least one vane to different angular positions relative to said at least one guide rail; and a logic system operatively connected to said translational drive system and to said angular drive system to control and monitor translational motion and angular motion of said at least one vane with respect to said at least one guide rail, wherein said different angular positions of said at least one vane include an open position in which said at least one vane is oriented perpendicular to said at least one guide rail, and wherein said logic system is configured to ensure that said at least one vane is in the open position before said translational drive system is activated.

2. The covering system as defined in claim 1, wherein said translational drive system includes a motor operatively connected to at least one gear, said at least one gear operatively connected to said at least one vane to translate said at least one vane along said guide rail.

3. The covering system as defined in claim 1, wherein said translational drive system further includes a motor and a drive cord extending between opposing ends of said guide rail, said drive cord (i) fixedly attached to said at least one vane and (ii) operatively coupled with a rotational shaft of said motor, and wherein movement of said drive cord resulting from activation of said motor causes the translational movement of said at least one vane along said guide rail.

4. The covering system of claim 3, further comprising a cord drive member, the cord drive member being affixed to the shaft of the motor for uniform rotational movement therewith, and the cord drive member being in engagement with the drive cord to effect movement of the drive cord when the motor is activated.

5. The covering system as defined in claim 4, wherein said drive cord comprises a beaded drive cord having a plurality of beaded members deposited along its length, and wherein said cord drive member defines channel for receiving at least a portion of said beaded drive cord in a substantially non-slipping relationship therewith.

6. The covering system as defined in claim 1, wherein said angular drive system includes a motor operatively connected to at least one vane to angularly move said at least one vane relative to said guide rail.

7. The covering system as defined in claim 6, wherein said angular drive system further includes a tilt rod, said motor operatively engaging said tilt rod, and said tilt rod operatively engaging said at least one vane, and wherein movement of the tilt rod resulting from activation of the motor angularly rotates said at least one vane relative to said guide rail.

8. The system as defined in claim 7, further comprising a gear train having one or more gears, the gear train being in operative connection with both a shaft of the motor and the tilt rod.

9. The system as defined in claim 8, wherein said gear train includes a drive gear, a driven gear, and a tilt rod drive unit, said drive gear secured to the shaft said motor for uniform rotation therewith, said driven gear operatively engaging both said drive gear and said tilt rod drive unit, and said tilt rod drive unit operatively engaging said tilt rod.

10. The covering system as defined in claim 1, wherein said powered control system is contained in a housing and attached to one end of said guide rail.

11. The covering system as defined in claim 1, wherein said at least one guide rail extends substantially horizontally, and wherein said at least one vane extends substantially orthogonal from said guide rail.

12. A covering system for an architectural opening, the covering system comprising a headrail;

at least one tilt rod rotatably mounted with respect to said headrail;

at least one carrier operatively mounted on said tilt rod to allow said carrier to translationally move along said tilt rod;

a hanger pin pivotally attached to said at least one carrier;

a first gear train operatively associated with said at least one carrier and operatively attached between said tilt rod and said hanger pin;

at least one vane operatively attached to said hanger pin;

a drive cord formed in a loop and extending along said headrail, said at least one carrier being attached to said drive cord;

a powered control system, said powered control system including a translational drive system operatively engaging said drive cord for selective translational movement of said at least one vane along said headrail;

an angular drive system operatively engaging said tilt rod to cause selective rotation of said at least one vane to different angular positions relative to said headrail; and a logic system operatively connected to said translational drive system and to said angular drive system to control and monitor the translational motion and angular motion of said at least one vane with respect to said headrail.

13. The covering system as defined in claim 12, wherein said translational drive system includes a motor operatively connected to at least one gear, said at least one gear operatively connected to said at least one vane to translate said vane along said headrail.

14. The covering system as defined in claim 13, wherein said translational drive system further includes a cord drive member operatively attached to said motor and to said drive cord, and said drive cord operatively attached to said at least one vane, and wherein said logic system energizes said motor to rotate said cord drive member to move said drive cord and cause the selective translational movement of said vane along said headrail.

15. The system as defined in claim 14, wherein said drive cord is a beaded drive cord, and wherein said cord drive member is a beaded cord drive member defining a beaded cord drive channel for receiving at least a portion of said beaded drive cord.

16. The system as defined in claim 12, wherein said angular drive system includes a motor operatively connected to a gear train, said gear train operatively connected to at least one vane to angularly move said vane relative to said headrail.

17. The system as defined in claim 16, wherein said angular drive system further includes a second gear train, said motor operatively engaging said second gear train, and said second gear train operatively engaging said tilt rod, and said tilt rod operatively engaging said first gear train, and wherein said logic system energizes said motor to actuate said second gear train to rotate said tilt rod to angularly rotate said vane relative to said guide rail.

18. The system as defined in claim 17, wherein said second gear train includes a drive gear, a driven gear, and a tilt rod drive unit, said drive gear operatively engaging said motor and said driven gear, said driven gear operatively engaging said tilt rod drive unit, and said tilt rod drive unit operatively engaging said tilt rod.

19. The system as defined in claim 12, wherein said powered control system is contained in a housing and suspended from one end of said headrail.

20. The system as defined in claim 12, wherein said headrail extends horizontally, and wherein said at least one vane extends orthogonally from said headrail.

21. A covering system for an architectural opening comprising a headrail;

at least one vane coupled to the headrail for translational movement along the headrail;

a motorized drive system for translationally moving the at least one vane along the headrail, wherein the motorized drive system includes a motor having an output shaft;

a cord drive member operatively coupled to the output shaft, wherein the cord drive member includes at least one tab that extend radially outwardly from a body of the cord drive member; and a drive cord extending from a first end of the headrail to a second end of the headrail, the drive cord being operatively coupled to the cord drive member and to the at least one vane, wherein activation of the motor rotates the cord drive member which moves the drive cord which causes the at least one vane to move translationally along the headrail;

a logic system operatively coupled to the motorized drive system, wherein the logic system is adapted to determine the translational position of the at least one vane along the headrail and to control the translational movement of the at least one vane responsive to input from a user; and a sensor electrically coupled with the logic system, wherein said at least one tab that extend radially outwardly from said body of said drive member pass in close proximity to the sensor, whereby the sensor can determine movement of the drive cord.

22. The covering system of claim 21, wherein the drive cord comprises a continuous looped drive cord having a plurality of bead structures attached thereto.

23. The covering system of claim 22, wherein said cord drive member has a channel formed therein, the channel including at least one pocket, each pocket of said at least one pocket being sized to receive one of the bead structures.

24. The covering system of claim 23, wherein the drive cord is looped around a pulley proximate the first end of the headrail and is looped around the cord drive member proximate the second end of the headrail, with a portion of the drive cord received in the channel.

25. The covering system of claim 23, wherein the cord drive member is attached to the output shaft for uniform rotational movement with the output shaft.

26. The covering system of claim 25, wherein the cord drive member further includes a keyed recess corresponding to the outer shape of the output shaft to rotationally affix the cord drive member to the output shaft.

27. The covering system of claim 21, wherein the sensor transmits a signal to the logic system each time a tab of the at least one tab passes in close proximity to the sensor, and wherein the logic system determines the position of the at least one vane based at least partially on the signal.

28. The covering system of claim 21, wherein the at least one vane is coupled to the headrail by a carrier, the carrier being adapted for translational movement along the headrail, and wherein the drive cord is fixedly secured to the carrier.

29. The covering system of claim 21, wherein the logic system comprises a microprocessor.

30. The covering system of claim 29, wherein the microprocessor is a programmable integrated circuit.

31. The covering system of claim 29, wherein the logic system further comprises a wireless receiver for receiving signals directing the translational movement of the at least one vane from a remote control.

32. The covering system of claim 31, wherein the receiver is a infrared receiver.

33. The covering system of claim 21, wherein the motor and the logic system are substantially contained within and supported by a housing structure, the housing structure being connected with the second end of the headrail.

34. The covering system of claim 33, wherein the housing structure is connected to the second end of the headrail by a connector bracket, the connector bracket being fixedly secured to both the headrail and the housing structure.

35. The covering system of claim 21, wherein the at least one vane includes a plurality of vanes, each vane being associated with a carrier of a plurality of carriers, each carrier being coupled to the headrail, only one carrier of the plurality of carriers being fixedly attached to the drive cord, the other carriers of the plurality of carriers being coupled with the one carrier and each other carrier by a pantograph structure.

36. The covering system of claim 21, wherein the drive cord comprises a loop extending from the first end to the second end of the headrail, wherein said loop has a first side and a second side, and wherein the at least one vane includes a plurality of vanes, the of said plurality of vanes being associated with a carrier of a plurality of carriers, each carrier of said plurality of carriers being coupled to the headrail, and wherein a first carrier of said plurality of carriers is attached to said first side of said loop, and wherein a second carrier of said plurality of carriers is attached to said second side of said loop and is adjacent to said first carrier, and wherein the carriers of the plurality of carriers other than said first and second carriers are coupled with either said first carrier or said second carrier by a pantograph structure.

37. A covering system for an architectural opening, the covering system comprising:

a headrail having a length;

an elongated tilt rod having a longitudinal axis and extending substantially the length of the headrail;

at least one vane coupled to said tilt rod;

a motorized drive system comprising a motor having an output shaft operatively coupled to said tilt rod by one or more gears for rotating said tilt rod about its said longitudinal axis and thereby pivoting the at least one vane about a pivot axis, the pivot axis being one of a longitudinal axis of the vane and an axis proximate and substantially parallel with the longitudinal axis of the vane, wherein the motor is vertically orientated with the output shaft of the motor being rotational about a longitudinal axis of the motor, wherein the tilt rod is horizontally-orientated, and wherein the one or more gears convert the vertical rotation of the output shaft into horizontal rotation of the tilt rod; and a logic system operatively coupled to the motorized drive system, the logic system adapted to determine the pivotal position of the at least one vane and to control the pivotal movement of the at least one vane responsive to input from a user.

38. The covering system of claim 37, wherein the one or more ears include (i) a drive gear coupled to the output shaft of the motor for unitary motion therewith, (ii) a slave gear meshed with the drive gear for rotation therewith, the slave gear including a worm gear formed thereon, and (iii) a tilt rod drive unit, the tilt rod drive unit including gear teeth meshed with the worm gear and a recess keyed to an outer shape of the tilt rod for receiving the tilt rod therein.

39. The covering system of claim 37, wherein the logic system comprises a microprocessor.

40. The covering system of claim 39, wherein the microprocessor is a programmable integrated circuit.

41. The covering system of claim 39, wherein the logic system further comprises a wireless receiver for receiving signals directing the pivotal movement of the at least one vane from a remote control.

42. The covering system of claim 41, wherein the receiver is an infrared receiver.

43. The covering system of claim 37, wherein the motor and the logic system are substantially contained within and supported by a housing structure, the housing structure being connected with the headrail.

44. The covering system of claim 43, wherein the headrail includes two ends and the housing structure is connected to one end of the headrail by a connector bracket, the connector bracket being fixedly secured to both the headrail and the housing structure.

45. The covering system of claim 37, further comprising a tilt rod drive unit, the tilt rod drive unit having (1) generally cylindrical body with opposite first and second ends, (2) gear teeth formed on the exterior of the body, the gear teeth configured for meshing with the one or more gears, and (3) a recessed cavity keyed to an external shape of the tilt rod in the first end for receiving the tilt rod therein and rotating unitarily therewith.

46. The covering system of claim 45, wherein the motor and the logic system are substantially contained within and supported by a housing structure, the housing structure including a generally u-shaped slot, and wherein the generally cylindrical body further includes a inwardly extending circumferential recess, the diameter of the generally cylindrical body being greater than the spacing between legs of the u-shaped slot and the diameter of the circumferential recess being less than the spacing between the legs of the u-shaped slot, the tilt rod drive unit being rotatably received into the u-shaped slot at the circumferential recess.

47. The covering system of claim 46 wherein the housing structure includes a positioning tang, the positioning tang extending upwardly from a bottom side of the housing structure and having an arcuate top end, and wherein cylindrical body proximate the second end is supported by the positioning tang.

48. The covering system of claim 45, further comprising a sensor electrically coupled with the logic system for measuring the extent of rotational movement of the tilt rod drive unit.

49. A covering system for an architectural opening comprising:

a headrail;

at least one vane operatively coupled to the headrail;

a first motorized drive system for pivoting the at least one vane about an axis, the axis being one of a longitudinal axis of the vane and an axis substantially parallel and proximate with the longitudinal axis of the vane;

a second motorized drive system for translationally moving the vane along the headrail;

a logic system operatively coupled to the first and second motorized drive systems, the logic system being adapted to determine both a pivotal position of the vane and a translational position of the vane along the headrail, and the logic system further being adapted to control pivotal movement and translational movement of the at least one vane responsive to input from a user, wherein said pivotal position of said at least one vane includes an open position in which said at least one vane is oriented perpendicular to said headrail, and wherein said logic system is configured to ensure that said at least one vane is in said open position before said second motorized drive system is activated.

50. The covering system of claim 49, further comprising:

a tilt rod extending substantially the entire length of the headrail; and at least one carrier, the at least one carrier being coupled to the headrail and to the tilt rod for translational movement relative to both the headrail and the tilt rod;

wherein the first motorized drive system includes a first motor and one or more gears for operatively coupling the first motor to said tilt rod, the tilt rod being operatively coupled to the at least one vane through a gear train in the carrier, activation of the motor causing the tilt rod to rotate and the at least one vane to pivot.

51. The covering system of claim 50, further comprising:

a looped drive cord; and a cord drive member, the cord drive member being (i) coupled to a shaft of a second motor of the second motorized drive system for rotational motion therewith and (ii) operatively coupled to the drive cord for moving a section of the drive cord between a first location proximate a first end of the headrail to a second location proximate a second end of the headrail;

wherein the at least one carrier is attached to the section of the drive cord.

52. The covering system of claim 51, further including a translational sensor coupled with the logic system for measuring the rotation of the second motor, and wherein the logic system utilizes signals from the translational sensor to determine the translational position of the at least one vane on the headrail.

53. The covering system of claim 52, further including an angular sensor coupled with the logic system for measuring the rotation of the tilt rod, and wherein the logic system utilizes signals from the angular sensor to determine the angular position of the at least one vane relative to the headrail.

54. The covering system of claim 49, further including an angular sensor coupled with the logic system for measuring the rotation of the tilt rod, and wherein the logic system utilizes signals from the angular sensor to determine the angular position of the at least one vane relative to the headrail.

55. The covering system of claim 49, wherein the logic system is electronic.

56. The covering system of claim 55, wherein the logic system includes a microprocessor.

57. The covering system of claim 56, wherein the microprocessor is a programmable integrated circuit.

58. The covering system of claim 56, wherein the logic system includes a wireless receiver to receive command signals from a remote control.

59. The covering system of claim 58, wherein the receiver is an infrared receiver.

60. The covering system of claim 59, wherein the infrared receiver comprises a fiber optic cable.

61. The covering system of claim 58, wherein the logic system activates one of the first and second motorized drive systems responsive to commands received from the remote control.

62. A control system for controlling the translational movement of at least one vane of a covering system for an architectural opening, the covering system including a headrail with first and second ends, a tilt rod extending longitudinally substantially the length of the headrail, at least one carrier slidably coupled to the headrail and the tilt rod, and the at least one vane depending from the carrier, the control system comprising:

a translational drive system including a first motor, a drive cord, and a cord drive member, the cord drive member being operatively coupled to a shaft of the first motor for rotational movement therewith and being operatively coupled to the drive cord to move the drive cord, the drive cord being adapted for coupling to said at least one carrier to translationally move said carrier and said vane along said headrail;

a logic system including a microprocessor;

a translational sensor coupled to the logic system; and a wireless receiver coupled to the logic system;

wherein the translational sensor is for measuring the rotation of the first motor and sending signals related thereto to the microprocessor, the wireless receiver is adapted for receiving command signals from a remote control, and the microprocessor is configured to (1) compute the position of said at least one vane based at least partially on the signals from the translational sensor, and (2) activate and control the operation of the first motor based on command signals received by the wireless receiver.

63. The control system of claim 62, further comprising a housing structure wherein the first motor, the logic system and the cord drive member are substantially contained within the housing structure.

64. The control system of claim 63, wherein the housing structure is adapted for retrofitting an existing covering system for an architectural opening.

65. The control system of claim 63, further comprising a connector bracket, the connector bracket being adapted to be fixedly secured to the housing structure and said headrail.

66. The control system of claim 62, further comprising:

an angular drive system, the angular drive system including a second motor, a tilt rod drive unit for operatively coupling with said tilt rod, one or more gears operatively coupling the second motor with the tilt rod drive unit for transferring rotational motion from a shaft of the second motor to the tilt rod drive unit; and wherein the control system further comprises an angular position sensor for measuring the rotation of the tilt rod drive unit and sending signals related thereto to the microprocessor, and wherein the microprocessor is further configured to (1) compute the angular position of said at least one vane relative to said headrail based at least partially on the signals from the angular position sensor, and (2) activate and control the operation of the second motor based on command signals received by the wireless receiver.

67. A control system for controlling the angular pivotal movement of at least one vane of a covering system for an architectural opening, the covering system including a headrail with first and second ends, a tilt rod extending longitudinally substantially the length of the headrail, at least one carrier slidably coupled to the headrail and the tilt rod, and the at least one vane depending from the carrier, the at least one vane being adapted for pivotal movement when the tilt rod is rotated, the control system comprising:

an angular drive system, the angular drive system including a first motor, a tilt rod drive unit for operatively coupling with said tilt rod, one or more gears operatively coupling the first motor with the tilt rod drive unit for transferring rotational motion from a shaft of the first motor to the tilt rod drive unit; and a logic system including a microprocessor;

an angular position sensor coupled to the logic system; and a wireless receiver;

wherein the angular position sensor is adapted for measuring the rotation of the tilt rod drive unit and sending signals related thereto to the microprocessor, the wireless receiver is adapted for receiving command signals from a remote control, and the microprocessor is configured to (1) compute the angular position of said at least one vane relative to said headrail based at least partially on the signals from the angular position sensor, and (2) activate and control the operation of the first motor based on command signals received by the wireless receiver.

68. The control system of claim 67, further comprising a housing structure wherein the first motor, the logic system and at least a substantial portion of the tilt rod drive are contained within the housing structure.

69. The control system of claim 68, wherein the housing structure is adapted for retrofitting an existing covering system for an architectural opening.

70. The control system of claim 68, further comprising a connector bracket, the connector bracket being adapted to be fixedly secured to the housing structure and said headrail.

71. The control system of claim 68, further comprising:

a translational drive system including a second motor, a drive cord, and a cord drive member, the cord drive member being operatively coupled to a shaft of the second motor for rotational movement therewith and being operatively coupled to the drive cord to move the drive cord, the drive cord being adapted for coupling to said at least one carrier to translationally move said at least one carrier and said at least one vane along said headrail; and a translational sensor for measuring the rotation of the second motor and sending signals related thereto to the microprocessor; and wherein the microprocessor is further configured to (1) compute the position of said at least one vane based at least partially on the signals from the translational sensor, and (2) activate and control the operation of the second motor based on command signals received by the wireless receiver.

72. A method of operating a control system for a covering system for an architectural opening, the covering system including a headrail and at least one vane depending from the headrail, the control system including (i) a translational drive system for moving the at least one vane translationally along the headrail from a retracted position to an extended position, (ii) an angular drive system for pivoting the at least one vane between open and closed angular positions, (iii) a logic system, and (iv) a plurality of sensors for receiving signals from the translational drive system, the angular drive system, and a remote control, the method comprising:

receiving a signal from a remote control;

determining a command by decoding the signal from the remote control; and activating one of the translational drive system and the angular drive system based on the command to either move the at least one vane translationally along the headrail or pivot the at least one vane between the open and closed positions, wherein the method further comprises ensuring activating said translational system is subject to prior detecting and controlling the angular position of said angular drive system.

73. The method of claim 72, wherein the translational drive system is activated to move the at least one vane translationally along the headrail, and wherein the method further comprises:

automatically deactivating the translational drive system when a limit is reached, the limit being one of the at least one vane being in the retracted position and the at least one vane being in the extended position.

74. The method of claim 72, wherein the angular drive system is activated to pivot the at least one vane between open an closed positions and wherein the method further comprises:

automatically deactivating the angular drive system when the vane is pivoted into one of the open and closed positions.

75. The method of claim 72, further comprising:

sampling for signals from a wireless remote for a first predetermined period of time; and if no signal from the wireless remote is received, (i) setting and alarm for a second predetermined period of time, (ii) entering sleep mode for the second predetermined period of time wherein no sampling is preformed while in sleep mode, and (iii) waking from sleep mode at the expiration of the second predetermined period of time.

76. The method of claim 72, wherein the signal from the remote control comprises a start bit, a channel bit and a direction bit, wherein the start bit is utilized by the control system to synchronize with the remote control, the channel bit indicates whether at least one vane is to be pivoted or moved translationally, and the direction bit indicates the direction the at least one vane is to be moved.

77. A covering system for an architectural opening comprising:

a headrail;

at least one vane coupled to the headrail;

a motorized drive system for pivoting the at least one vane about an axis, the axis being one of a longitudinal axis of the vane and an axis proximate and substantially parallel with the longitudinal axis of the vane;

a logic system operatively coupled to the motorized drive system, the logic system adapted to determine the pivotal position of the vane and to control the pivotal movement of the vane responsive to input from a user;

an elongated tilt rod extending substantially the length of the headrail, wherein the motorized drive system includes a motor and one or more gears for operatively coupling to the tilt rod permitting the tilt rod to rotate about a longitudinal axis of the tilt rod, and wherein the motor is substantially vertically orientated with a shaft of the motor being rotational about a longitudinal axis of the motor, and the tilt rod is substantially horizontally-orientated, and wherein the one or more gears convert the substantially vertical rotation of the shaft into substantially horizontal rotation of the tilt rod; and a tilt rod drive unit, the tilt rod drive unit having (1) generally cylindrical body with opposite first and second ends, (2) gear teeth formed on the exterior of the body, the gear teeth configured for meshing with the one or more gears, (3) a recessed cavity keyed to an external shape of the tilt rod in the first end for receiving the tilt rod therein and rotating unitarily therewith, wherein the tilt rod drive unit further includes a indicator flange extending radially from the generally cylindrical body over generally one half a circumference of the generally cylindrical body, the indicator flange having first and second radially-extending edges.

78. The covering system of claim 77, further comprising a sensor electrically coupled with the logic system for measuring the extent of rotational movement of the tilt rod drive unit, wherein the indicator flange passes one of between, over, and under the sensor in close proximity therewith.

79. The covering system of claim 78, wherein the sensor sends a signal to the logic system when either the first or second radially-extending edges passes one of between, over, and under the sensor in close proximity therewith.

80. The covering system of claim 79, wherein when the first radially-extending edge passes the sensor the vane is in an open position, and wherein when the second radially-extending edge passes the sensor the vane is in a closed position, the closed position being approximately perpendicular to the open position.

81. The covering system of claim 79, wherein when the first radially-extending edge passes the sensor the vane is in an open position, and wherein when the third radially-extending edge passes the sensor the vane is in a closed position, the closed position being approximately perpendicular to the open position.

82. A covering system for an architectural opening comprising:

a headrail;

at least one vane coupled to the headrail;

a motorized drive system for pivoting the at least one vane about an axis, the axis being one of a longitudinal axis of the vane and an axis proximate and substantially parallel with the longitudinal axis of the vane;

a logic system operatively coupled to the motorized drive system, the logic system adapted to determine the pivotal position of the vane and to control the pivotal movement of the vane responsive to input from a user;

an elongated tilt rod extending substantially the length of the headrail, wherein the motorized drive system includes a motor and one or more gears for operatively coupling to the tilt rod permitting the tilt rod to rotate about a longitudinal axis of the tilt rod, and wherein the motor is substantially vertically orientated with a shaft of the motor being rotational about a longitudinal axis of the motor, and the tilt rod is substantially horizontally-orientated, and wherein the one or more gears convert the substantially vertical rotation of the shaft into substantially horizontal rotation of the tilt rod; and a tilt rod drive unit, the tilt rod drive unit having (1) generally cylindrical body with opposite first and second ends, (2) gear teeth formed on the exterior of the body, the gear teeth configured for meshing with the one or more gears, (3) a recessed cavity keyed to an external shape of the tilt rod in the first end for receiving the tilt rod therein and rotating unitarily therewith, wherein the tilt rod drive unit further includes first and second indicator flanges extending radially from the generally cylindrical body, each extending over generally one quarter the circumference of the generally cylindrical body, the first indicator flange being generally directly opposite the second indicator flange, the first indicator flange having first and second radially-extending edges, and the second indicator flange having third and forth radially-extending edges, the first and third radially-extending edges being radially substantially collinear and opposite each other.

83. The covering system of claim 82, further comprising a sensor electrically coupled with the logic system for measuring the extent of rotational movement of the tilt rod drive unit, wherein the first and second indicator flanges pass one of between, over, and under the sensor in close proximity therewith during rotation of the tilt rod drive unit.

84. The covering system of claim 83, wherein the sensor sends a signal to the logic system when either the first, second, third or forth radially-extending edges passes one of between, over, and under the sensor in close proximity therewith.

* * * * *

UNITED STATES PATENT AND TRADEMARK OFFICE

CERTIFICATE OF CORRECTION

PATENT NO. : 6,755,230 B2
DATED : June 29, 2004
INVENTOR(S) : Bogdan R. Ulatowski et al.

It is certified that error appears in the above-identified patent and that said Letters Patent is hereby corrected as shown below:

Title page,
Item [56], References Cited, U.S. PATENT DOCUMENTS, delete "93,297, 07/1869, Schnelby et al." and insert -- US 2002/0093297 A1, 07/2002, Schnebly et al. --.

Signed and Sealed this

Thirty-first Day of August, 2004

JON W. DUDAS
*Director of the United States Patent and Trademark Office*